US010252109B2

(12) United States Patent
Watterson

(10) Patent No.: US 10,252,109 B2
(45) Date of Patent: Apr. 9, 2019

(54) WEIGHT PLATFORM TREADMILL

(71) Applicant: ICON Health & Fitness, Inc., Logan, UT (US)

(72) Inventor: Scott R. Watterson, Providence, UT (US)

(73) Assignee: ICON Health & Fitness, Inc., Logan, UT (US)

( * ) Notice: Subject to any disclaimer, the term of this patent is extended or adjusted under 35 U.S.C. 154(b) by 55 days.

(21) Appl. No.: 15/461,246

(22) Filed: Mar. 16, 2017

(65) Prior Publication Data

US 2017/0326411 A1 Nov. 16, 2017

Related U.S. Application Data

(60) Provisional application No. 62/336,567, filed on May 13, 2016.

(51) Int. Cl.
*A63B 22/00* (2006.01)
*A63B 24/00* (2006.01)
(Continued)

(52) U.S. Cl.
CPC ..... *A63B 24/0075* (2013.01); *A61H 1/005* (2013.01); *A63B 21/072* (2013.01); *A63B 21/0726* (2013.01); *A63B 22/0023* (2013.01); *A63B 22/0207* (2015.10); *A63B 22/0235* (2013.01); *A63B 22/0285* (2013.01); *A63B 71/0036* (2013.01); *A63B 71/0619* (2013.01); *A63B 71/0622* (2013.01); *A63B 71/0686* (2013.01); *A61H 2201/0165* (2013.01); *A61H 2201/1215* (2013.01); *A61H 2201/5043* (2013.01); *A61H 2201/5058* (2013.01); *A61H 2201/5079* (2013.01); *A61H 2201/5084* (2013.01); *A61H 2201/5092* (2013.01); *A61H 2201/5097* (2013.01); *A61H 2203/0406* (2013.01); *A63B 69/0057* (2013.01); *A63B 2071/065* (2013.01); *A63B 2071/0694* (2013.01); *A63B 2209/08* (2013.01);
(Continued)

(58) Field of Classification Search
None
See application file for complete search history.

(56) References Cited

U.S. PATENT DOCUMENTS 9,595 A 2/1853 Moreland
9,695 A 5/1853 Hinsdale
(Continued)

FOREIGN PATENT DOCUMENTS

KR 100829744 5/2018
TW M504568 3/2015
(Continued)

OTHER PUBLICATIONS

International Search Report issued in PCT/US17/23002 dated Jun. 28, 2017.
(Continued)

*Primary Examiner* — Stephen R Crow
(74) *Attorney, Agent, or Firm* — Ray Quinney & Nebeker

(57) ABSTRACT

A treadmill includes a deck, a first pulley disposed in a first portion of the deck, a second pulley disposed in a second portion of the deck, a tread belt surrounding the first pulley and the second pulley, and a platform incorporated into the deck.

20 Claims, 11 Drawing Sheets

(51) Int. Cl.

| | |
|---|---|
| ***A63B 21/072*** | (2006.01) |
| ***A63B 22/02*** | (2006.01) |
| ***A63B 71/06*** | (2006.01) |
| ***A63B 71/00*** | (2006.01) |
| ***A61H 1/00*** | (2006.01) |
| *A63B 69/00* | (2006.01) |

(52) U.S. Cl.

CPC ..... *A63B 2220/17* (2013.01); *A63B 2220/20* (2013.01); *A63B 2220/30* (2013.01); *A63B 2220/40* (2013.01); *A63B 2220/52* (2013.01); *A63B 2220/805* (2013.01); *A63B 2220/806* (2013.01); *A63B 2220/808* (2013.01); *A63B 2225/20* (2013.01); *A63B 2225/682* (2013.01); *A63B 2230/01* (2013.01); *A63B 2230/06* (2013.01); *A63B 2230/75* (2013.01)

(56) References Cited

U.S. PATENT DOCUMENTS

| | | | |
|---|---|---|---|
| 34,577 | A | 3/1862 | Jabden |
| 104,973 | A | 7/1870 | Man |
| 115,826 | A | 6/1871 | Creed |
| 192,338 | A | 6/1877 | Marshall |
| 232,022 | A | 9/1880 | Gifford |
| 232,579 | A | 9/1880 | Weeks |
| 248,121 | A | 10/1881 | Tuttle |
| 284,294 | A | 9/1883 | Graves |
| 321,388 | A | 6/1885 | Ruebsam |
| 325,435 | A | 9/1885 | North |
| 337,942 | A | 3/1886 | Parley |
| 339,638 | A | 4/1886 | Goldie |
| 353,089 | A | 11/1886 | Smith |
| 356,219 | A | 1/1887 | Yeoman |
| 359,778 | A | 3/1887 | Pauber |
| 372,272 | A | 10/1887 | Murphy |
| 374,496 | A | 12/1887 | Reach |
| 421,779 | A | 2/1890 | Steven |
| 428,912 | A | 5/1890 | Holmes |
| 447,780 | A | 3/1891 | Luge |
| 450,792 | A | 4/1891 | Dodd |
| 457,400 | A | 8/1891 | Dowd |
| 480,271 | A | 8/1892 | Newton |
| 484,352 | A | 10/1892 | Ayton |
| 588,350 | A | 8/1897 | Perkins |
| 603,350 | A | 5/1898 | Towers |
| 610,716 | A | 9/1898 | Marshal |
| 624,995 | A | 5/1899 | Tellefsen |
| 659,216 | A | 10/1900 | Dowling |
| 663,486 | A | 12/1900 | Boren |
| 674,391 | A | 5/1901 | Baker |
| 679,784 | A | 8/1901 | Ryan |
| 680,556 | A | 8/1901 | Wray |
| 682,988 | A | 9/1901 | Carroll |
| 683,284 | A | 9/1901 | Honey |
| 685,788 | A | 11/1901 | Mcfadden |
| 689,418 | A | 12/1901 | Ryan |
| 722,462 | A | 3/1903 | Smith |
| 723,625 | A | 3/1903 | Thornley |
| 754,992 | A | 3/1904 | Grabner |
| 760,374 | A | 5/1904 | Belvoir |
| 761,504 | A | 5/1904 | Kleinbach |
| 766,930 | A | 8/1904 | De Clemons |
| 772,906 | A | 10/1904 | Reach |
| 776,824 | A | 12/1904 | William, Jr. |
| 807,670 | A | 12/1905 | Grabner |
| 846,389 | A | 3/1907 | Blackburn |
| 852,193 | A | 4/1907 | Mcmillan |
| 881,521 | A | 3/1908 | Wilson |
| 897,722 | A | 9/1908 | Day |
| 931,394 | A | 8/1909 | Day |
| 937,795 | A | 10/1909 | Hackney |
| 943,127 | A | 12/1909 | Van Boven |
| 964,745 | A | 7/1910 | Blakoe |
| 979,609 | A | 12/1910 | De Vaughn |
| 1,016,729 | A | 2/1912 | Barrett |
| 1,019,861 | A | 3/1912 | Titus |
| 1,020,777 | A | 3/1912 | Peterson |
| 1,064,968 | A | 6/1913 | Hagen |
| 1,082,940 | A | 12/1913 | Flora |
| 1,115,826 | A | 11/1914 | Johnson |
| 1,123,272 | A | 1/1915 | Goodman |
| 1,144,085 | A | 6/1915 | Abplanalp |
| 1,211,765 | A | 1/1917 | Schmidt |
| 1,316,683 | A | 9/1919 | Calvert |
| 1,422,888 | A | 7/1922 | Reeves |
| 1,495,278 | A | 5/1924 | Titus |
| 1,539,214 | A | 5/1925 | Shockey |
| 1,570,482 | A | 1/1926 | Hale |
| 1,576,474 | A | 3/1926 | Walker |
| 1,580,530 | A | 4/1926 | Rambo |
| 1,585,748 | A | 5/1926 | Wendelken |
| 1,672,944 | A | 6/1928 | Jowett |
| 1,698,831 | A | 1/1929 | Titus |
| 1,715,870 | A | 6/1929 | Spain |
| 1,766,089 | A | 6/1930 | Wood |
| 1,778,635 | A | 10/1930 | Heisler |
| 1,824,406 | A | 9/1931 | Petersime |
| 1,850,530 | A | 3/1932 | Brown |
| 1,851,843 | A | 3/1932 | Inman |
| 1,893,728 | A | 1/1933 | Bullis |
| 1,902,694 | A | 3/1933 | Edwards |
| 1,917,566 | A | 7/1933 | Wood |
| 1,919,627 | A | 7/1933 | Fitz Gerald |
| 1,928,089 | A | 9/1933 | Blickman |
| 1,973,945 | A | 9/1934 | Chavin |
| 1,978,579 | A | 10/1934 | Hooks |
| 1,982,843 | A | 12/1934 | Traver |
| 1,982,872 | A | 12/1934 | Newton |
| 1,991,520 | A | 2/1935 | Postl |
| 2,067,136 | A | 1/1937 | Brindenbaugh |
| 2,117,957 | A | 5/1938 | Ritter |
| 2,129,262 | A | 9/1938 | Rex |
| 2,145,940 | A | 2/1939 | Marlowe |
| 2,153,077 | A | 4/1939 | Arthur |
| 2,165,700 | A | 7/1939 | Henry |
| 2,177,957 | A | 10/1939 | Stewart |
| 2,183,345 | A | 12/1939 | Brandon |
| 2,209,034 | A | 7/1940 | Rene |
| 2,219,219 | A | 10/1940 | Boger |
| 2,247,946 | A | 7/1941 | Hein et al. |
| 2,255,864 | A | 9/1941 | Stephens |
| 2,274,574 | A | 2/1942 | Zerne |
| 2,315,485 | A | 4/1943 | Le Roy |
| 2,346,105 | A | 4/1944 | Haehnel |
| 2,379,984 | A | 7/1945 | Nereaux |
| 2,399,915 | A | 5/1946 | Drake |
| 2,436,987 | A | 3/1948 | Bailleaux |
| 2,438,548 | A | 3/1948 | Ehmann |
| 2,440,644 | A | 4/1948 | Powell |
| 2,456,017 | A | 12/1948 | Park |
| 2,470,544 | A | 5/1949 | Bell |
| 2,472,391 | A | 6/1949 | Albizu |
| 2,500,299 | A | 3/1950 | Spitzkeit |
| 2,512,417 | A | 6/1950 | Polite |
| 2,569,007 | A | 9/1951 | Klyce |
| 2,573,351 | A | 10/1951 | Motis |
| 2,632,645 | A | 3/1953 | Barkschat |
| 2,637,319 | A | 5/1953 | Bruene |
| 2,640,696 | A | 6/1953 | Adalbert |
| 2,641,250 | A | 6/1953 | Brockman |
| 2,642,288 | A | 6/1953 | Bell |
| 2,645,539 | A | 7/1953 | Thompson |
| 2,646,282 | A | 7/1953 | Ringman |
| 2,648,540 | A | 8/1953 | Hunter |
| 2,654,135 | A | 10/1953 | Grizzard et al. |
| 2,674,453 | A | 4/1954 | Hummert |
| 2,695,797 | A | 11/1954 | Mccarthy et al. |
| 2,714,507 | A | 8/1955 | Goodrich |
| 2,740,178 | A | 4/1956 | Kellems |
| 2,743,623 | A | 5/1956 | Wells |
| 2,746,822 | A | 5/1956 | Copenhaver |
| 2,763,156 | A | 9/1956 | Garigal |

(56) References Cited

U.S. PATENT DOCUMENTS

| | | | |
|---|---|---|---|
| 2,842,365 | A | 7/1958 | Kelley |
| 2,843,858 | A | 7/1958 | Berma |
| 2,855,200 | A | 10/1958 | Blickman |
| 2,874,971 | A | 2/1959 | Devery |
| 2,924,456 | A | 2/1960 | Miller |
| 2,927,006 | A | 3/1960 | Brooks |
| 2,938,695 | A | 5/1960 | Ciampa |
| 2,968,337 | A | 1/1961 | Bartlett |
| 2,969,060 | A | 1/1961 | Swanda |
| 2,977,120 | A | 3/1961 | Morris |
| 2,978,830 | A | 4/1961 | Killian |
| 2,984,594 | A | 5/1961 | Runton |
| 2,985,933 | A | 5/1961 | Peterson et al. |
| 3,000,628 | A | 9/1961 | Kellogg |
| 3,035,671 | A | 5/1962 | Sicherman |
| 3,057,201 | A | 10/1962 | Erich |
| 3,059,312 | A | 10/1962 | Jamieson |
| 3,068,002 | A | 12/1962 | Balne |
| 3,068,950 | A | 12/1962 | Davidson |
| 3,072,426 | A | 1/1963 | Gilbert |
| 3,090,092 | A | 5/1963 | Szemplak |
| 3,099,509 | A | 7/1963 | Duenke |
| 3,112,108 | A | 11/1963 | Hanke |
| 3,115,332 | A | 12/1963 | Singleton |
| 3,118,441 | A | 1/1964 | Prosser |
| 3,127,171 | A | 3/1964 | Noland et al. |
| 3,161,395 | A | 12/1964 | Carter |
| 3,179,071 | A | 4/1965 | Johnston |
| 3,193,287 | A | 7/1965 | Robinson |
| 3,194,598 | A | 7/1965 | Goldfuss |
| 3,205,888 | A | 9/1965 | Stroop |
| 3,246,894 | A | 4/1966 | Salisbury |
| 3,256,630 | A | 6/1966 | Spector |
| 3,270,494 | A | 9/1966 | Holmes |
| 3,312,466 | A | 4/1967 | Melchiona |
| 3,316,898 | A | 5/1967 | Brown |
| 3,319,273 | A | 5/1967 | Lawrence |
| 3,323,367 | A | 6/1967 | Searle |
| 3,342,485 | A | 9/1967 | Martin |
| 3,345,067 | A | 10/1967 | Smith |
| 3,349,621 | A | 10/1967 | Mullen |
| 3,358,813 | A | 12/1967 | Kohlhagen |
| 3,370,584 | A | 2/1968 | Girten |
| 3,373,993 | A | 3/1968 | Oja et al. |
| 3,378,259 | A | 4/1968 | Kupchinski |
| 3,380,737 | A | 4/1968 | Petros |
| 3,381,958 | A | 5/1968 | Gulland |
| 3,384,370 | A | 5/1968 | Bailey et al. |
| 3,390,460 | A | 7/1968 | Brown |
| 3,408,067 | A | 10/1968 | Armstrong |
| 3,408,069 | A | 10/1968 | Lewis |
| 3,411,497 | A | 11/1968 | Rickey et al. |
| 3,411,776 | A | 11/1968 | Holkesvick et al. |
| 3,416,174 | A | 12/1968 | Novitske |
| 3,428,311 | A | 2/1969 | Mitchell |
| 3,428,312 | A | 2/1969 | Machen |
| 3,430,507 | A | 3/1969 | Hurst et al. |
| 3,432,164 | A | 3/1969 | Deeks |
| 3,438,627 | A | 4/1969 | La Lanne |
| 3,444,830 | A | 5/1969 | Doetsch |
| 3,446,503 | A | 5/1969 | Lawton |
| 3,456,592 | A | 7/1969 | Nelson |
| 3,465,592 | A | 9/1969 | Perrine |
| 3,482,835 | A | 12/1969 | Dean |
| 3,488,051 | A | 1/1970 | Scherer |
| 3,495,824 | A | 2/1970 | Cuinier |
| 3,501,140 | A | 3/1970 | Eichorn |
| 3,511,500 | A | 5/1970 | Dunn |
| 3,514,110 | A | 5/1970 | Thomander |
| 3,518,985 | A | 7/1970 | Quinton |
| 3,540,724 | A | 11/1970 | Hunter |
| 3,547,435 | A | 12/1970 | Scott |
| 3,554,541 | A | 1/1971 | Spoth |
| 3,563,541 | A | 2/1971 | Sanquist |
| 3,566,861 | A | 3/1971 | Weiss |
| 3,567,219 | A | 3/1971 | Foster |
| 3,568,669 | A | 3/1971 | Stites |
| 3,572,700 | A | 3/1971 | Mastropaolo |
| 3,583,465 | A | 6/1971 | Youngs et al. |
| 3,586,322 | A | 6/1971 | Kverneland |
| 3,588,101 | A | 6/1971 | Jungreis |
| 3,589,193 | A | 6/1971 | Thornton |
| 3,589,715 | A | 6/1971 | Mark |
| 3,589,720 | A | 6/1971 | Agamian |
| 3,592,466 | A | 7/1971 | Parsons |
| 3,598,404 | A | 8/1971 | Bowman |
| 3,601,398 | A | 8/1971 | Brochman |
| 3,602,502 | A | 8/1971 | Jaegar |
| 3,606,320 | A | 9/1971 | Erwin, Jr. |
| 3,606,406 | A | 9/1971 | Walters |
| 3,608,898 | A | 9/1971 | Berlin |
| 3,614,097 | A | 10/1971 | Blickman |
| 3,614,108 | A | 10/1971 | Garten |
| 3,617,056 | A | 11/1971 | Herbold |
| 3,628,654 | A | 12/1971 | Haracz |
| 3,628,791 | A | 12/1971 | Garcia |
| 3,634,895 | A | 1/1972 | Childers |
| 3,636,577 | A | 1/1972 | Nissen |
| 3,638,941 | A | 2/1972 | Kulkens |
| 3,640,528 | A | 2/1972 | Proctor |
| 3,640,530 | A | 2/1972 | Henson et al. |
| 3,641,601 | A | 2/1972 | Sieg |
| 3,642,279 | A | 2/1972 | Cutter |
| 3,643,943 | A | 2/1972 | Erwin, Jr. et al. |
| 3,647,209 | A | 3/1972 | La Lanne |
| 3,650,529 | A | 3/1972 | Salm |
| 3,652,085 | A | 3/1972 | Civalier |
| 3,658,327 | A | 4/1972 | Thiede |
| 3,659,845 | A | 5/1972 | Quinton |
| 3,664,666 | A | 5/1972 | Lloyd |
| 3,664,910 | A | 5/1972 | Hollie |
| 3,664,916 | A | 5/1972 | Rhodiaceta |
| 3,672,124 | A | 6/1972 | Pirotta |
| 3,679,244 | A | 7/1972 | Reddy |
| 3,686,776 | A | 8/1972 | Dahl |
| 3,689,066 | A | 9/1972 | Hagen |
| 3,690,655 | A | 9/1972 | Chapman |
| 3,703,284 | A | 11/1972 | Hesen |
| 3,708,166 | A | 1/1973 | Annas |
| 3,708,167 | A | 1/1973 | Potgieter |
| 3,709,197 | A | 1/1973 | Moseley |
| 3,731,917 | A | 5/1973 | Townsend |
| 3,738,649 | A | 6/1973 | Miller |
| 3,741,538 | A | 6/1973 | Useldinger |
| 3,751,033 | A | 8/1973 | Rosenthal |
| 3,756,595 | A | 9/1973 | Hague |
| 3,758,109 | A | 9/1973 | Bender |
| 3,759,511 | A | 9/1973 | Zinkin |
| 3,761,083 | A | 9/1973 | Buchner |
| 3,767,195 | A | 10/1973 | Dimick |
| 3,771,785 | A | 11/1973 | Speyer |
| 3,784,193 | A | 1/1974 | Simjian |
| 3,788,412 | A | 1/1974 | Vincent |
| 3,789,467 | A | 2/1974 | Aratani et al. |
| 3,792,860 | A | 2/1974 | Selnes |
| 3,797,624 | A | 3/1974 | Powell et al. |
| 3,802,701 | A | 4/1974 | Good |
| 3,807,728 | A | 4/1974 | Chillier |
| 3,809,393 | A | 5/1974 | Jones |
| 3,814,420 | A | 6/1974 | Encke |
| 3,815,903 | A | 6/1974 | Blomqvist |
| 3,822,488 | A | 7/1974 | Johnson |
| 3,822,599 | A | 7/1974 | Brentham |
| 3,825,253 | A | 7/1974 | Speyer |
| 3,826,491 | A | 7/1974 | Elder |
| 3,831,942 | A | 8/1974 | Del Mar |
| 3,833,216 | A | 9/1974 | Philbin |
| 3,834,696 | A | 9/1974 | Spector |
| 3,840,227 | A | 10/1974 | Chesemore |
| 3,848,467 | A | 11/1974 | Flavell |
| 3,851,874 | A | 12/1974 | Wilkin |
| 3,858,873 | A | 1/1975 | Jones |
| 3,858,874 | A | 1/1975 | Weider |
| 3,858,938 | A | 1/1975 | Kristensson et al. |

(56) References Cited

U.S. PATENT DOCUMENTS 3,861,215 A 1/1975 Bradley
3,869,121 A 3/1975 Flavell
3,870,297 A 3/1975 Elder
3,874,375 A 4/1975 Penner
3,874,657 A 4/1975 Niebojewski
3,880,274 A 4/1975 Bechtloff
3,883,922 A 5/1975 Fleischhauer
3,884,464 A 5/1975 Evangelos
3,891,207 A 6/1975 Helliwell
3,892,404 A 7/1975 Martucci
3,901,379 A 8/1975 Bruhm
3,902,480 A 9/1975 Wilson
3,902,717 A 9/1975 Kulkens
3,903,613 A 9/1975 Bisberg
3,904,196 A 9/1975 Berlin
3,909,857 A 10/1975 Herrera
3,912,263 A 10/1975 Yatso
3,913,908 A 10/1975 Speyer
3,918,710 A 11/1975 Niebojewski
3,920,240 A 11/1975 Ross
3,926,430 A 12/1975 Good
3,929,026 A 12/1975 Hofmann
3,938,400 A 2/1976 Konyha
3,938,803 A 2/1976 Wilmoth
3,941,377 A 3/1976 Lie
3,948,513 A 4/1976 Pfotenhauer
3,953,025 A 4/1976 Mazman
3,957,266 A 5/1976 Rice
3,958,803 A 5/1976 Geisselbrecht
3,963,101 A 6/1976 Stadelmann et al.
3,971,555 A 7/1976 Mahnke
3,976,058 A 8/1976 Tidwell
3,977,451 A 8/1976 Duba
3,979,931 A 9/1976 Man
3,981,500 A 9/1976 Ryan
3,984,666 A 10/1976 Barron
3,998,454 A 12/1976 Jones
4,004,801 A 1/1977 Campanaro
4,012,015 A 3/1977 Nelson et al.
4,024,949 A 5/1977 Kleysteuber et al.
4,026,545 A 5/1977 Schonenberger
4,026,548 A 5/1977 Birdwell
4,029,312 A 6/1977 Wright
4,033,567 A 7/1977 Lipfert
4,042,305 A 8/1977 Vincent
4,043,552 A 8/1977 Kerkonian
4,056,265 A 11/1977 Ide
4,059,265 A 11/1977 Wieder et al.
4,060,240 A 11/1977 Dunston
4,061,257 A 12/1977 St. Clair
4,063,726 A 12/1977 Wilson
4,063,727 A 12/1977 Hall
4,066,257 A 1/1978 Moller
4,066,259 A 1/1978 Brentham
4,066,868 A 1/1978 Witkin et al.
4,067,372 A 1/1978 Masson
4,071,235 A 1/1978 Zent
4,072,309 A 2/1978 Wilson
4,073,490 A 2/1978 Feather
4,074,409 A 2/1978 Smith
4,074,519 A 2/1978 Garrett
4,076,236 A 2/1978 Ionel
4,076,237 A 2/1978 Dussia
4,077,626 A 3/1978 Newman
4,082,267 A 4/1978 Flavell
4,093,196 A 6/1978 Bauer
4,093,211 A 6/1978 Hughes et al.
4,094,330 A 6/1978 Jong
4,098,100 A 7/1978 Wah
4,101,124 A 7/1978 Mahnke
4,111,417 A 9/1978 Gardner
4,113,071 A 9/1978 Muller et al.
4,120,294 A 10/1978 Wolfe
4,122,585 A 10/1978 Sharp et al.
4,131,701 A 12/1978 VanAuken
4,140,312 A 2/1979 Buchmann
4,141,158 A 2/1979 Benseler et al.
4,146,222 A 3/1979 Hribar
4,149,714 A 4/1979 Lambert, Jr.
4,151,988 A 5/1979 Nabinger
4,151,994 A 5/1979 Stalberger, Jr.
4,154,441 A 5/1979 Gajda
4,157,181 A 6/1979 Cecka
4,157,594 A 6/1979 Raabe
4,167,938 A 9/1979 Remih
4,168,061 A 9/1979 Gordon
4,170,351 A 10/1979 Ozbey
4,171,805 A 10/1979 Abbott
4,176,836 A 12/1979 Coyle
4,179,134 A 12/1979 Atkinson
4,183,156 A 1/1980 Rudy
4,183,494 A 1/1980 Cleveland
4,188,030 A 2/1980 Hooper
4,193,630 A 3/1980 Steele
4,198,044 A 4/1980 Holappa
4,199,139 A 4/1980 Mahnke
4,200,279 A 4/1980 Lambert, Jr.
4,200,280 A 4/1980 Goodwin
4,204,673 A 5/1980 Speer, Sr.
4,207,879 A 6/1980 Safadago
4,208,049 A 6/1980 Wilson
4,215,516 A 8/1980 Huschle et al.
4,216,856 A 8/1980 Moring et al.
4,227,689 A 10/1980 Keiser
4,231,568 A 11/1980 Riley
4,231,569 A 11/1980 Rae
4,235,437 A 11/1980 Ruis et al.
4,239,092 A 12/1980 Janson
4,240,627 A 12/1980 Brentham
4,241,915 A 12/1980 Noble
4,248,476 A 2/1981 Phelps
4,249,725 A 2/1981 Mattox
4,249,773 A 2/1981 Giambalvo
4,251,932 A 2/1981 Love
4,252,314 A 2/1981 Ceppo
4,253,661 A 3/1981 Russell
4,253,662 A 3/1981 Podolak
4,256,302 A 3/1981 Keiser et al.
4,257,590 A 3/1981 Sullivan et al.
4,258,821 A 3/1981 Wendt
4,258,913 A 3/1981 Brentham
4,263,897 A 4/1981 Terayama
4,274,625 A 6/1981 Gaetano
4,275,882 A 6/1981 Grosser et al.
4,278,095 A 7/1981 Lapeyre
4,278,249 A 7/1981 Forrest
4,286,782 A 9/1981 Fuhrhop
4,290,601 A 9/1981 Mittelstadt
4,296,924 A 10/1981 Anzaldua et al.
4,300,760 A 11/1981 Bobroff
4,300,761 A 11/1981 Howard
4,307,880 A 12/1981 Abram
4,313,602 A 2/1982 Sullivan
4,313,603 A 2/1982 Simjian
4,316,609 A 2/1982 Silberman
4,316,610 A 2/1982 Hinds
4,324,501 A 4/1982 Herbenar
4,325,548 A 4/1982 Piccini
4,327,713 A 5/1982 Okazaki et al.
4,328,964 A 5/1982 Walls
4,328,965 A 5/1982 Hatfield
4,328,968 A 5/1982 Hacker
4,333,978 A 6/1982 Kocher
4,334,676 A 6/1982 Schonenberger
4,334,678 A 6/1982 Doyel
4,334,695 A 6/1982 Ashby
4,337,283 A 6/1982 Haas, Jr.
4,342,452 A 8/1982 Summa
4,344,616 A 8/1982 Ogden
4,345,756 A 8/1982 Hoagland
4,346,888 A 8/1982 Szabo
4,349,192 A 9/1982 Lambert, Jr. et al.
4,349,597 A 9/1982 Fine et al.
4,350,336 A 9/1982 Hanford

(56) References Cited

U.S. PATENT DOCUMENTS 4,354,675 A 10/1982 Barclay et al.
4,355,061 A 10/1982 Zeigler
4,357,010 A 11/1982 Telle
4,357,011 A 11/1982 Voris
4,358,105 A 11/1982 Sweeney, Jr.
4,363,480 A 12/1982 Fisher et al.
4,363,486 A 12/1982 Chaudhry
4,367,895 A 1/1983 Pacitti et al.
4,368,735 A 1/1983 Filmer
4,369,081 A 1/1983 Curry et al.
4,369,966 A 1/1983 Silberman et al.
4,370,766 A 2/1983 Teague, Jr.
4,371,162 A 2/1983 Hartzell
4,372,553 A 2/1983 Hatfield
4,373,716 A 2/1983 Pagani
4,374,587 A 2/1983 Ogden
4,374,588 A 2/1983 Ruggles
4,376,533 A 3/1983 Kolbel
4,377,045 A 3/1983 Aurensan
4,382,596 A 5/1983 Silberman
4,383,684 A 5/1983 Schliep
4,383,714 A 5/1983 Ishida
4,384,715 A 5/1983 Barrett, Jr.
4,387,893 A 6/1983 Baldwin
4,389,047 A 6/1983 Hall
4,390,179 A 6/1983 Szkalak
4,391,440 A 7/1983 Berger
4,397,462 A 8/1983 Wilmarth
4,398,713 A 8/1983 Ellis
4,402,504 A 9/1983 Christian
4,406,451 A 9/1983 Gaetano
4,408,613 A 10/1983 Relyea
4,422,635 A 12/1983 Herod
4,422,636 A 12/1983 de Angeli
4,423,864 A 1/1984 Wiik
4,424,693 A 1/1984 Best et al.
4,426,077 A 1/1984 Becker
4,428,577 A 1/1984 Croom
4,428,578 A 1/1984 Kirkpatrick
4,431,181 A 2/1984 Baswell
4,431,184 A 2/1984 Lew et al.
4,434,981 A 3/1984 Norton
4,441,708 A 4/1984 Brentham
4,445,684 A 5/1984 Ruff
4,448,434 A 5/1984 Anderson
4,452,448 A 6/1984 Ausherman
4,453,766 A 6/1984 DiVito
4,456,245 A 6/1984 Baldwin
4,456,246 A 6/1984 Szabo
4,461,472 A 7/1984 Martinez
4,461,473 A 7/1984 Cole
4,463,948 A 8/1984 Mohr
4,465,274 A 8/1984 Davenport
4,465,276 A 8/1984 Cox
4,465,277 A 8/1984 Dittrich
4,474,370 A 10/1984 Oman
4,476,582 A 10/1984 Strauss et al.
4,477,071 A 10/1984 Brown et al.
4,478,413 A 10/1984 Siwula
4,482,152 A 11/1984 Wolff
4,489,933 A 12/1984 Fisher
4,489,936 A 12/1984 Dal Monte
4,491,318 A 1/1985 Francke
4,492,375 A 1/1985 Connelly
4,494,662 A 1/1985 Clymer
4,496,147 A 1/1985 DeCloux et al.
4,499,784 A 2/1985 Shum
4,502,679 A 3/1985 De Lorenzo
4,502,682 A 3/1985 Miller
4,505,474 A 3/1985 Mattox
4,505,475 A 3/1985 Olschansky et al.
4,505,495 A 3/1985 Foss et al.
4,509,510 A 4/1985 Hook
4,511,137 A 4/1985 Jones
4,512,567 A 4/1985 Phillips
4,512,571 A 4/1985 Hermelin
4,515,363 A 5/1985 Schleffendorf
4,521,013 A 6/1985 Dofel
4,529,194 A 7/1985 Haaheim
4,529,196 A 7/1985 Logan
4,529,197 A 7/1985 Gogarty
4,529,198 A 7/1985 Hettick, Jr.
4,531,727 A 7/1985 Pitre
4,531,731 A 7/1985 Law
4,533,136 A 8/1985 Smith et al.
4,536,244 A 8/1985 Greci et al.
4,537,396 A 8/1985 Hooper
4,538,805 A 9/1985 Parviainen
4,540,171 A 9/1985 Clark
4,540,173 A 9/1985 Hopkins, Jr.
4,542,899 A 9/1985 Hendricks
4,544,152 A 10/1985 Taitel
4,544,153 A 10/1985 Babcock
4,546,967 A 10/1985 Kecala
4,546,970 A 10/1985 Mahnke
4,546,971 A 10/1985 Raasoch
4,548,405 A 10/1985 Lee
4,549,433 A 10/1985 Gneiss et al.
4,549,733 A 10/1985 Salyer
4,549,734 A 10/1985 Hibler, Jr.
4,555,109 A 11/1985 Hartmann
4,556,216 A 12/1985 Pitkanen
4,563,001 A 1/1986 Terauds
4,563,003 A 1/1986 Bugallo et al.
4,564,193 A 1/1986 Stewart
4,565,369 A 1/1986 Bedgood
4,566,689 A 1/1986 Ogden
4,566,690 A 1/1986 Schook
4,566,732 A 1/1986 Ostergaard, Sr.
4,569,518 A 2/1986 Fulks
4,569,519 A 2/1986 Mattox et al.
4,571,682 A 2/1986 Silverman et al.
4,572,500 A 2/1986 Weiss
4,572,504 A 2/1986 DiBartolo
4,575,074 A 3/1986 Damratoski
4,576,352 A 3/1986 Ogden
4,576,376 A 3/1986 Miller
4,576,377 A 3/1986 Wolff
4,577,860 A 3/1986 Matias et al.
4,577,861 A 3/1986 Bangerter et al.
4,579,360 A 4/1986 Nishimura et al.
4,580,983 A 4/1986 Cassini et al.
4,581,269 A 4/1986 Tilman
4,582,320 A 4/1986 Shaw
4,587,695 A 5/1986 Jensen
4,589,656 A 5/1986 Baldwin
4,591,147 A 5/1986 Smith et al.
4,591,150 A 5/1986 Mosher
4,591,151 A 5/1986 Hensley
4,592,544 A 6/1986 Smith et al.
4,598,908 A 7/1986 Morgan
4,600,188 A 7/1986 Bangerter et al.
4,600,189 A 7/1986 Olschansky et al.
4,600,196 A 7/1986 Jones
4,601,142 A 7/1986 Frommelt
4,602,779 A 7/1986 Ogden
4,603,855 A 8/1986 Sebelle
4,603,856 A 8/1986 Fiore
4,606,540 A 8/1986 Chin Sen
4,606,541 A 8/1986 Kirkpatrick
4,607,840 A 8/1986 Harper
4,607,841 A 8/1986 Gala
4,608,969 A 9/1986 Hamlin
4,609,174 A 9/1986 Nakatani
4,610,448 A 9/1986 Hill
4,610,449 A 9/1986 Diercks, Jr.
4,611,805 A 9/1986 Franklin et al.
4,614,337 A 9/1986 Schonenberger
4,616,822 A 10/1986 Trulaske
4,618,139 A 10/1986 Haaheim
4,618,140 A 10/1986 Brown
4,618,144 A 10/1986 Gibson
4,619,454 A 10/1986 Walton
4,620,701 A 11/1986 Mojden

(56) References Cited

U.S. PATENT DOCUMENTS 4,620,704 A 11/1986 Shifferaw
4,621,623 A 11/1986 Wang
4,621,807 A 11/1986 Stramer
4,621,810 A 11/1986 Cummins
4,624,457 A 11/1986 Silberman et al.
4,625,962 A 12/1986 Street
4,627,614 A 12/1986 De Angeli
4,627,615 A 12/1986 Nurkowski
4,627,616 A 12/1986 Kauffman
4,627,618 A 12/1986 Schwartz
4,630,817 A 12/1986 Buckley
4,632,385 A 12/1986 Geraci
4,632,386 A 12/1986 Beech
4,632,388 A 12/1986 Schleffendorf
4,632,390 A 12/1986 Richey
4,632,393 A 12/1986 Van Noord
4,632,414 A 12/1986 Ellefson
4,632,421 A 12/1986 Shamie
4,634,118 A 1/1987 Jensen
4,634,127 A 1/1987 Rockwell
4,635,926 A 1/1987 Minkow
4,635,927 A 1/1987 Shu
4,635,928 A 1/1987 Ogden et al.
4,637,605 A 1/1987 Ritchie
4,638,523 A 1/1987 Todd
4,638,969 A 1/1987 Brown
4,638,994 A 1/1987 Gogarty
4,641,833 A 2/1987 Trethewey
4,642,080 A 2/1987 Takano et al.
4,643,418 A 2/1987 Bart
4,643,420 A 2/1987 Riley
4,645,197 A 2/1987 Mcfee
4,645,198 A 2/1987 Levenston
4,645,200 A 2/1987 Hix
4,645,201 A 2/1987 Evans
4,645,917 A 2/1987 Penney et al.
4,647,037 A 3/1987 Donohue
4,647,040 A 3/1987 Ehrenfried
4,647,041 A 3/1987 Whiteley
4,648,481 A 3/1987 Lee
4,648,594 A 3/1987 Schleffendorf
4,650,067 A 3/1987 Brule
4,650,183 A 3/1987 McIntyre
4,650,184 A 3/1987 Brebner
4,650,185 A 3/1987 Cartwright
4,651,581 A 3/1987 Svensson
4,651,988 A 3/1987 Sobel
4,655,448 A 4/1987 Harder
4,657,246 A 4/1987 Salyer
4,659,074 A 4/1987 Taitel et al.
4,659,077 A 4/1987 Stropkay
4,659,078 A 4/1987 Blome
4,660,550 A 4/1987 Bodine
4,662,629 A 5/1987 Plovie
4,662,630 A 5/1987 Dignard et al.
4,664,371 A 5/1987 Viander
4,664,373 A 5/1987 Hait
4,664,646 A 5/1987 Rorabaugh
4,666,149 A 5/1987 Olschansky et al.
4,666,151 A 5/1987 Chillier
4,673,177 A 6/1987 Szymski
4,673,180 A 6/1987 Rice
4,674,740 A 6/1987 Iams et al.
4,674,743 A 6/1987 Hirano
4,678,185 A 7/1987 Mahnke
4,679,786 A 7/1987 Rodgers
4,679,787 A 7/1987 Guilbault
4,684,121 A 8/1987 Nestegard
4,684,126 A 8/1987 Dalebout et al.
4,685,670 A 8/1987 Zinkin
4,685,671 A 8/1987 Hagerman et al.
4,687,195 A 8/1987 Potts
4,697,809 A 10/1987 Rockwell
4,700,946 A 10/1987 Breunig
4,702,475 A 10/1987 Elstein et al.
4,705,267 A 11/1987 Jackson
4,706,953 A 11/1987 Graham
4,708,337 A 11/1987 Shyu
4,709,917 A 12/1987 Yang
4,709,918 A 12/1987 Grinblat
4,709,920 A 12/1987 Schnell
4,711,447 A 12/1987 Mansfield
4,714,248 A 12/1987 Koss
4,717,146 A 1/1988 Nohara
4,718,207 A 1/1988 Frommelt
4,720,093 A 1/1988 Del Mar
4,720,099 A 1/1988 Carlson
4,720,789 A 1/1988 Hector et al.
4,721,301 A 1/1988 Drake
4,721,303 A 1/1988 Fitzpatrick
4,722,522 A 2/1988 Lundgren
4,725,057 A 2/1988 Shifferaw
4,726,581 A 2/1988 Chang
4,726,582 A 2/1988 Fulks
4,728,099 A 3/1988 Pitre
4,729,558 A 3/1988 Kuo
4,729,562 A 3/1988 Pipasik
4,730,828 A 3/1988 Lane
4,730,829 A 3/1988 Carlson
4,733,858 A 3/1988 Lan
4,733,860 A 3/1988 Steffee
4,733,905 A 3/1988 Buickerood
4,741,530 A 5/1988 Wolf
4,743,009 A 5/1988 Beale
4,743,010 A 5/1988 Geraci
4,743,015 A 5/1988 Marshall
4,743,017 A 5/1988 Jaeger
4,744,559 A 5/1988 Mahnke et al.
4,746,115 A 5/1988 Lahman
4,749,184 A 6/1988 Tobin
4,750,736 A 6/1988 Watterson
4,750,738 A 6/1988 Dang
4,751,755 A 6/1988 Carey, Jr. et al.
4,753,437 A 6/1988 Lapcevic
4,756,098 A 7/1988 Boggia
4,756,527 A 7/1988 Ledbetter
4,757,987 A 7/1988 Allemand
4,759,540 A 7/1988 Yu et al.
4,763,897 A 8/1988 Yakata
4,765,610 A 8/1988 Sidwell
4,765,613 A 8/1988 Voris
4,765,616 A 8/1988 Wolff
4,768,780 A 9/1988 Hayes
4,771,148 A 9/1988 Bersonnet
4,772,015 A 9/1988 Carlson et al.
4,773,170 A 9/1988 Moore et al.
4,773,640 A 9/1988 Kolbel et al.
4,775,149 A 10/1988 Wilson
4,776,581 A 10/1988 Shepherdson
4,776,582 A 10/1988 Ramhorst
4,776,587 A 10/1988 Carlson et al.
4,778,173 A 10/1988 Joutras
4,779,867 A 10/1988 Hinds
4,779,884 A 10/1988 Minati
4,784,384 A 11/1988 Deola
4,786,049 A 11/1988 Lautenschlager
4,786,050 A 11/1988 Geschwender
4,789,153 A 12/1988 Brown
4,790,522 A 12/1988 Drutchas
4,790,528 A 12/1988 Nakao et al.
4,790,596 A 12/1988 Shifferaw
4,792,134 A 12/1988 Chen
4,793,608 A 12/1988 Mahnke et al.
4,797,968 A 1/1989 Wenzlick
4,798,377 A 1/1989 White
4,798,760 A 1/1989 Diaz-Kotti
4,799,475 A 1/1989 Iams et al.
4,799,671 A 1/1989 Hoggan et al.
4,801,079 A 1/1989 Gonella
4,801,139 A 1/1989 Vanhoutte
4,801,140 A 1/1989 Bergeron
4,804,178 A 2/1989 Friedebach
4,805,901 A 2/1989 Kulick
4,807,874 A 2/1989 Little

(56) References Cited

U.S. PATENT DOCUMENTS 4,807,893 A 2/1989 Huang
4,809,804 A 3/1989 Houston et al.
4,809,972 A 3/1989 Rasmussen et al.
4,809,973 A 3/1989 Johns
4,809,976 A 3/1989 Berger
4,813,667 A 3/1989 Watterson
4,813,668 A 3/1989 Solloway
4,813,743 A 3/1989 Mizelle
4,817,939 A 4/1989 Augspurger et al.
4,818,175 A 4/1989 Kimura
4,819,583 A 4/1989 Guerra
4,822,029 A 4/1989 Sarno
4,822,034 A 4/1989 Shields
4,822,035 A 4/1989 Jennings et al.
4,822,038 A 4/1989 Maag
4,824,104 A 4/1989 Bloch
4,826,153 A 5/1989 Schalip
4,826,157 A 5/1989 Fitzpatrick
4,826,158 A 5/1989 Fields, Jr.
4,826,159 A 5/1989 Hersey
4,828,255 A 5/1989 Lahman
4,828,257 A 5/1989 Dyer et al.
4,830,362 A 5/1989 Bull
4,830,363 A 5/1989 Kennedy
4,830,365 A 5/1989 March
4,832,332 A 5/1989 Dumbser
4,834,365 A 5/1989 Jones
4,834,396 A 5/1989 Schnell
4,836,530 A 6/1989 Stanley, Jr.
4,836,535 A 6/1989 Pearson
4,838,180 A 6/1989 Gutgsell
4,838,543 A 6/1989 Armstrong et al.
4,838,544 A 6/1989 Sasakawa et al.
4,840,373 A 6/1989 Maag
4,842,266 A 6/1989 Sweeney, Sr.
4,842,268 A 6/1989 Jenkins
4,842,274 A 6/1989 Oosthuizen
4,844,448 A 7/1989 Niznik
4,844,449 A 7/1989 Truslaske
4,844,450 A 7/1989 Rodgers, Jr.
4,844,453 A 7/1989 Hestilow
4,844,456 A 7/1989 Habing et al.
4,846,458 A 7/1989 Potts
4,848,737 A 7/1989 Ehrenfield
4,850,585 A 7/1989 Dalebout
4,852,874 A 8/1989 Sleichter, III et al.
4,854,578 A 8/1989 Fulks
4,856,773 A 8/1989 Deola
4,856,775 A 8/1989 Colledge
4,858,912 A 8/1989 Boyd
4,858,915 A 8/1989 Szabo
4,858,918 A 8/1989 Iams et al.
4,861,020 A 8/1989 Soligny, Sr.
4,861,023 A 8/1989 Wedman
4,861,025 A 8/1989 Rockwell
4,863,161 A 9/1989 Telle
4,863,163 A 9/1989 Wehrell
4,865,344 A 9/1989 Romero, Sr. et al.
4,867,443 A 9/1989 Jensen
4,869,493 A 9/1989 Johnston
4,869,494 A 9/1989 Lambert, Sr.
4,869,497 A 9/1989 Stewart et al.
4,872,670 A 10/1989 Nichols
4,875,676 A 10/1989 Zimmer
4,877,239 A 10/1989 Dela Rosa
4,878,662 A 11/1989 Chern
4,878,663 A 11/1989 Luquette
4,880,227 A 11/1989 Sowell
4,880,229 A 11/1989 Broussard
4,880,230 A 11/1989 Cook
4,883,272 A 11/1989 Lay
4,886,266 A 12/1989 Trulaske
4,887,929 A 12/1989 Hale
4,889,458 A 12/1989 Taylor
4,891,764 A 1/1990 McIntosh
4,893,409 A 1/1990 Poehlmann
4,893,810 A 1/1990 Lee
4,894,933 A 1/1990 Tonkel et al.
4,898,379 A 2/1990 Shiba
4,898,381 A 2/1990 Gordon
4,900,012 A 2/1990 Fu
4,900,013 A 2/1990 Rodgers, Jr.
4,900,016 A 2/1990 Caruthers
4,900,017 A 2/1990 Bold, Jr.
4,900,018 A 2/1990 Ish, III
4,902,006 A 2/1990 Stallings, Jr.
4,902,007 A 2/1990 Ferrari
4,904,829 A 2/1990 Berthaud et al.
4,905,330 A 3/1990 Jacobs
4,907,795 A 3/1990 Shaw et al.
4,907,798 A 3/1990 Burchatz
4,909,504 A 3/1990 Yang
4,909,505 A 3/1990 Tee
4,911,436 A 3/1990 Lighter
4,911,438 A 3/1990 Van Straaten
4,913,396 A 4/1990 Dalebout et al.
4,913,419 A 4/1990 McAuliffe
4,913,422 A 4/1990 Elmore
4,913,423 A 4/1990 Farran
4,915,377 A 4/1990 Malnke et al.
4,915,379 A 4/1990 Sapp
4,917,376 A 4/1990 Lo
4,919,418 A 4/1990 Miller
4,919,419 A 4/1990 Houston
4,921,242 A 5/1990 Watterson
4,921,245 A 5/1990 Roberts
4,921,247 A 5/1990 Sterling
4,923,193 A 5/1990 Pitzen et al.
4,925,183 A 5/1990 Kim
4,925,200 A 5/1990 Jones
4,925,724 A 5/1990 Ogden
4,927,136 A 5/1990 Leask
4,927,138 A 5/1990 Ferrari
4,928,546 A 5/1990 Walters
4,928,957 A 5/1990 Lanier et al.
4,928,961 A 5/1990 Madden
4,930,768 A 6/1990 Lapcevic
4,930,769 A 6/1990 Nenoff
4,930,770 A 6/1990 Baker
4,934,690 A 6/1990 Bull
4,934,692 A 6/1990 Owens
4,938,473 A 7/1990 Lee
4,940,233 A 7/1990 Bull
4,941,652 A 7/1990 Nagano et al.
4,941,673 A 7/1990 Bennett
4,944,511 A 7/1990 Francis
4,944,518 A 7/1990 Flynn
4,948,121 A 8/1990 Haaheim et al.
4,948,123 A 8/1990 Schook
4,949,951 A 8/1990 Deola
4,949,954 A 8/1990 Hix
4,949,958 A 8/1990 Richey
4,949,959 A 8/1990 Stevens
4,952,265 A 8/1990 Yamanaka et al.
4,953,415 A 9/1990 Lehtonen
4,953,858 A 9/1990 Zelli
4,955,466 A 9/1990 Almes et al.
4,958,832 A 9/1990 Kim
4,960,276 A 10/1990 Feuer et al.
4,964,632 A 10/1990 Rockwell
4,968,028 A 11/1990 Wehrell
4,971,305 A 11/1990 Rennex
4,971,316 A 11/1990 Dalebout et al.
4,973,050 A 11/1990 Santoro
4,974,831 A 12/1990 Dunham
4,974,832 A 12/1990 Dalebout
4,974,836 A 12/1990 Hirsch
4,974,838 A 12/1990 Sollenberger
4,976,424 A 12/1990 Sargeant et al.
4,976,428 A 12/1990 Ghazi
4,976,435 A 12/1990 Shatford
4,978,122 A 12/1990 Dibowski
4,982,955 A 1/1991 Heasley
4,984,810 A 1/1991 Stearns

(56) References Cited

U.S. PATENT DOCUMENTS

| | | | |
|---|---|---|---|
| 4,986,261 | A | 1/1991 | Iams et al. |
| 4,986,689 | A | 1/1991 | Drutchas |
| 4,989,860 | A | 2/1991 | Iams et al. |
| 4,990,838 | A | 2/1991 | Kawato et al. |
| 4,992,190 | A | 2/1991 | Shtarkman |
| 4,995,777 | A | 2/1991 | Warmington |
| 4,998,723 | A | 3/1991 | Santoro |
| 4,998,725 | A | 3/1991 | Watterson et al. |
| 5,000,440 | A | 3/1991 | Lynch |
| 5,000,442 | A | 3/1991 | Dalebout et al. |
| 5,000,446 | A | 3/1991 | Sarno |
| 5,001,632 | A | 3/1991 | Hall-Tipping |
| 5,002,271 | A | 3/1991 | Gonzales |
| 5,004,224 | A | 4/1991 | Wang |
| 5,005,832 | A | 4/1991 | Van Der Hoeven |
| 5,007,630 | A | 4/1991 | Real et al. |
| 5,007,631 | A | 4/1991 | Wang |
| 5,011,139 | A | 4/1991 | Towley, III |
| 5,011,142 | A | 4/1991 | Eckler |
| 5,013,031 | A | 5/1991 | Bull |
| 5,015,926 | A | 5/1991 | Casler |
| 5,016,870 | A | 5/1991 | Bulloch et al. |
| 5,018,725 | A | 5/1991 | Cook |
| 5,020,793 | A | 6/1991 | Loane |
| 5,022,377 | A | 6/1991 | Stevens |
| 5,024,441 | A | 6/1991 | Rousseau |
| 5,026,049 | A | 6/1991 | Goodman |
| 5,027,303 | A | 6/1991 | Witte |
| 5,029,801 | A | 7/1991 | Dalebout et al. |
| 5,029,848 | A | 7/1991 | Sleamaker |
| 5,029,849 | A | 7/1991 | Nurkowski |
| 5,029,850 | A | 7/1991 | Van Straaten |
| 5,031,455 | A | 7/1991 | Cline |
| 5,031,901 | A | 7/1991 | Saarinen |
| 5,031,905 | A | 7/1991 | Walsh |
| 5,032,048 | A | 7/1991 | Walton et al. |
| 5,033,740 | A | 7/1991 | Schwartz |
| 5,034,576 | A | 7/1991 | Dalebout et al. |
| RE33,662 | E | 8/1991 | Blair et al. |
| 5,037,084 | A | 8/1991 | Flor |
| 5,037,089 | A | 8/1991 | Spagnuolo |
| 5,037,090 | A | 8/1991 | Fitzpatrick |
| 5,039,088 | A | 8/1991 | Shifferaw |
| 5,039,089 | A | 8/1991 | Lapcevic |
| 5,039,091 | A | 8/1991 | Johnson |
| 5,040,785 | A | 8/1991 | Charnitski |
| 5,040,787 | A | 8/1991 | Brotman |
| 5,040,788 | A | 8/1991 | Randall |
| 5,042,704 | A | 8/1991 | Izzo |
| 5,042,799 | A | 8/1991 | Stanley |
| 5,044,629 | A | 9/1991 | Ryan |
| 5,044,631 | A | 9/1991 | Jones |
| 5,044,632 | A | 9/1991 | Jones |
| 5,046,382 | A | 9/1991 | Steinberg |
| 5,046,722 | A | 9/1991 | Antoon |
| 5,048,823 | A | 9/1991 | Bean |
| 5,048,825 | A | 9/1991 | Kelly |
| 5,048,826 | A | 9/1991 | Ryan |
| 5,050,872 | A | 9/1991 | Farenholtz |
| 5,050,873 | A | 9/1991 | Jones |
| 5,051,638 | A | 9/1991 | Pyles |
| 5,052,684 | A | 10/1991 | Kosuge et al. |
| 5,054,770 | A | 10/1991 | Bull |
| 5,056,777 | A | 10/1991 | Capjon et al. |
| 5,058,881 | A | 10/1991 | Measom |
| 5,058,882 | A | 10/1991 | Dalebout et al. |
| 5,058,884 | A | 10/1991 | Fuller, Sr. |
| 5,058,888 | A | 10/1991 | Walker et al. |
| 5,062,626 | A | 11/1991 | Dalebout et al. |
| 5,062,627 | A | 11/1991 | Bingham |
| 5,062,629 | A | 11/1991 | Vaughan |
| 5,062,630 | A | 11/1991 | Nelson |
| 5,062,631 | A | 11/1991 | Dau et al. |
| 5,062,632 | A | 11/1991 | Dalebout et al. |
| 5,062,633 | A | 11/1991 | Engel et al. |
| 5,064,191 | A | 11/1991 | Johnson |
| 5,066,000 | A | 11/1991 | Dolan |
| 5,067,710 | A | 11/1991 | Watterson et al. |
| 5,071,115 | A | 12/1991 | Welch |
| 5,071,119 | A | 12/1991 | Johnson |
| 5,072,928 | A | 12/1991 | Stearns et al. |
| 5,072,929 | A | 12/1991 | Peterson et al. |
| 5,074,550 | A | 12/1991 | Sloan |
| 5,077,916 | A | 1/1992 | Beneteau |
| 5,080,353 | A | 1/1992 | Tench |
| 5,081,991 | A | 1/1992 | Chance |
| 5,085,426 | A | 2/1992 | Wanzer et al. |
| 5,085,427 | A | 2/1992 | Finn |
| 5,085,430 | A | 2/1992 | Habing |
| 5,087,047 | A | 2/1992 | McConnell |
| 5,088,729 | A | 2/1992 | Dalebout |
| 5,090,694 | A | 2/1992 | Pauls et al. |
| 5,094,249 | A | 3/1992 | Marras et al. |
| 5,094,447 | A | 3/1992 | Wang |
| 5,094,449 | A | 3/1992 | Stearns |
| 5,096,225 | A | 3/1992 | Osawa |
| 5,100,129 | A | 3/1992 | Porter |
| 5,102,121 | A | 4/1992 | Solow et al. |
| 5,102,122 | A | 4/1992 | Piane, Jr. |
| 5,102,124 | A | 4/1992 | Diodati |
| 5,102,380 | A | 4/1992 | Jacobson et al. |
| 5,104,119 | A | 4/1992 | Lynch |
| 5,104,120 | A | 4/1992 | Watterson et al. |
| 5,106,079 | A | 4/1992 | Escobedo |
| 5,108,090 | A | 4/1992 | Reed |
| 5,108,093 | A | 4/1992 | Watterson |
| 5,109,778 | A | 5/1992 | Berkowitz et al. |
| 5,110,117 | A | 5/1992 | Fisher et al. |
| 5,110,121 | A | 5/1992 | Foster |
| 5,112,045 | A | 5/1992 | Mason et al. |
| 5,112,287 | A | 5/1992 | Brewer |
| 5,114,388 | A | 5/1992 | Trulaske |
| 5,114,391 | A | 5/1992 | Pitzen et al. |
| 5,116,297 | A | 5/1992 | Stonecipher |
| 5,120,289 | A | 6/1992 | Yu |
| 5,123,629 | A | 6/1992 | Takeuchi |
| 5,123,885 | A | 6/1992 | Shields |
| 5,123,886 | A | 6/1992 | Cook |
| 5,125,647 | A | 6/1992 | Smith |
| 5,125,884 | A | 6/1992 | Weber et al. |
| 5,129,872 | A | 7/1992 | Dalton et al. |
| 5,131,895 | A | 7/1992 | Rogers, Jr. |
| 5,131,898 | A | 7/1992 | Panagos |
| 5,135,216 | A | 8/1992 | Bingham et al. |
| 5,135,445 | A | 8/1992 | Christensen |
| 5,135,449 | A | 8/1992 | Jones |
| 5,135,453 | A | 8/1992 | Sollenberger |
| 5,135,458 | A | 8/1992 | Huang |
| 5,135,459 | A | 8/1992 | Perry, Jr. |
| 5,137,272 | A | 8/1992 | Wilkinson |
| 5,137,501 | A | 8/1992 | Mertesdorf |
| 5,138,730 | A | 8/1992 | Masuda |
| 5,141,478 | A | 8/1992 | Upper |
| 5,141,480 | A | 8/1992 | Lennox et al. |
| 5,141,483 | A | 8/1992 | Smith |
| 5,142,358 | A | 8/1992 | Jason |
| 5,145,475 | A | 9/1992 | Cares |
| 5,145,481 | A | 9/1992 | Friedebach |
| 5,147,266 | A | 9/1992 | Ricard |
| 5,149,084 | A | 9/1992 | Dalebout et al. |
| 5,149,312 | A | 9/1992 | Croft et al. |
| 5,151,071 | A | 9/1992 | Jain et al. |
| 5,156,650 | A | 10/1992 | Bals |
| 5,158,518 | A | 10/1992 | Pizzuto |
| 5,158,520 | A | 10/1992 | Lemke et al. |
| 5,160,305 | A | 11/1992 | Lin |
| 5,162,029 | A | 11/1992 | Gerard |
| 5,163,885 | A | 11/1992 | Wanzer et al. |
| 5,167,159 | A | 12/1992 | Lucking |
| 5,167,597 | A | 12/1992 | David |
| 5,167,850 | A | 12/1992 | Shtarkman |
| 5,169,362 | A | 12/1992 | Schwartz |
| 5,169,363 | A | 12/1992 | Campanaro |
| 5,171,196 | A | 12/1992 | Lynch |

(56) References Cited

U.S. PATENT DOCUMENTS

| | | | |
|---|---|---|---|
| 5,176,601 | A | 1/1993 | Reynolds |
| 5,176,602 | A | 1/1993 | Roberts |
| 5,178,590 | A | 1/1993 | Stephens |
| 5,178,593 | A | 1/1993 | Roberts |
| 5,178,599 | A | 1/1993 | Scott |
| 5,180,352 | A | 1/1993 | Sreter |
| 5,181,894 | A | 1/1993 | Shieng |
| 5,184,295 | A | 2/1993 | Mann |
| 5,184,988 | A | 2/1993 | Dunham |
| 5,184,991 | A | 2/1993 | Brangi |
| 5,184,994 | A | 2/1993 | Morris |
| 5,186,697 | A | 2/1993 | Rennex |
| 5,190,509 | A | 3/1993 | Davison, Jr. |
| 5,190,513 | A | 3/1993 | Habing et al. |
| 5,192,255 | A | 3/1993 | Dalebout et al. |
| 5,192,257 | A | 3/1993 | Panasewicz |
| 5,192,258 | A | 3/1993 | Keller |
| 5,194,059 | A | 3/1993 | Wu |
| 5,195,781 | A | 3/1993 | Osawa |
| 5,195,935 | A | 3/1993 | Fencel |
| 5,195,937 | A | 3/1993 | Engel et al. |
| 5,199,931 | A | 4/1993 | Easley et al. |
| 5,199,934 | A | 4/1993 | Lin |
| 5,199,935 | A | 4/1993 | Gibson et al. |
| 5,201,694 | A | 4/1993 | Zappel |
| 5,201,772 | A | 4/1993 | Maxwell |
| 5,203,126 | A | 4/1993 | Sorenson et al. |
| 5,203,229 | A | 4/1993 | Chen |
| 5,203,800 | A | 4/1993 | Meredith |
| 5,203,826 | A | 4/1993 | Dalebout |
| 5,205,798 | A | 4/1993 | Lekhtman |
| 5,205,800 | A | 4/1993 | Grant |
| 5,205,802 | A | 4/1993 | Swisher |
| 5,207,489 | A | 5/1993 | Miller |
| 5,207,621 | A | 5/1993 | Koch et al. |
| 5,207,622 | A | 5/1993 | Wilkinson et al. |
| 5,207,625 | A | 5/1993 | White |
| 5,207,628 | A | 5/1993 | Graham |
| 5,209,223 | A | 5/1993 | McGorry et al. |
| 5,209,482 | A | 5/1993 | Hopfer |
| 5,209,715 | A | 5/1993 | Walker et al. |
| 5,211,614 | A | 5/1993 | Henes |
| 5,211,617 | A | 5/1993 | Millen |
| 5,215,510 | A | 6/1993 | Baran |
| 5,217,422 | A | 6/1993 | Domzalski |
| 5,221,240 | A | 6/1993 | Mann |
| 5,221,245 | A | 6/1993 | Yeh |
| 5,222,928 | A | 6/1993 | Yacullo |
| 5,224,909 | A | 7/1993 | Hamilton |
| 5,226,866 | A | 7/1993 | Engel et al. |
| 5,226,868 | A | 7/1993 | Montgomery |
| 5,230,680 | A | 7/1993 | Wu |
| 5,231,752 | A | 8/1993 | Hereford |
| 5,232,422 | A | 8/1993 | Bishop, Jr. |
| 5,234,392 | A | 8/1993 | Clark |
| 5,234,395 | A | 8/1993 | Miller et al. |
| 5,236,406 | A | 8/1993 | Webber |
| 5,240,417 | A | 8/1993 | Smithson et al. |
| 5,242,339 | A | 9/1993 | Thornton |
| 5,242,340 | A | 9/1993 | Jerome |
| 5,242,342 | A | 9/1993 | Silverman |
| 5,242,343 | A | 9/1993 | Miller |
| 5,242,344 | A | 9/1993 | Hundley |
| 5,242,345 | A | 9/1993 | Mitchell |
| 5,242,347 | A | 9/1993 | Keeton |
| 5,242,348 | A | 9/1993 | Bates |
| 5,242,353 | A | 9/1993 | Cole et al. |
| 5,244,444 | A | 9/1993 | Wostry |
| 5,247,853 | A | 9/1993 | Dalebout |
| 5,250,012 | A | 10/1993 | Whitcomb, Jr. |
| 5,250,013 | A | 10/1993 | Brangi |
| 5,254,065 | A | 10/1993 | Pollock |
| 5,254,066 | A | 10/1993 | Brown et al. |
| 5,254,067 | A | 10/1993 | Dalton et al. |
| 5,256,117 | A | 10/1993 | Potts et al. |
| 5,256,118 | A | 10/1993 | Chen |
| 5,256,121 | A | 10/1993 | Brotman |
| 5,256,126 | A | 10/1993 | Grotstein |
| 5,257,701 | A | 11/1993 | Edelson |
| 5,257,964 | A | 11/1993 | Petters |
| 5,261,864 | A | 11/1993 | Fitzpatrick |
| 5,261,865 | A | 11/1993 | Trainor |
| 5,263,913 | A | 11/1993 | Boren |
| 5,263,915 | A | 11/1993 | Habing |
| 5,263,916 | A | 11/1993 | Bobich |
| 5,267,929 | A | 12/1993 | Chen |
| 5,267,930 | A | 12/1993 | Henes |
| 5,269,736 | A | 12/1993 | Roberts |
| 5,269,737 | A | 12/1993 | Sobotka |
| 5,269,738 | A | 12/1993 | Boren |
| 5,273,285 | A | 12/1993 | Long |
| 5,273,505 | A | 12/1993 | Jones |
| 5,277,678 | A | 1/1994 | Friedebach et al. |
| 5,277,683 | A | 1/1994 | Wilkins |
| 5,277,684 | A | 1/1994 | Harris |
| 5,279,528 | A | 1/1994 | Dalebout et al. |
| 5,279,529 | A | 1/1994 | Eschenbach |
| 5,279,531 | A | 1/1994 | Jen Huey |
| 5,280,936 | A | 1/1994 | Schmidlin |
| 5,281,193 | A | 1/1994 | Colbo, Jr. |
| 5,282,776 | A | 2/1994 | Dalebout |
| 5,284,461 | A | 2/1994 | Wilkinson et al. |
| 5,284,463 | A | 2/1994 | Shields |
| 5,284,464 | A | 2/1994 | Lee, III et al. |
| 5,286,243 | A | 2/1994 | Lapcevic |
| 5,290,205 | A | 3/1994 | Densmore et al. |
| 5,290,211 | A | 3/1994 | Stearns |
| 5,290,214 | A | 3/1994 | Chen |
| 5,292,293 | A | 3/1994 | Schumacher |
| 5,292,297 | A | 3/1994 | Hsu |
| 5,295,928 | A | 3/1994 | Rennex |
| 5,295,935 | A | 3/1994 | Wang |
| 5,298,002 | A | 3/1994 | Lin |
| 5,299,992 | A | 4/1994 | Wilkinson |
| 5,299,993 | A | 4/1994 | Habing |
| 5,299,997 | A | 4/1994 | Chen |
| 5,302,161 | A | 4/1994 | Loubert et al. |
| 5,302,162 | A | 4/1994 | Pasero |
| 5,303,885 | A | 4/1994 | Wade |
| 5,306,218 | A | 4/1994 | Huang Chen |
| 5,306,221 | A | 4/1994 | Itaru |
| 5,308,075 | A | 5/1994 | Theriault |
| 5,308,234 | A | 5/1994 | Nicke et al. |
| 5,308,304 | A | 5/1994 | Habing |
| 5,310,392 | A | 5/1994 | Lo |
| 5,310,394 | A | 5/1994 | Kallios |
| 5,313,852 | A | 5/1994 | Arena |
| 5,314,391 | A | 5/1994 | Potash et al. |
| 5,314,392 | A | 5/1994 | Hawkins et al. |
| 5,314,394 | A | 5/1994 | Ronan |
| 5,316,534 | A | 5/1994 | Dalebout et al. |
| 5,318,487 | A | 6/1994 | Golen et al. |
| 5,318,490 | A | 6/1994 | Henderson et al. |
| 5,318,491 | A | 6/1994 | Houston |
| 5,318,495 | A | 6/1994 | Malynowsky |
| 5,320,343 | A | 6/1994 | McKinney |
| 5,320,588 | A | 6/1994 | Wanzer et al. |
| 5,320,591 | A | 6/1994 | Harmon et al. |
| 5,322,489 | A | 6/1994 | Webb et al. |
| 5,324,242 | A | 6/1994 | Lo |
| 5,328,410 | A | 7/1994 | Amburgey et al. |
| 5,328,420 | A | 7/1994 | Allen |
| 5,328,422 | A | 7/1994 | Nichols |
| 5,328,428 | A | 7/1994 | Huang |
| 5,328,429 | A | 7/1994 | Potash et al. |
| 5,328,430 | A | 7/1994 | Vittone |
| 5,330,401 | A | 7/1994 | Walstead |
| 5,330,402 | A | 7/1994 | Johnson |
| 5,330,404 | A | 7/1994 | Lopeteguy et al. |
| 5,330,405 | A | 7/1994 | Habing et al. |
| 5,330,408 | A | 7/1994 | Westmoreland, Jr. |
| 5,334,120 | A | 8/1994 | Rasmussen |
| 5,336,142 | A | 8/1994 | Dalebout et al. |
| 5,336,143 | A | 8/1994 | Wu |

(56) References Cited

U.S. PATENT DOCUMENTS

| | | | |
|---|---|---|---|
| 5,336,144 | A | 8/1994 | Rodden |
| 5,336,145 | A | 8/1994 | Keiser |
| 5,336,146 | A | 8/1994 | Piaget et al. |
| 5,336,148 | A | 8/1994 | Ish, III |
| 5,336,151 | A | 8/1994 | Van Ballegooie |
| 5,338,274 | A | 8/1994 | Jones |
| 5,338,277 | A | 8/1994 | Yang |
| 5,342,261 | A | 8/1994 | Johnston |
| 5,342,264 | A | 8/1994 | Gordon |
| 5,342,269 | A | 8/1994 | Huang |
| 5,342,271 | A | 8/1994 | Long |
| RE34,728 | E | 9/1994 | Hall-Tipping |
| 5,344,372 | A | 9/1994 | Hung |
| 5,344,374 | A | 9/1994 | Telle |
| 5,346,447 | A | 9/1994 | Stearns |
| 5,348,524 | A | 9/1994 | Grant |
| 5,350,344 | A | 9/1994 | Kissel |
| 5,350,345 | A | 9/1994 | Frey |
| 5,352,166 | A | 10/1994 | Chang |
| 5,352,167 | A | 10/1994 | Ulicny |
| 5,352,169 | A | 10/1994 | Eschenbach |
| 5,352,171 | A | 10/1994 | Lin |
| 5,352,174 | A | 10/1994 | Mason et al. |
| 5,353,452 | A | 10/1994 | Rulis |
| 5,354,248 | A | 10/1994 | Rawls et al. |
| 5,354,251 | A | 10/1994 | Sleamaker |
| 5,354,252 | A | 10/1994 | Habing |
| 5,354,253 | A | 10/1994 | Awbrey et al. |
| 5,356,003 | A | 10/1994 | Gretz et al. |
| 5,356,356 | A | 10/1994 | Hildebrandt et al. |
| 5,356,357 | A | 10/1994 | Wang et al. |
| 5,356,358 | A | 10/1994 | Chen |
| 5,356,360 | A | 10/1994 | Johns |
| 5,358,461 | A | 10/1994 | Bailey, Jr. |
| 5,358,462 | A | 10/1994 | Calderone |
| 5,359,986 | A | 11/1994 | Magrath, III et al. |
| 5,362,069 | A | 11/1994 | Hall-Tipping |
| 5,362,290 | A | 11/1994 | Huang |
| 5,362,295 | A | 11/1994 | Nurge |
| 5,362,296 | A | 11/1994 | Wang et al. |
| 5,364,060 | A | 11/1994 | Donovan et al. |
| 5,364,327 | A | 11/1994 | Graham |
| 5,366,428 | A | 11/1994 | Liao |
| 5,366,432 | A | 11/1994 | Habing et al. |
| 5,368,042 | A | 11/1994 | O'Neal et al. |
| 5,368,532 | A | 11/1994 | Farnet |
| 5,368,536 | A | 11/1994 | Stodgell |
| 5,370,594 | A | 12/1994 | Grinblat |
| 5,372,556 | A | 12/1994 | Ropp |
| 5,372,559 | A | 12/1994 | Dalebout et al. |
| 5,372,560 | A | 12/1994 | Chang |
| 5,372,564 | A | 12/1994 | Spirito |
| 5,374,227 | A | 12/1994 | Webb |
| 5,374,230 | A | 12/1994 | Bonnaime |
| 5,376,053 | A | 12/1994 | Ponder |
| 5,378,212 | A | 1/1995 | Pin-Kuo |
| 5,378,216 | A | 1/1995 | Ish, III et al. |
| 5,380,258 | A | 1/1995 | Hawley, Jr. |
| 5,382,207 | A | 1/1995 | Skowronski et al. |
| 5,382,208 | A | 1/1995 | Hu |
| 5,382,209 | A | 1/1995 | Pasier |
| 5,383,827 | A | 1/1995 | Stern |
| 5,383,828 | A | 1/1995 | Sands et al. |
| 5,385,346 | A | 1/1995 | Carroll et al. |
| 5,385,519 | A | 1/1995 | Hsu |
| 5,387,169 | A | 2/1995 | Wang |
| 5,387,170 | A | 2/1995 | Rawls et al. |
| 5,387,171 | A | 2/1995 | Casey et al. |
| 5,391,132 | A | 2/1995 | Greenwald |
| 5,392,476 | A | 2/1995 | Williams |
| 5,394,922 | A | 3/1995 | Colson et al. |
| 5,396,876 | A | 3/1995 | Liscio et al. |
| 5,397,287 | A | 3/1995 | Lindfors |
| 5,398,948 | A | 3/1995 | Mathis |
| 5,401,226 | A | 3/1995 | Stearns |
| 5,403,251 | A | 4/1995 | Belsito et al. |
| 5,403,252 | A | 4/1995 | Leon et al. |
| 5,403,253 | A | 4/1995 | Gaylord |
| 5,403,254 | A | 4/1995 | Lundin et al. |
| 5,403,255 | A | 4/1995 | Johnston |
| 5,403,256 | A | 4/1995 | Squires |
| 5,406,661 | A | 4/1995 | Pekar |
| 5,407,402 | A | 4/1995 | Brown et al. |
| 5,407,403 | A | 4/1995 | Coleman |
| 5,407,404 | A | 4/1995 | Killian et al. |
| 5,407,405 | A | 4/1995 | Oren |
| 5,407,408 | A | 4/1995 | Wilkinson |
| 5,407,411 | A | 4/1995 | Trainor |
| 5,407,414 | A | 4/1995 | Bass |
| 5,409,330 | A | 4/1995 | Naines et al. |
| 5,409,435 | A | 4/1995 | Daniels |
| RE34,959 | E | 5/1995 | Potts |
| 5,410,971 | A | 5/1995 | Golden et al. |
| 5,413,546 | A | 5/1995 | Basile |
| 5,413,551 | A | 5/1995 | Wu |
| 5,415,608 | A | 5/1995 | Bode |
| 5,417,634 | A | 5/1995 | Habing |
| 5,417,643 | A | 5/1995 | Taylor |
| 5,419,570 | A | 5/1995 | Bollotte |
| 5,419,571 | A | 5/1995 | Vaughan |
| 5,419,747 | A | 5/1995 | Piaget |
| 5,419,749 | A | 5/1995 | Morgenstein |
| 5,419,751 | A | 5/1995 | Byrd et al. |
| 5,421,795 | A | 6/1995 | Chen |
| 5,421,796 | A | 6/1995 | Jones et al. |
| 5,421,798 | A | 6/1995 | Bond et al. |
| 5,421,800 | A | 6/1995 | Mullen |
| 5,421,801 | A | 6/1995 | Davies, III et al. |
| 5,423,729 | A | 6/1995 | Eschenbach |
| 5,423,730 | A | 6/1995 | Hirsch |
| 5,423,731 | A | 6/1995 | Chen |
| 5,429,563 | A | 7/1995 | Engel et al. |
| 5,429,567 | A | 7/1995 | Gerschefske et al. |
| 5,429,568 | A | 7/1995 | Chen |
| 5,429,569 | A | 7/1995 | Gunnari |
| 5,431,612 | A | 7/1995 | Holden |
| 5,433,679 | A | 7/1995 | Szymczak et al. |
| 5,433,685 | A | 7/1995 | Winslow |
| 5,435,315 | A | 7/1995 | McPhee et al. |
| 5,435,798 | A | 7/1995 | Habing et al. |
| 5,435,799 | A | 7/1995 | Lundin |
| 5,435,801 | A | 7/1995 | Hung |
| 5,437,589 | A | 8/1995 | Habing |
| 5,439,225 | A | 8/1995 | Gvoich et al. |
| 5,441,467 | A | 8/1995 | Stevens |
| 5,441,468 | A | 8/1995 | Deckers et al. |
| 5,443,435 | A | 8/1995 | Wilkinson |
| 5,447,480 | A | 9/1995 | Fulks |
| 5,449,332 | A | 9/1995 | Hervig |
| 5,449,334 | A | 9/1995 | Kingsbury |
| 5,451,191 | A | 9/1995 | Beenken |
| 5,453,066 | A | 9/1995 | Richter, Jr. |
| 5,454,772 | A | 10/1995 | Rodden |
| 5,454,773 | A | 10/1995 | Blanchard et al. |
| 5,456,644 | A | 10/1995 | Hecox et al. |
| 5,456,648 | A | 10/1995 | Edinburg |
| 5,458,553 | A | 10/1995 | Wu |
| 5,460,586 | A | 10/1995 | Wilkinson |
| 5,462,503 | A | 10/1995 | Benjamin et al. |
| 5,462,504 | A | 10/1995 | Trulaske et al. |
| 5,464,378 | A | 11/1995 | Lee |
| 5,466,200 | A | 11/1995 | Ulrich et al. |
| 5,466,203 | A | 11/1995 | Chen |
| 5,467,874 | A | 11/1995 | Whitaker |
| 5,468,205 | A | 11/1995 | McFall et al. |
| 5,470,298 | A | 11/1995 | Curtis |
| 5,471,405 | A | 11/1995 | Marsh |
| 5,472,397 | A | 12/1995 | Ammoscato et al. |
| 5,472,399 | A | 12/1995 | Szekely |
| 5,474,087 | A | 12/1995 | Nashner |
| 5,474,510 | A | 12/1995 | Chen |
| 5,476,428 | A | 12/1995 | Potash et al. |
| 5,476,430 | A | 12/1995 | Lee et al. |
| 5,478,298 | A | 12/1995 | Chen |

(56) References Cited

U.S. PATENT DOCUMENTS

| | | | |
|---|---|---|---|
| 5,480,212 | A | 1/1996 | Marconet |
| 5,484,358 | A | 1/1996 | Wang et al. |
| 5,484,362 | A | 1/1996 | Skowronski et al. |
| 5,484,365 | A | 1/1996 | Jones et al. |
| 5,487,707 | A | 1/1996 | Sharf et al. |
| 5,489,249 | A | 2/1996 | Brewer et al. |
| 5,489,250 | A | 2/1996 | Densmore et al. |
| 5,490,818 | A | 2/1996 | Haber et al. |
| 5,492,514 | A | 2/1996 | Daum |
| 5,492,518 | A | 2/1996 | Measom |
| 5,492,520 | A | 2/1996 | Brown |
| 5,493,127 | A | 2/1996 | Lloyd et al. |
| 5,496,235 | A | 3/1996 | Stevens |
| 5,496,236 | A | 3/1996 | Buonauito |
| 5,496,238 | A | 3/1996 | Taylor |
| 5,496,239 | A | 3/1996 | Kallman |
| 5,496,244 | A | 3/1996 | Caruthers |
| 5,498,222 | A | 3/1996 | Hur |
| 5,498,223 | A | 3/1996 | Iams et al. |
| 5,499,956 | A | 3/1996 | Habing et al. |
| 5,499,959 | A | 3/1996 | Holmes et al. |
| 5,499,961 | A | 3/1996 | Mattox |
| 5,501,647 | A | 3/1996 | Snyder |
| 5,501,656 | A | 3/1996 | Homma et al. |
| 5,503,608 | A | 4/1996 | Chang |
| 5,505,011 | A | 4/1996 | Bleimhofer |
| 5,505,677 | A | 4/1996 | Hinds |
| 5,507,271 | A | 4/1996 | Actor |
| 5,507,710 | A | 4/1996 | Chen |
| 5,509,870 | A | 4/1996 | Lloyd |
| 5,512,025 | A | 4/1996 | Dalebout et al. |
| 5,512,029 | A | 4/1996 | Barnard |
| 5,514,053 | A | 5/1996 | Hawkins et al. |
| 5,514,059 | A | 5/1996 | Romney |
| 5,518,471 | A | 5/1996 | Hettinger et al. |
| 5,518,473 | A | 5/1996 | Miller |
| 5,518,476 | A | 5/1996 | Mcleon |
| 5,518,477 | A | 5/1996 | Simonson |
| 5,518,483 | A | 5/1996 | Oswald |
| 5,518,486 | A | 5/1996 | Sheeler |
| 5,520,599 | A | 5/1996 | Chen |
| 5,522,783 | A | 6/1996 | Gordon |
| 5,527,245 | A | 6/1996 | Dalebout et al. |
| 5,527,249 | A | 6/1996 | Harris |
| 5,527,250 | A | 6/1996 | Chen |
| 5,527,253 | A | 6/1996 | Wilkinson |
| 5,529,554 | A | 6/1996 | Eschenbach |
| 5,529,560 | A | 6/1996 | Dise |
| 5,531,658 | A | 7/1996 | L. S. C. |
| 5,533,899 | A | 7/1996 | Young |
| 5,533,948 | A | 7/1996 | Wilkinson |
| 5,533,951 | A | 7/1996 | Chang |
| 5,533,952 | A | 7/1996 | Schaber |
| 5,538,489 | A | 7/1996 | Magid |
| 5,540,642 | A | 7/1996 | Sprague |
| 5,542,892 | A | 8/1996 | Buhler |
| 5,545,112 | A | 8/1996 | Densmore et al. |
| 5,545,114 | A | 8/1996 | Gvoich |
| 5,549,052 | A | 8/1996 | Hoffman |
| 5,549,530 | A | 8/1996 | Fulks |
| 5,549,532 | A | 8/1996 | Kropp |
| 5,549,533 | A | 8/1996 | Olson et al. |
| 5,549,536 | A | 8/1996 | Clark |
| 5,551,934 | A | 9/1996 | Binette |
| 5,551,937 | A | 9/1996 | Kwo |
| 5,554,033 | A | 9/1996 | Bizzi et al. |
| 5,554,083 | A | 9/1996 | Chen |
| 5,554,085 | A | 9/1996 | Dalebout |
| 5,554,086 | A | 9/1996 | Habing et al. |
| 5,556,362 | A | 9/1996 | Whipps |
| 5,556,369 | A | 9/1996 | Roberts |
| 5,558,608 | A | 9/1996 | Hall |
| 5,562,572 | A | 10/1996 | Carmein |
| 5,562,574 | A | 10/1996 | Miller |
| 5,562,577 | A | 10/1996 | Nichols, Sr. et al. |
| 5,563,487 | A | 10/1996 | Davis |
| 5,568,993 | A | 10/1996 | Potzick |
| 5,569,128 | A | 10/1996 | Dalebout |
| 5,569,133 | A | 10/1996 | Vittone |
| 5,569,138 | A | 10/1996 | Wang et al. |
| 5,571,064 | A | 11/1996 | Holm |
| 5,573,485 | A | 11/1996 | Geschwender |
| 5,575,740 | A | 11/1996 | Piaget |
| 5,577,985 | A | 11/1996 | Miller |
| 5,577,987 | A | 11/1996 | Brown |
| 5,580,249 | A | 12/1996 | Jacobsen et al. |
| 5,580,340 | A | 12/1996 | Yu |
| 5,580,341 | A | 12/1996 | Simonson |
| 5,582,563 | A | 12/1996 | Fan |
| 5,582,565 | A | 12/1996 | Soria |
| 5,584,700 | A | 12/1996 | Feldman et al. |
| 5,584,779 | A | 12/1996 | Knecht |
| 5,586,736 | A | 12/1996 | Mollet |
| 5,586,811 | A | 12/1996 | Tornero |
| 5,586,962 | A | 12/1996 | Hallmark |
| 5,588,938 | A | 12/1996 | Schneider et al. |
| 5,588,942 | A | 12/1996 | Dillard |
| 5,590,893 | A | 1/1997 | Robinson et al. |
| 5,591,104 | A | 1/1997 | Andrus et al. |
| 5,591,106 | A | 1/1997 | Dalebout et al. |
| 5,591,107 | A | 1/1997 | Rodgers, Jr. |
| 5,591,908 | A | 1/1997 | Reid |
| 5,593,372 | A | 1/1997 | Rodgers, Jr. |
| 5,593,380 | A | 1/1997 | Bittikofer |
| 5,595,545 | A | 1/1997 | O'Brien |
| 5,595,556 | A | 1/1997 | Dalebout et al. |
| 5,595,559 | A | 1/1997 | Viel |
| 5,597,362 | A | 1/1997 | Lee |
| 5,597,375 | A | 1/1997 | Simonson |
| 5,599,261 | A | 2/1997 | Easley et al. |
| 5,600,310 | A | 2/1997 | Whipple, III et al. |
| 5,601,518 | A | 2/1997 | Weintraub |
| 5,603,675 | A | 2/1997 | Wu |
| 5,603,678 | A | 2/1997 | Wilson |
| 5,605,524 | A | 2/1997 | Husted |
| 5,607,250 | A | 3/1997 | Tatterson et al. |
| 5,607,375 | A | 3/1997 | Dalebout |
| 5,609,278 | A | 3/1997 | Fresco |
| 5,613,216 | A | 3/1997 | Galler |
| 5,613,856 | A | 3/1997 | Hoover |
| 5,613,924 | A | 3/1997 | Lee |
| 5,613,928 | A | 3/1997 | Laudone |
| 5,616,103 | A | 4/1997 | Lee |
| 5,616,106 | A | 4/1997 | Abelbeck |
| 5,616,107 | A | 4/1997 | Simonson |
| 5,616,111 | A | 4/1997 | Randolph |
| 5,618,250 | A | 4/1997 | Butz |
| 5,620,402 | A | 4/1997 | Simonson |
| 5,620,403 | A | 4/1997 | Lundin |
| 5,622,527 | A | 4/1997 | Watterson et al. |
| 5,624,353 | A | 4/1997 | Naidus |
| 5,624,360 | A | 4/1997 | Wilkins |
| 5,624,361 | A | 4/1997 | Lai |
| 5,625,577 | A | 4/1997 | Kunii et al. |
| 5,626,539 | A | 5/1997 | Piaget |
| 5,626,546 | A | 5/1997 | Little |
| 5,626,548 | A | 5/1997 | Coyle |
| 5,628,715 | A | 5/1997 | Simonson |
| 5,628,716 | A | 5/1997 | Brice |
| 5,630,566 | A | 5/1997 | Case |
| 5,632,209 | A | 5/1997 | Sakakibara |
| 5,632,711 | A | 5/1997 | Hwang |
| 5,634,870 | A | 6/1997 | Wilkinson |
| 5,637,064 | A | 6/1997 | Olson et al. |
| 5,643,142 | A | 7/1997 | Salerno et al. |
| 5,643,144 | A | 7/1997 | Trulaske |
| 5,643,147 | A | 7/1997 | Huang |
| 5,643,152 | A | 7/1997 | Simonson |
| 5,643,153 | A | 7/1997 | Nylen et al. |
| 5,643,157 | A | 7/1997 | Seliber |
| 5,643,162 | A | 7/1997 | Landers et al. |
| 5,645,509 | A | 7/1997 | Brewer et al. |
| 5,645,510 | A | 7/1997 | Wilkinson |
| 5,645,914 | A | 7/1997 | Horowitz |

(56) References Cited

U.S. PATENT DOCUMENTS 5,649,882 A 7/1997 Parikh et al.
5,650,709 A 7/1997 Rotunda et al.
5,653,662 A 8/1997 Rodgers, Jr.
5,653,669 A 8/1997 Cheng
5,655,997 A 8/1997 Greenberg et al.
5,656,003 A 8/1997 Robinson et al.
5,658,227 A 8/1997 Stearns
5,662,557 A 9/1997 Watterson et al.
5,665,031 A 9/1997 Hsieh
5,665,033 A 9/1997 Palmer
5,665,041 A 9/1997 Hsieh
5,667,459 A 9/1997 Su
5,667,465 A 9/1997 McCollum et al.
5,669,455 A 9/1997 Dietrich
5,669,833 A 9/1997 Stone
5,669,857 A 9/1997 Watterson et al.
5,669,862 A 9/1997 Sayman
5,669,865 A 9/1997 Gordon
5,672,140 A 9/1997 Watterson et al.
5,674,156 A 10/1997 Watterson et al.
5,674,167 A 10/1997 Piaget et al.
5,674,453 A 10/1997 Watterson et al.
5,676,624 A 10/1997 Watterson et al.
5,679,047 A 10/1997 Engel
5,679,100 A 10/1997 Charnitski
5,679,101 A 10/1997 Magid
5,681,247 A 10/1997 Webber
5,681,249 A 10/1997 Endelman
5,683,332 A 11/1997 Watterson et al.
5,683,334 A 11/1997 Webber
5,685,804 A 11/1997 Whan-Tong et al.
5,685,810 A 11/1997 Chung
5,688,196 A 11/1997 O'neil
5,688,209 A 11/1997 Trulaske et al.
5,688,210 A 11/1997 Chou
5,688,212 A 11/1997 Walker
5,688,216 A 11/1997 Mauriello
5,690,582 A 11/1997 Ulrich et al.
5,690,587 A 11/1997 Gruenangerl
5,690,589 A 11/1997 Rodgers, Jr.
5,692,994 A 12/1997 Eschenbach
5,692,996 A 12/1997 Widerman
5,692,997 A 12/1997 Stearns
5,693,004 A 12/1997 Carlson et al.
5,695,434 A 12/1997 Dalebout et al.
5,695,436 A 12/1997 Huang
5,702,325 A 12/1997 Watterson et al.
5,704,879 A 1/1998 Watterson et al.
5,707,168 A 1/1998 Sharon
5,707,319 A 1/1998 Riley
5,708,355 A 1/1998 Schrey
5,709,428 A 1/1998 Hugghins
5,709,632 A 1/1998 Socwell
5,709,633 A 1/1998 Sokol
5,709,634 A 1/1998 Pointer
5,709,636 A 1/1998 Vallone
5,709,638 A 1/1998 Mackert et al.
5,711,745 A 1/1998 Yang
5,711,746 A 1/1998 Carlson
5,711,749 A 1/1998 Miller
5,713,549 A 2/1998 Shieh
5,713,821 A 2/1998 Nissen
5,716,308 A 2/1998 Lee
5,718,657 A 2/1998 Dalebout et al.
5,718,660 A 2/1998 Chen
5,720,200 A 2/1998 Anderson et al.
5,720,474 A 2/1998 Sugiyama
5,720,702 A 2/1998 Lee
5,722,917 A 3/1998 Olschansky et al.
5,722,920 A 3/1998 Bauer
5,722,921 A 3/1998 Simonson
5,722,922 A 3/1998 Watterson et al.
5,725,459 A 3/1998 Rexach
5,725,463 A 3/1998 Colonello et al.
5,730,236 A 3/1998 Miller et al.
5,733,227 A 3/1998 Lee
5,733,228 A 3/1998 Stevens
5,733,229 A 3/1998 Dalebout et al.
5,733,232 A 3/1998 Hsu
5,735,586 A 4/1998 Cheng
5,735,773 A 4/1998 Vittone
5,735,776 A 4/1998 Swezey
5,738,612 A 4/1998 Tsuda
5,738,616 A 4/1998 Robertson
5,741,205 A 4/1998 Doll et al.
5,743,193 A 4/1998 Kakuta et al.
5,743,832 A 4/1998 Sands et al.
5,743,833 A 4/1998 Watterson et al.
5,743,835 A 4/1998 Trotter
5,746,682 A 5/1998 Hung
5,746,687 A 5/1998 Vial et al.
5,746,688 A 5/1998 Prager
5,749,372 A 5/1998 Allen
5,749,668 A 5/1998 Mcilvain
5,749,787 A 5/1998 Jank
5,749,807 A 5/1998 Webb
5,749,809 A 5/1998 Lin
5,749,813 A 5/1998 Domzalski
5,752,879 A 5/1998 Berdut
5,752,897 A 5/1998 Skowronski et al.
5,752,901 A 5/1998 Lee
5,755,642 A 5/1998 Miller
5,755,645 A 5/1998 Miller et al.
5,755,646 A 5/1998 Chu
5,755,651 A 5/1998 Homyonfer
5,755,823 A 5/1998 Cleary
5,759,136 A 6/1998 Chen
5,759,139 A 6/1998 Wright
5,760,353 A 6/1998 Rapp
5,761,831 A 6/1998 Cho
5,762,584 A 6/1998 Daniels
5,762,587 A 6/1998 Dalebout et al.
5,762,588 A 6/1998 Chen
5,766,118 A 6/1998 Conner
5,769,759 A 6/1998 Alter
5,769,762 A 6/1998 Towley, III et al.
5,771,152 A 6/1998 Crompton et al.
5,772,522 A 6/1998 Nesbit
5,772,558 A 6/1998 Rodgers, Jr.
5,772,560 A 6/1998 Watterson et al.
5,772,563 A 6/1998 Lin
5,776,040 A 7/1998 Webb et al.
5,776,582 A 7/1998 Needham
5,779,599 A 7/1998 Chen
5,779,604 A 7/1998 Towley, III et al.
5,779,607 A 7/1998 Harris
5,782,639 A 7/1998 Beal
5,782,723 A 7/1998 Kuo
5,785,630 A 7/1998 Bobick et al.
5,785,632 A 7/1998 Greenberg et al.
5,788,609 A 8/1998 Miller
5,788,610 A 8/1998 Eschenbach
5,788,611 A 8/1998 Kuo
5,788,616 A 8/1998 Polidi
5,788,618 A 8/1998 Joutras
5,792,027 A 8/1998 Gvoich
5,792,028 A 8/1998 Jarvie
5,792,029 A 8/1998 Gordon
5,792,031 A 8/1998 Alton
5,792,034 A 8/1998 Kozlovsky
5,795,270 A 8/1998 Woods et al.
5,795,274 A 8/1998 Kasbohm
5,797,578 A 8/1998 Graffeo
5,797,639 A 8/1998 Zorzenon
5,800,310 A 9/1998 Jones
5,800,321 A 9/1998 Webber
5,800,323 A 9/1998 Ansel
5,803,874 A 9/1998 Wilkinson
5,803,877 A 9/1998 Franey
5,803,882 A 9/1998 Habing et al.
5,807,210 A 9/1998 Devlin
5,807,214 A 9/1998 Riazi
5,810,696 A 9/1998 Webb
5,810,697 A 9/1998 Joiner

(56) References Cited

U.S. PATENT DOCUMENTS

| | | | |
|---|---|---|---|
| 5,810,698 | A | 9/1998 | Hullett et al. |
| 5,810,702 | A | 9/1998 | Wilkinson |
| 5,813,142 | A | 9/1998 | Demon |
| 5,813,947 | A | 9/1998 | Densmore |
| 5,813,953 | A | 9/1998 | Whipple |
| 5,816,372 | A | 10/1998 | Carlson et al. |
| 5,816,981 | A | 10/1998 | Hung |
| 5,816,983 | A | 10/1998 | Dawes et al. |
| 5,820,478 | A | 10/1998 | Wood et al. |
| 5,820,529 | A | 10/1998 | Weintraub |
| 5,820,532 | A | 10/1998 | Oliver |
| 5,823,618 | A | 10/1998 | Fox et al. |
| 5,825,983 | A | 10/1998 | Park et al. |
| 5,827,155 | A | 10/1998 | Jensen et al. |
| 5,827,158 | A | 10/1998 | Drecksel |
| 5,829,771 | A | 11/1998 | Hsu |
| 5,830,107 | A | 11/1998 | Brigliadoro |
| 5,830,113 | A | 11/1998 | Coody et al. |
| 5,830,114 | A | 11/1998 | Halfen et al. |
| 5,833,577 | A | 11/1998 | Hurt |
| 5,833,582 | A | 11/1998 | Chen |
| 5,833,583 | A | 11/1998 | Chuang |
| 5,833,584 | A | 11/1998 | Piaget et al. |
| 5,833,587 | A | 11/1998 | Strong et al. |
| 5,836,770 | A | 11/1998 | Powers |
| 5,836,854 | A | 11/1998 | Kuo |
| 5,836,858 | A | 11/1998 | Sharff |
| 5,839,990 | A | 11/1998 | Virkkala |
| 5,839,993 | A | 11/1998 | Fox |
| 5,839,997 | A | 11/1998 | Roth et al. |
| 5,842,956 | A | 12/1998 | Strachan |
| 5,842,961 | A | 12/1998 | Davis |
| 5,846,166 | A | 12/1998 | Kuo |
| 5,848,954 | A | 12/1998 | Stearns et al. |
| 5,852,264 | A | 12/1998 | Muller |
| 5,855,537 | A | 1/1999 | Coody et al. |
| 5,855,538 | A | 1/1999 | Argabright |
| 5,857,939 | A | 1/1999 | Kaufman |
| 5,857,940 | A | 1/1999 | Husted |
| 5,857,941 | A | 1/1999 | Maresh |
| 5,857,942 | A | 1/1999 | Moon et al. |
| 5,857,943 | A | 1/1999 | Murray |
| 5,860,190 | A | 1/1999 | Cano |
| 5,860,893 | A | 1/1999 | Watterson et al. |
| 5,860,894 | A | 1/1999 | Dalebout et al. |
| 5,860,899 | A | 1/1999 | Rassman |
| 5,865,710 | A | 2/1999 | Wilson-Hyde |
| 5,865,714 | A | 2/1999 | Marlowe |
| 5,868,108 | A | 2/1999 | Schmitz et al. |
| 5,868,648 | A | 2/1999 | Coody et al. |
| 5,868,653 | A | 2/1999 | Klasen |
| 5,871,421 | A | 2/1999 | Trulaske et al. |
| 5,871,424 | A | 2/1999 | Conner |
| 5,876,095 | A | 3/1999 | Johnston |
| 5,876,310 | A | 3/1999 | Mackey et al. |
| 5,876,313 | A | 3/1999 | Krull |
| 5,879,247 | A | 3/1999 | Winter et al. |
| 5,879,271 | A | 3/1999 | Stearns et al. |
| 5,879,273 | A | 3/1999 | Wei |
| 5,879,276 | A | 3/1999 | Miller |
| 5,882,281 | A | 3/1999 | Stearns et al. |
| 5,885,196 | A | 3/1999 | Gvoich |
| 5,885,197 | A | 3/1999 | Barton |
| 5,888,172 | A | 3/1999 | Andrus et al. |
| 5,890,562 | A | 4/1999 | Bartels et al. |
| 5,890,995 | A | 4/1999 | Bobick et al. |
| 5,891,001 | A | 4/1999 | Carnes et al. |
| 5,891,003 | A | 4/1999 | Deac et al. |
| 5,891,004 | A | 4/1999 | Berry |
| 5,891,042 | A | 4/1999 | Sham et al. |
| 5,895,339 | A | 4/1999 | Maresh |
| 5,895,340 | A | 4/1999 | Keller |
| 5,895,342 | A | 4/1999 | Solland |
| 5,897,457 | A | 4/1999 | Mackovjak |
| 5,897,459 | A | 4/1999 | Habing et al. |
| 5,897,460 | A | 4/1999 | McBride et al. |
| 5,897,461 | A | 4/1999 | Socwell |
| 5,897,463 | A | 4/1999 | Maresh |
| 5,897,467 | A | 4/1999 | Habing et al. |
| 5,897,469 | A | 4/1999 | Yalch |
| 5,897,472 | A | 4/1999 | Thulasingam |
| 5,897,474 | A | 4/1999 | Romero |
| 5,899,833 | A | 5/1999 | Ryan et al. |
| 5,899,834 | A | 5/1999 | Dalebout et al. |
| 5,902,214 | A | 5/1999 | Makikawa et al. |
| 5,904,398 | A | 5/1999 | Farricielli |
| 5,904,636 | A | 5/1999 | Chen |
| 5,904,638 | A | 5/1999 | Habing et al. |
| 5,906,269 | A | 5/1999 | Zabron et al. |
| 5,906,564 | A | 5/1999 | Jacobsen |
| 5,906,566 | A | 5/1999 | Whitcomb |
| 5,908,373 | A | 6/1999 | Pitre |
| 5,910,070 | A | 6/1999 | Henry et al. |
| 5,910,072 | A | 6/1999 | Rawls et al. |
| 5,910,073 | A | 6/1999 | Conner |
| 5,911,132 | A | 6/1999 | Sloane |
| 5,911,649 | A | 6/1999 | Miller |
| 5,913,751 | A | 6/1999 | Eschenbach |
| 5,916,064 | A | 6/1999 | Eschenbach |
| 5,916,069 | A | 6/1999 | Wang |
| 5,917,692 | A | 6/1999 | Schmitz et al. |
| 5,919,118 | A | 7/1999 | Stearns |
| 5,921,892 | A | 7/1999 | Easton |
| 5,921,896 | A | 7/1999 | Boland |
| 5,921,901 | A | 7/1999 | Palacios |
| 5,924,966 | A | 7/1999 | Havlovic |
| 5,925,001 | A | 7/1999 | Hoyt et al. |
| 5,927,780 | A | 7/1999 | Chandler |
| 5,928,116 | A | 7/1999 | Chiang |
| 5,931,767 | A | 8/1999 | Morales |
| 5,935,048 | A | 8/1999 | Krull |
| 5,938,551 | A | 8/1999 | Warner |
| 5,938,565 | A | 8/1999 | Bernacki |
| 5,938,570 | A | 8/1999 | Maresh |
| 5,938,571 | A | 8/1999 | Stevens |
| 5,938,574 | A | 8/1999 | Webber |
| 5,938,575 | A | 8/1999 | Stearns |
| 5,940,502 | A | 8/1999 | Hirai et al. |
| 5,940,911 | A | 8/1999 | Wang |
| 5,941,800 | A | 8/1999 | Laconis |
| 5,941,803 | A | 8/1999 | Chamberlain |
| 5,941,807 | A | 8/1999 | Cassidy |
| 5,943,794 | A | 8/1999 | Gelsomini |
| 5,944,641 | A | 8/1999 | Habing |
| 5,944,642 | A | 8/1999 | Krull |
| 5,947,869 | A | 9/1999 | Shea |
| 5,947,872 | A | 9/1999 | Ryan et al. |
| 5,951,444 | A | 9/1999 | Webber |
| 5,951,447 | A | 9/1999 | Butler |
| 5,951,449 | A | 9/1999 | Oppriecht |
| 5,954,106 | A | 9/1999 | Huang |
| 5,954,621 | A | 9/1999 | Joutras et al. |
| 5,957,814 | A | 9/1999 | Eschenbach |
| 5,957,819 | A | 9/1999 | Cortesi |
| 5,961,423 | A | 10/1999 | Sellers |
| 5,961,428 | A | 10/1999 | Webber |
| 5,961,430 | A | 10/1999 | Zuckerman et al. |
| 5,964,684 | A | 10/1999 | Sokol |
| 5,967,944 | A | 10/1999 | Vittone et al. |
| 5,967,948 | A | 10/1999 | Carr |
| 5,967,950 | A | 10/1999 | Hsu |
| 5,967,954 | A | 10/1999 | Habing |
| 5,967,955 | A | 10/1999 | Westfall et al. |
| 5,971,892 | A | 10/1999 | Lee |
| 5,971,895 | A | 10/1999 | Habing |
| 5,971,902 | A | 10/1999 | Robertson et al. |
| 5,976,039 | A | 11/1999 | Epel et al. |
| 5,976,061 | A | 11/1999 | Moon et al. |
| 5,980,430 | A | 11/1999 | Wang |
| 5,980,432 | A | 11/1999 | Ahman |
| 5,984,798 | A | 11/1999 | Gilmour |
| 5,984,836 | A | 11/1999 | Casali |
| 5,984,839 | A | 11/1999 | Corkum |
| 5,989,161 | A | 11/1999 | Wang et al. |

(56) References Cited

U.S. PATENT DOCUMENTS

| | | | |
|---|---|---|---|
| 5,989,163 | A | 11/1999 | Rodgers, Jr. |
| 5,989,164 | A | 11/1999 | Kullman et al. |
| 5,989,165 | A | 11/1999 | Giannelli et al. |
| 5,989,166 | A | 11/1999 | Capizzo et al. |
| 5,989,168 | A | 11/1999 | See |
| 5,991,143 | A | 11/1999 | Wright et al. |
| 5,993,358 | A | 11/1999 | Gureghian et al. |
| 5,993,359 | A | 11/1999 | Eschenbach |
| 5,993,362 | A | 11/1999 | Ghobadi |
| 5,997,447 | A | 12/1999 | Giannelli et al. |
| 5,997,450 | A | 12/1999 | Wilkinson |
| 5,998,897 | A | 12/1999 | Bosten et al. |
| 6,003,294 | A | 12/1999 | Fitzgerald et al. |
| 6,003,481 | A | 12/1999 | Pischinger et al. |
| 6,004,244 | A | 12/1999 | Simonson |
| 6,004,246 | A | 12/1999 | Sencil |
| 6,004,247 | A | 12/1999 | Webber |
| 6,006,379 | A | 12/1999 | Hensley |
| 6,007,268 | A | 12/1999 | Whittington et al. |
| 6,010,432 | A | 1/2000 | Vawter |
| 6,011,134 | A | 1/2000 | Marks et al. |
| 6,012,591 | A | 1/2000 | Brandenberg |
| 6,012,772 | A | 1/2000 | Conde et al. |
| 6,013,011 | A | 1/2000 | Moore et al. |
| 6,015,367 | A | 1/2000 | Scaramucci |
| 6,015,368 | A | 1/2000 | Clem |
| 6,015,371 | A | 1/2000 | Davitt |
| 6,017,293 | A | 1/2000 | Pfefferle |
| 6,019,403 | A | 2/2000 | Corbett |
| 6,022,300 | A | 2/2000 | Hightower |
| 6,022,302 | A | 2/2000 | McBride |
| 6,024,677 | A | 2/2000 | Siwertz |
| 6,027,429 | A | 2/2000 | Daniels |
| 6,027,430 | A | 2/2000 | Stearns et al. |
| 6,027,432 | A | 2/2000 | Cheng |
| 6,027,433 | A | 2/2000 | Flynn |
| 6,029,858 | A | 2/2000 | Srokose et al. |
| 6,030,320 | A | 2/2000 | Stearns |
| 6,030,323 | A | 2/2000 | Fontenot |
| 6,033,344 | A | 3/2000 | Trulaske et al. |
| 6,033,347 | A | 3/2000 | Dalebout et al. |
| 6,033,350 | A | 3/2000 | Krull |
| 6,036,622 | A | 3/2000 | Gordon |
| 6,036,625 | A | 3/2000 | Woodruff |
| 6,039,677 | A | 3/2000 | Spletzer |
| 6,039,678 | A | 3/2000 | Dawson |
| 6,042,512 | A | 3/2000 | Eschenbach |
| 6,042,514 | A | 3/2000 | Abelbeck |
| 6,042,515 | A | 3/2000 | Wang |
| 6,042,516 | A | 3/2000 | Norton |
| 6,042,518 | A | 3/2000 | Hildebrandt et al. |
| 6,042,523 | A | 3/2000 | Graham |
| 6,045,487 | A | 4/2000 | Miller |
| 6,045,488 | A | 4/2000 | Eschenbach |
| 6,045,490 | A | 4/2000 | Shafer |
| 6,045,491 | A | 4/2000 | McNergney |
| 6,050,920 | A | 4/2000 | Ehrenfried |
| 6,050,921 | A | 4/2000 | Wang |
| 6,050,922 | A | 4/2000 | Wang |
| 6,050,923 | A | 4/2000 | Yu |
| 6,053,816 | A | 4/2000 | Immel |
| 6,053,844 | A | 4/2000 | Clem |
| 6,053,847 | A | 4/2000 | Stearns et al. |
| 6,053,848 | A | 4/2000 | Eschenbach |
| 6,053,853 | A | 4/2000 | Hinds |
| 6,055,747 | A | 5/2000 | Lombardino |
| 6,056,678 | A | 5/2000 | Giannelli et al. |
| 6,059,692 | A | 5/2000 | Hickman |
| 6,059,695 | A | 5/2000 | Hung |
| 6,059,698 | A | 5/2000 | Mazor |
| 6,059,701 | A | 5/2000 | George et al. |
| 6,063,009 | A | 5/2000 | Stearns |
| 6,065,572 | A | 5/2000 | Schober et al. |
| 6,066,075 | A | 5/2000 | Poulton |
| 6,066,077 | A | 5/2000 | Horst |
| 6,068,578 | A | 5/2000 | Wang |
| 6,068,579 | A | 5/2000 | Killian et al. |
| 6,071,031 | A | 6/2000 | Bailey |
| 6,071,216 | A | 6/2000 | Giannelli et al. |
| 6,071,217 | A | 6/2000 | Barnett |
| 6,074,328 | A | 6/2000 | Johnson |
| 6,075,525 | A | 6/2000 | Hsieh |
| 6,077,196 | A | 6/2000 | Eschenbach |
| 6,077,198 | A | 6/2000 | Eschenbach |
| 6,077,199 | A | 6/2000 | Hsu |
| 6,077,200 | A | 6/2000 | Lin |
| 6,079,915 | A | 6/2000 | Bosten et al. |
| 6,080,091 | A | 6/2000 | Habing et al. |
| 6,082,346 | A | 7/2000 | Andrews et al. |
| 6,083,144 | A | 7/2000 | Towley, III et al. |
| 6,086,520 | A | 7/2000 | Rodriquez |
| 6,086,521 | A | 7/2000 | Solland |
| 6,090,014 | A | 7/2000 | Eschenbach |
| 6,090,016 | A | 7/2000 | Kuo |
| 6,090,020 | A | 7/2000 | Webber |
| 6,095,951 | A | 8/2000 | Skowronski et al. |
| 6,095,954 | A | 8/2000 | Svanberg |
| 6,099,439 | A | 8/2000 | Ryan et al. |
| 6,099,442 | A | 8/2000 | Krull |
| 6,099,444 | A | 8/2000 | Domenge |
| 6,101,684 | A | 8/2000 | Ginocchio |
| 6,102,412 | A | 8/2000 | Staffaroni |
| 6,102,832 | A | 8/2000 | Tani |
| 6,102,836 | A | 8/2000 | Person |
| 6,102,837 | A | 8/2000 | Hubbard |
| 6,106,437 | A | 8/2000 | Brooks |
| 6,106,439 | A | 8/2000 | Boland |
| 6,110,075 | A | 8/2000 | Woodruff |
| 6,110,076 | A | 8/2000 | Hurt |
| 6,110,077 | A | 8/2000 | Yu |
| 6,110,081 | A | 8/2000 | Barrett |
| 6,112,624 | A | 9/2000 | Chen |
| 6,113,188 | A | 9/2000 | Stewart et al. |
| 6,113,323 | A | 9/2000 | Bosten et al. |
| 6,113,518 | A | 9/2000 | Maresh |
| 6,113,522 | A | 9/2000 | Fontenot et al. |
| 6,113,564 | A | 9/2000 | McGuire |
| 6,117,049 | A | 9/2000 | Lowe |
| 6,120,421 | A | 9/2000 | Kuo |
| 6,120,424 | A | 9/2000 | Arline |
| 6,123,646 | A | 9/2000 | Colassi |
| 6,123,647 | A | 9/2000 | Mitchell |
| 6,123,648 | A | 9/2000 | Stevens |
| 6,123,649 | A | 9/2000 | Lee |
| 6,123,650 | A | 9/2000 | Birrell |
| 6,125,851 | A | 10/2000 | Walker et al. |
| 6,126,574 | A | 10/2000 | Stearns et al. |
| 6,126,575 | A | 10/2000 | Wang |
| 6,126,576 | A | 10/2000 | Wang |
| 6,126,577 | A | 10/2000 | Chang |
| 6,128,981 | A | 10/2000 | Bondhus et al. |
| 6,129,651 | A | 10/2000 | Denaro |
| 6,129,962 | A | 10/2000 | Quigley et al. |
| 6,132,340 | A | 10/2000 | Wang |
| 6,132,347 | A | 10/2000 | Alessandri |
| 6,135,924 | A | 10/2000 | Gibbs et al. |
| 6,135,925 | A | 10/2000 | Liu |
| 6,135,926 | A | 10/2000 | Lee |
| 6,135,927 | A | 10/2000 | Lo |
| 6,142,870 | A | 11/2000 | Wada et al. |
| 6,142,913 | A | 11/2000 | Ewert |
| 6,142,914 | A | 11/2000 | Crawford et al. |
| 6,142,915 | A | 11/2000 | Eschenbach |
| 6,146,313 | A | 11/2000 | Whan-Tong et al. |
| 6,146,315 | A | 11/2000 | Schonenberger |
| 6,149,551 | A | 11/2000 | Pyles et al. |
| 6,149,552 | A | 11/2000 | Chen |
| 6,149,556 | A | 11/2000 | Jordan |
| 6,149,558 | A | 11/2000 | Chen |
| 6,149,559 | A | 11/2000 | Mackey |
| 6,152,856 | A | 11/2000 | Studor et al. |
| 6,152,859 | A | 11/2000 | Stearns |
| 6,152,864 | A | 11/2000 | Giannelli et al. |
| 6,162,153 | A | 12/2000 | Perez, Jr. |

(56) References Cited

U.S. PATENT DOCUMENTS

| | | | |
|---|---|---|---|
| 6,162,183 | A | 12/2000 | Hoover |
| 6,163,451 | A | 12/2000 | Chiu |
| 6,165,107 | A | 12/2000 | Birrell |
| 6,165,110 | A | 12/2000 | Gajda |
| 6,168,551 | B1 | 1/2001 | Mcguinness |
| 6,168,557 | B1 | 1/2001 | Liao |
| 6,171,216 | B1 | 1/2001 | Wang |
| 6,172,178 | B1 | 1/2001 | Koning et al. |
| 6,174,265 | B1 | 1/2001 | Alessandri |
| 6,174,267 | B1 | 1/2001 | Dalebout |
| 6,174,268 | B1 | 1/2001 | Novak |
| 6,175,994 | B1 | 1/2001 | Nicoletti |
| 6,176,814 | B1 | 1/2001 | Ryan et al. |
| 6,179,748 | B1 | 1/2001 | Barr |
| 6,179,753 | B1 | 1/2001 | Barker et al. |
| 6,181,647 | B1 | 1/2001 | Tipton et al. |
| 6,183,397 | B1 | 2/2001 | Stearns et al. |
| 6,183,400 | B1 | 2/2001 | Pope |
| 6,183,401 | B1 | 2/2001 | Krull |
| 6,183,403 | B1 | 2/2001 | Dunn |
| 6,186,290 | B1 | 2/2001 | Carlson |
| 6,186,460 | B1 | 2/2001 | Lin |
| 6,186,926 | B1 | 2/2001 | Ellis |
| 6,186,927 | B1 | 2/2001 | Krull |
| 6,186,928 | B1 | 2/2001 | Chen |
| 6,186,929 | B1 | 2/2001 | Endelman et al. |
| 6,189,846 | B1 | 2/2001 | Wang |
| 6,190,289 | B1 | 2/2001 | Pyles et al. |
| 6,193,635 | B1 | 2/2001 | Webber et al. |
| 6,196,952 | B1 | 3/2001 | Chen |
| 6,196,954 | B1 | 3/2001 | Chen |
| 6,199,732 | B1 | 3/2001 | Swetish |
| 6,203,473 | B1 | 3/2001 | Atwood |
| 6,203,474 | B1 | 3/2001 | Jones |
| 6,206,795 | B1 | 3/2001 | Ou |
| 6,206,804 | B1 | 3/2001 | Maresh |
| 6,210,305 | B1 | 4/2001 | Eschenbach |
| 6,213,919 | B1 | 4/2001 | Wang |
| 6,213,923 | B1 | 4/2001 | Cameron et al. |
| 6,215,870 | B1 | 4/2001 | Hirai et al. |
| 6,217,483 | B1 | 4/2001 | Kallassy |
| 6,217,487 | B1 | 4/2001 | Reinert |
| 6,217,493 | B1 | 4/2001 | Spletzer |
| 6,217,495 | B1 | 4/2001 | Yalch |
| 6,220,990 | B1 | 4/2001 | Crivello |
| 6,220,992 | B1 | 4/2001 | Shafik |
| 6,220,995 | B1 | 4/2001 | Chen |
| 6,224,516 | B1 | 5/2001 | Disch |
| 6,224,519 | B1 | 5/2001 | Doolittle |
| 6,228,003 | B1 | 5/2001 | Hald et al. |
| 6,230,047 | B1 | 5/2001 | McHugh |
| 6,230,460 | B1 | 5/2001 | Huyett |
| 6,231,482 | B1 | 5/2001 | Thompson |
| 6,231,489 | B1 | 5/2001 | McBride et al. |
| 6,231,946 | B1 | 5/2001 | Brown, Jr. et al. |
| 6,234,935 | B1 | 5/2001 | Chu |
| 6,234,936 | B1 | 5/2001 | Wang |
| 6,234,941 | B1 | 5/2001 | Chu |
| 6,237,583 | B1 | 5/2001 | Ripley et al. |
| 6,238,322 | B1 | 5/2001 | Hsu |
| 6,238,323 | B1 | 5/2001 | Simonson |
| 6,241,553 | B1 | 6/2001 | Hsia |
| 6,241,638 | B1 | 6/2001 | Hurt |
| 6,244,988 | B1 | 6/2001 | Delman |
| 6,244,992 | B1 | 6/2001 | James |
| 6,244,995 | B1 | 6/2001 | Prsala |
| 6,245,001 | B1 | 6/2001 | Siaperas |
| 6,251,047 | B1 | 6/2001 | Stearns et al. |
| 6,251,048 | B1 | 6/2001 | Kaufman |
| 6,251,052 | B1 | 6/2001 | Simonson |
| 6,254,514 | B1 | 7/2001 | Maresh et al. |
| 6,254,515 | B1 | 7/2001 | Carman et al. |
| 6,254,516 | B1 | 7/2001 | Giannelli et al. |
| 6,261,022 | B1 | 7/2001 | Dalebout et al. |
| 6,261,209 | B1 | 7/2001 | Coody |
| 6,264,272 | B1 | 7/2001 | Jones et al. |
| 6,264,586 | B1 | 7/2001 | Webber |
| 6,264,588 | B1 | 7/2001 | Ellis |
| 6,267,710 | B1 | 7/2001 | Liu |
| 6,267,711 | B1 | 7/2001 | Hinds |
| 6,273,842 | B1 | 8/2001 | Wang |
| 6,273,843 | B1 | 8/2001 | Lo |
| 6,276,749 | B1 | 8/2001 | Okazawa et al. |
| 6,277,054 | B1 | 8/2001 | Kuo |
| 6,277,056 | B1 | 8/2001 | McBride et al. |
| 6,280,361 | B1 | 8/2001 | Harvey et al. |
| 6,280,362 | B1 | 8/2001 | Dalebout et al. |
| 6,280,367 | B1 | 8/2001 | Arsenault |
| 6,282,816 | B1 | 9/2001 | Rosendahl |
| 6,283,859 | B1 | 9/2001 | Carlson et al. |
| 6,283,896 | B1 | 9/2001 | Grunfeld |
| 6,287,240 | B1 | 9/2001 | Trabbic |
| 6,287,241 | B1 | 9/2001 | Ellis |
| 6,290,630 | B1 | 9/2001 | Boland |
| 6,293,375 | B1 | 9/2001 | Chen |
| 6,293,892 | B1 | 9/2001 | Slawinski et al. |
| 6,299,959 | B1 | 10/2001 | Squires et al. |
| 6,302,815 | B1 | 10/2001 | Shishido et al. |
| 6,302,826 | B1 | 10/2001 | Lee |
| 6,302,828 | B1 | 10/2001 | Martin et al. |
| 6,302,829 | B1 | 10/2001 | Schmidt |
| 6,302,830 | B1 | 10/2001 | Stearns |
| 6,302,833 | B1 | 10/2001 | Ellis et al. |
| 6,306,108 | B1 | 10/2001 | Butler |
| 6,307,167 | B1 | 10/2001 | Kajio et al. |
| 6,309,331 | B1 | 10/2001 | Raymond |
| 6,312,363 | B1 | 11/2001 | Watterson et al. |
| 6,312,366 | B1 | 11/2001 | Prusick |
| 6,314,667 | B1 | 11/2001 | Rife et al. |
| 6,315,486 | B1 | 11/2001 | Lunz |
| 6,315,702 | B1 | 11/2001 | Ikonomopoulos |
| 6,319,176 | B1 | 11/2001 | Landfair |
| 6,319,178 | B1 | 11/2001 | Webber |
| 6,319,179 | B1 | 11/2001 | Hinds |
| 6,322,059 | B1 | 11/2001 | Kelm et al. |
| 6,322,481 | B1 | 11/2001 | Krull |
| 6,322,483 | B1 | 11/2001 | Rotella |
| 6,325,745 | B1 | 12/2001 | Yu |
| 6,325,746 | B1 | 12/2001 | Wang |
| 6,328,325 | B1 | 12/2001 | Greenwood |
| 6,328,676 | B1 | 12/2001 | Alessandri |
| 6,328,677 | B1 | 12/2001 | Drapeau |
| 6,334,624 | B1 | 1/2002 | Giglio |
| 6,335,100 | B1 | 1/2002 | Tominaga et al. |
| 6,338,701 | B1 | 1/2002 | Webber |
| 6,340,340 | B1 | 1/2002 | Stearns |
| 6,342,028 | B1 | 1/2002 | De Sane |
| 6,344,986 | B1 | 2/2002 | Jain et al. |
| 6,347,603 | B1 | 2/2002 | Felger |
| 6,347,731 | B1 | 2/2002 | Burger |
| 6,348,028 | B1 | 2/2002 | Cragg |
| 6,350,218 | B1 | 2/2002 | Dalebout et al. |
| 6,350,219 | B1 | 2/2002 | Hobson |
| 6,350,221 | B1 | 2/2002 | Krull |
| 6,352,494 | B2 | 3/2002 | McAlonan |
| 6,357,077 | B1 | 3/2002 | Jones, Jr. et al. |
| 6,358,187 | B1 | 3/2002 | Smith |
| 6,360,408 | B1 | 3/2002 | Dykstra et al. |
| 6,361,476 | B1 | 3/2002 | Eschenbach |
| 6,368,251 | B1 | 4/2002 | Casler |
| 6,368,252 | B1 | 4/2002 | Stearns |
| 6,368,254 | B1 | 4/2002 | Wall |
| 6,371,738 | B2 | 4/2002 | Jones |
| 6,371,895 | B1 | 4/2002 | Endelman et al. |
| 6,375,580 | B1 | 4/2002 | Schmidt |
| 6,379,287 | B1 | 4/2002 | Slawinski et al. |
| 6,379,289 | B1 | 4/2002 | Gossie |
| 6,382,627 | B1 | 5/2002 | Lundberg |
| 6,383,120 | B1 | 5/2002 | Lo |
| 6,387,015 | B1 | 5/2002 | Watson |
| 6,387,016 | B1 | 5/2002 | Lo |
| 6,387,018 | B1 | 5/2002 | Krull |
| 6,387,019 | B1 | 5/2002 | Krull |
| 6,387,022 | B1 | 5/2002 | Smith |

(56) References Cited

U.S. PATENT DOCUMENTS 6,387,024 B1 5/2002 Monti et al.
6,390,927 B1 5/2002 Cleveland, III
6,390,953 B1 5/2002 Maresh
6,390,955 B1 5/2002 Wang
6,394,239 B1 5/2002 Carlson
6,394,935 B1 5/2002 Lake
6,394,936 B1 5/2002 Voris
6,394,938 B1 5/2002 Tornabene
6,397,797 B1 6/2002 Kolmanovsky et al.
6,398,695 B2 6/2002 Miller
6,402,666 B2 6/2002 Krull
6,409,632 B1 6/2002 Eschenbach
6,409,633 B1 6/2002 Abelbeck
6,413,196 B1 7/2002 Crowson
6,413,197 B2 7/2002 McKechnie et al.
6,416,442 B1 7/2002 Stearns et al.
6,416,444 B1 7/2002 Lim
6,416,446 B1 7/2002 Krull
6,416,447 B1 7/2002 Harmon
6,419,611 B1 7/2002 Levine et al.
6,422,976 B1 7/2002 Eschenbach
6,422,977 B1 7/2002 Eschenbach
6,422,979 B1 7/2002 Krull
6,422,980 B1 7/2002 Simonson
6,422,981 B1 7/2002 Riser
6,422,983 B1 7/2002 Weck
6,427,805 B1 8/2002 Gibson et al.
6,428,449 B1 8/2002 Apseloff
6,428,450 B1 8/2002 Ho
6,430,997 B1 8/2002 French et al.
6,432,026 B1 8/2002 Wang
6,435,466 B1 8/2002 Adams
6,436,007 B1 8/2002 Eschenbach
6,436,008 B1 8/2002 Skowronski et al.
6,436,013 B1 8/2002 Krull
6,440,013 B1 8/2002 Brown
6,440,042 B2 8/2002 Eschenbach
6,440,045 B1 8/2002 Gaston
6,443,521 B1 9/2002 Nye et al.
6,443,875 B1 9/2002 Golen, Jr. et al.
6,443,877 B1 9/2002 Hoecht
6,443,878 B1 9/2002 Webber
6,447,424 B1 9/2002 Ashby et al.
6,447,430 B1 9/2002 Webb et al.
6,447,432 B1 9/2002 Krull
6,450,284 B1 9/2002 Sakyo et al.
6,450,922 B1 9/2002 Henderson et al.
6,450,923 B1 9/2002 Vatti
6,450,925 B1 9/2002 Kuo
6,450,928 B1 9/2002 Larkins, Jr.
6,454,050 B2 9/2002 Gibson et al.
6,454,679 B1 9/2002 Radow
6,454,682 B1 9/2002 Kuo
6,455,960 B1 9/2002 Trago et al.
6,458,060 B1 10/2002 Watterson et al.
6,458,061 B2 10/2002 Simonson
6,461,275 B1 10/2002 Wang et al.
6,461,279 B1 10/2002 Kuo
6,461,284 B1 10/2002 Francavilla
6,466,460 B1 10/2002 Rein et al.
6,468,189 B2 10/2002 Alessandri
6,471,622 B1 10/2002 Hammer et al.
6,471,624 B1 10/2002 Voris
6,474,193 B1 11/2002 Farney
6,475,121 B2 11/2002 Wang
6,475,122 B2 11/2002 Wu
6,478,721 B1 11/2002 Hunter
6,482,128 B1 11/2002 Michalow
6,482,130 B1 11/2002 Pasero et al.
6,482,132 B2 11/2002 Eschenbach
6,482,134 B1 11/2002 Rasmussen
6,482,139 B1 11/2002 Haag
6,485,397 B1 11/2002 Manderbacka
6,488,020 B1 12/2002 Rosas-Magallan
6,488,599 B2 12/2002 Nye
6,488,612 B2 12/2002 Sechrest et al.
6,491,268 B1 12/2002 Channer et al.
6,491,609 B2 12/2002 Webber
6,491,610 B1 12/2002 Henn
6,494,814 B1 12/2002 Wang
6,494,817 B2 12/2002 Lake
6,500,097 B1 12/2002 Hall
6,500,101 B1 12/2002 Chen
6,500,102 B1 12/2002 Domenge
6,503,173 B2 1/2003 Clem
6,505,503 B1 1/2003 Teresi et al.
6,506,142 B2 1/2003 Itoh et al.
6,510,760 B2 1/2003 Matsuo
6,513,669 B2 2/2003 Ozawa et al.
6,514,180 B1 2/2003 Rawls
6,515,182 B2 2/2003 Hosokawa et al.
6,520,531 B1 2/2003 Gien
6,520,891 B1 2/2003 Stephens, Jr.
6,524,226 B2 2/2003 Kushner
6,527,674 B1 3/2003 Clem
6,527,678 B1 * 3/2003 Wang ..... A63B 22/0235 482/51
6,527,683 B2 3/2003 Tolles
6,527,685 B2 3/2003 Endelman et al.
6,527,796 B1 3/2003 Magovern
6,530,864 B1 3/2003 Parks
6,533,707 B2 3/2003 Wang
6,537,184 B2 3/2003 Kim
6,537,185 B1 3/2003 Hur
6,539,931 B2 4/2003 Trajkovic et al.
6,540,650 B1 4/2003 Krull
6,540,651 B1 4/2003 Aberton et al.
6,543,247 B2 4/2003 Strauss
6,544,146 B1 4/2003 Stearns et al.
6,547,701 B1 4/2003 Eschenbach
6,547,702 B1 4/2003 Heidecke
6,551,217 B2 4/2003 Kaganovsky
6,551,218 B2 4/2003 Goh
6,551,220 B1 4/2003 Schroeder
6,551,223 B2 4/2003 Cheng
6,551,226 B1 4/2003 Webber et al.
6,554,749 B2 4/2003 Iund et al.
6,558,300 B2 5/2003 Deola
6,558,301 B1 5/2003 Jackson
6,558,302 B2 5/2003 Cluff
6,561,955 B1 5/2003 Dreissigacker et al.
6,561,956 B1 5/2003 Allison
6,561,960 B2 5/2003 Webber
6,563,489 B1 5/2003 Latypov et al.
6,569,061 B2 5/2003 Stearns et al.
6,569,062 B2 5/2003 Wang
6,572,511 B1 6/2003 Volpe
6,572,512 B2 6/2003 Anderson et al.
6,572,513 B1 6/2003 Whan-Tong et al.
6,575,878 B1 6/2003 Choy
6,575,885 B1 6/2003 Weck et al.
6,579,210 B1 6/2003 Stearns et al.
6,579,213 B1 6/2003 Webber et al.
6,579,214 B2 6/2003 Crump
6,582,342 B2 6/2003 Kaufman
6,582,344 B2 6/2003 Tang
6,582,345 B2 6/2003 Roy
6,585,624 B1 7/2003 Chen
6,585,626 B2 7/2003 McBride
6,589,138 B2 7/2003 Dyer et al.
6,592,498 B1 7/2003 Trainor
6,592,499 B2 7/2003 Parker
6,592,502 B1 7/2003 Phillips
6,595,905 B2 7/2003 McBride
6,599,223 B2 7/2003 Wang
6,601,016 B1 7/2003 Brown et al.
6,601,358 B2 8/2003 Panatta
6,601,825 B2 8/2003 Bressner et al.
6,604,008 B2 8/2003 Chudley et al.
6,605,020 B1 8/2003 Huang
6,605,024 B2 8/2003 Stearns
6,607,472 B2 8/2003 Toole
6,609,478 B2 8/2003 Del Valle
6,610,063 B2 8/2003 Kumar et al.

(56) References Cited

U.S. PATENT DOCUMENTS 6,612,170 B2 9/2003 Brown
6,612,969 B2 9/2003 Eschenbach
6,612,971 B1 9/2003 Morris
6,619,681 B2 9/2003 Gutierrez
6,620,079 B2 9/2003 Kuo
6,623,407 B2 9/2003 Novak
6,623,409 B1 9/2003 Abelbeck
6,626,799 B2 9/2003 Watterson et al.
6,626,802 B1 9/2003 Rodgers, Jr.
6,626,803 B1 9/2003 Oglesby et al.
6,629,902 B2 10/2003 Murphy et al.
6,629,908 B2 10/2003 Hamady
6,629,909 B1 10/2003 Stearns et al.
6,629,910 B1 10/2003 Krull
6,632,160 B2 10/2003 LaFond et al.
6,632,161 B1 10/2003 Nir
6,634,996 B2 10/2003 Jacobsen
6,634,997 B2 10/2003 Breibart et al.
6,634,998 B2 10/2003 Siaperas
6,637,811 B2 10/2003 Zheng
6,637,818 B2 10/2003 Williams
6,645,125 B1 11/2003 Stearns et al.
6,645,126 B1 11/2003 Martin et al.
6,645,129 B2 11/2003 Eschenbach
6,645,130 B2 11/2003 Webber
6,648,800 B2 11/2003 Stearns et al.
6,648,801 B2 11/2003 Stearns et al.
6,648,802 B2 11/2003 Ware
6,652,419 B1 11/2003 Rota
6,652,424 B2 11/2003 Dalebout
6,652,425 B1 11/2003 Martin et al.
6,652,426 B2 11/2003 Carter
6,652,429 B2 11/2003 Bushnell
6,652,431 B1 11/2003 Mattox
6,652,432 B2 11/2003 Smith
6,656,093 B2 12/2003 Chen
6,660,949 B2 12/2003 Kamino et al.
6,661,136 B1 12/2003 Lee
6,662,651 B1 12/2003 Roth
6,663,127 B2 12/2003 Miller
6,663,498 B2 12/2003 Stipan
6,663,500 B2 12/2003 Huang
6,666,796 B1 12/2003 MacCready, Jr.
6,666,800 B2 12/2003 Krull
6,666,801 B1 12/2003 Michalow
6,668,678 B1 12/2003 Baba et al.
6,669,600 B2 12/2003 Warner
6,669,606 B2 12/2003 Krull
6,669,607 B2 12/2003 Slawinski et al.
6,669,609 B2 12/2003 Gerschefske et al.
6,671,975 B2 1/2004 Hennessey
6,672,991 B2 1/2004 O'Malley
6,672,992 B1 1/2004 Lo et al.
6,672,994 B1 1/2004 Stearns et al.
6,676,530 B2 1/2004 Lochtefeld
6,676,572 B2 1/2004 Wang
6,676,573 B2 1/2004 Abelbeck et al.
6,676,577 B2 1/2004 Stearns
6,676,579 B1 1/2004 Lin
6,679,816 B1 1/2004 Krull
6,679,820 B2 1/2004 Barkus et al.
6,681,704 B1 1/2004 Brookhiser
6,681,728 B2 1/2004 Haghgooie
6,682,460 B2 1/2004 Lo
6,682,461 B2 1/2004 Wang
6,685,600 B1 2/2004 Ullman
6,685,601 B1 2/2004 Knapp
6,685,602 B2 2/2004 Colosky, Jr. et al.
6,685,607 B1 2/2004 Olson
6,689,019 B2 2/2004 Ohrt et al.
6,689,023 B2 2/2004 Baumler
6,689,025 B2 2/2004 Emick
6,691,839 B1 2/2004 El-Kassouf
6,692,415 B1 2/2004 Winston
6,692,417 B2 2/2004 Burrell
6,695,620 B1 2/2004 Huang
6,695,694 B2 2/2004 Ishikawa et al.
6,698,110 B1 3/2004 Robbins
6,699,146 B1 3/2004 Winter et al.
6,699,159 B2 3/2004 Rouse
6,699,161 B1 3/2004 Speas
6,699,162 B2 3/2004 Chen
6,702,719 B1 3/2004 Brown et al.
6,702,723 B2 3/2004 Landfair
6,702,726 B2 3/2004 Lin
6,705,974 B1 3/2004 Tardif
6,705,976 B1 3/2004 Piane, Jr.
6,705,977 B1 3/2004 Ziak
6,708,427 B2 3/2004 Sussmann et al.
6,711,789 B2 3/2004 Ping
6,712,737 B1 3/2004 Nusbaum
6,712,740 B2 3/2004 Simonson
6,716,142 B2 4/2004 Kuo
6,716,144 B1 4/2004 Shifferaw
6,719,667 B2 * 4/2004 Wong ..... A63B 22/02 482/54
6,719,669 B1 4/2004 Wang
6,719,672 B1 4/2004 Ellis et al.
6,719,674 B2 4/2004 Krull
6,723,413 B2 4/2004 Walters
6,726,600 B2 4/2004 Miller
6,726,601 B1 4/2004 Beutel
6,726,602 B2 4/2004 Chang
6,730,002 B2 5/2004 Hald et al.
6,733,423 B1 5/2004 Chang
6,733,424 B2 5/2004 Krull
6,736,360 B1 5/2004 Buczek
6,736,759 B1 5/2004 Stubbs et al.
6,736,765 B2 5/2004 Wallace et al.
6,736,766 B1 5/2004 Gallant
6,738,274 B2 5/2004 Prasad et al.
6,740,009 B1 5/2004 Hall
6,741,052 B2 5/2004 Fitzgibbon
6,743,153 B2 6/2004 Watterson et al.
6,746,370 B1 6/2004 Fleming et al.
6,746,371 B1 6/2004 Brown et al.
6,746,380 B2 6/2004 Lien et al.
6,746,381 B2 6/2004 Krull
6,747,427 B1 6/2004 Carson
6,749,537 B1 6/2004 Hickman
6,749,540 B1 6/2004 Pasero et al.
6,749,542 B2 6/2004 Wu
6,749,547 B2 6/2004 Krull
6,752,745 B1 6/2004 Davis
6,758,790 B1 7/2004 Ellis
6,758,791 B1 7/2004 Kuo
6,758,792 B1 7/2004 Chang
6,761,387 B2 7/2004 Sloss
6,761,667 B1 7/2004 Cutler et al.
6,761,672 B1 7/2004 Williams
6,764,429 B1 7/2004 Michalow
6,764,430 B1 7/2004 Fencel
6,764,431 B2 7/2004 Yoss
6,765,726 B2 7/2004 French et al.
6,767,314 B2 7/2004 Thompson
6,770,014 B2 8/2004 Amore
6,770,015 B2 8/2004 Simonson
6,776,740 B1 8/2004 Anderson et al.
6,778,938 B1 8/2004 Ng et al.
6,783,482 B2 8/2004 Oglesby et al.
6,786,821 B2 9/2004 Nobe et al.
6,786,847 B1 9/2004 Morgan et al.
6,786,848 B2 9/2004 Yamashita et al.
6,786,850 B2 9/2004 Nizamuddin
6,786,852 B2 9/2004 Watterson et al.
6,790,162 B1 9/2004 Ellis et al.
6,790,163 B1 9/2004 Van De Laarschot
6,793,607 B2 9/2004 Neil
6,793,609 B1 9/2004 Fan
6,796,159 B2 9/2004 Kelm et al.
6,796,925 B2 9/2004 Martinez et al.
6,796,927 B2 9/2004 Toyama
6,802,800 B1 10/2004 Hobson
6,808,458 B1 10/2004 Jung

(56) References Cited

U.S. PATENT DOCUMENTS

| | | | |
|---|---|---|---|
| 6,808,475 | B2 | 10/2004 | Kehrbaum |
| 6,811,519 | B2 | 11/2004 | Kuo |
| 6,811,520 | B2 | 11/2004 | Wu |
| 6,817,117 | B1 | 11/2004 | Campbell |
| 6,817,968 | B2 | 11/2004 | Galbraith et al. |
| 6,821,230 | B2 | 11/2004 | Dalebout et al. |
| 6,824,210 | B2 | 11/2004 | Zheng |
| 6,824,502 | B1 | 11/2004 | Huang |
| 6,827,822 | B2 | 12/2004 | Tao et al. |
| 6,830,540 | B2 | 12/2004 | Watterson et al. |
| 6,830,541 | B2 | 12/2004 | Wu |
| 6,835,166 | B1 | 12/2004 | Stearns et al. |
| 6,837,829 | B2 | 1/2005 | Eschenbach |
| 6,837,830 | B2 | 1/2005 | Eldridge |
| 6,837,838 | B2 | 1/2005 | List |
| 6,840,892 | B1 | 1/2005 | Wu |
| 6,842,928 | B2 | 1/2005 | Yang et al. |
| 6,843,732 | B1 | 1/2005 | Huang |
| 6,846,270 | B1 | 1/2005 | Etnyre |
| 6,846,272 | B2 | 1/2005 | Rosenow et al. |
| 6,849,032 | B2 | 2/2005 | Chu |
| 6,852,068 | B2 | 2/2005 | Ogawa |
| 6,855,093 | B2 | 2/2005 | Anderson et al. |
| 6,855,097 | B2 | 2/2005 | Krull |
| 6,857,993 | B2 | 2/2005 | Yeh |
| 6,860,131 | B2 | 3/2005 | Armstrong et al. |
| 6,860,836 | B1 | 3/2005 | Wu |
| 6,860,839 | B1 | 3/2005 | Dice |
| 6,860,841 | B1 | 3/2005 | Mortorano |
| 6,872,168 | B2 | 3/2005 | Wang et al. |
| 6,872,173 | B2 | 3/2005 | Krull |
| 6,872,175 | B2 | 3/2005 | Lin |
| 6,875,157 | B1 | 4/2005 | Wang |
| 6,875,160 | B2 | 4/2005 | Watterson et al. |
| 6,878,101 | B2 | 4/2005 | Colley |
| 6,880,487 | B2 | 4/2005 | Reinkensmeyer et al. |
| 6,881,176 | B2 | 4/2005 | Oishi et al. |
| 6,886,645 | B2 | 5/2005 | Bise et al. |
| 6,887,185 | B1 | 5/2005 | Kuo |
| 6,887,190 | B1 | 5/2005 | Azari |
| 6,893,381 | B2 | 5/2005 | Slawinski |
| 6,893,383 | B1 | 5/2005 | Chang et al. |
| 6,896,342 | B1 | 5/2005 | Cheng |
| 6,896,645 | B1 | 5/2005 | Krull |
| 6,899,657 | B2 | 5/2005 | Chuang |
| 6,899,659 | B2 | 5/2005 | Anderson et al. |
| 6,899,661 | B1 | 5/2005 | Krull |
| 6,902,513 | B1 | 6/2005 | Mcclure |
| 6,902,515 | B2 | 6/2005 | Howell et al. |
| 6,902,516 | B2 | 6/2005 | Krull |
| 6,905,446 | B2 | 6/2005 | Greenland |
| 6,908,416 | B2 | 6/2005 | Mercado et al. |
| 6,908,417 | B2 | 6/2005 | Jackson |
| 6,910,992 | B2 | 6/2005 | Arguilez |
| 6,913,562 | B2 | 7/2005 | Chen |
| 6,913,563 | B2 | 7/2005 | Chen |
| 6,916,278 | B2 | 7/2005 | Webber |
| 6,918,858 | B2 | 7/2005 | Watterson et al. |
| 6,918,859 | B1 | 7/2005 | Yeh |
| 6,918,860 | B1 | 7/2005 | Nusbaum |
| 6,918,861 | B2 | 7/2005 | Liao et al. |
| 6,921,354 | B1 | 7/2005 | Shifferaw |
| 6,921,355 | B2 | 7/2005 | Campanaro et al. |
| 6,923,746 | B1 | 8/2005 | Skowronski et al. |
| 6,923,747 | B1 | 8/2005 | Chu |
| 6,923,748 | B1 | 8/2005 | Mauz |
| 6,923,749 | B1 | 8/2005 | Smith |
| 6,926,644 | B2 | 8/2005 | Chen |
| 6,926,646 | B1 | 8/2005 | Nguyen |
| 6,926,649 | B2 | 8/2005 | Slawinski |
| 6,929,589 | B1 | 8/2005 | Bruggemann et al. |
| 6,932,745 | B1 | 8/2005 | Ellis |
| 6,939,271 | B1 | 9/2005 | Whan-Tong et al. |
| 6,941,620 | B1 | 9/2005 | Hinds |
| 6,944,294 | B2 | 9/2005 | Tsay |
| 6,945,912 | B2 | 9/2005 | Levi |
| 6,945,916 | B2 | 9/2005 | Schroeder |
| 6,945,917 | B1 | 9/2005 | Baatz |
| 6,949,053 | B1 | 9/2005 | Stearns |
| 6,949,054 | B1 | 9/2005 | Stearns |
| 6,953,418 | B1 | 10/2005 | Chen |
| 6,960,156 | B2 | 11/2005 | Smith |
| 6,964,632 | B1 | 11/2005 | Ko |
| 6,966,872 | B2 | 11/2005 | Eschenbach |
| 6,971,974 | B2 | 12/2005 | Bowman |
| 6,971,975 | B2 | 12/2005 | Croft |
| 6,971,978 | B2 | 12/2005 | Hyder |
| 6,974,404 | B1 | 12/2005 | Watterson et al. |
| 6,974,405 | B2 | 12/2005 | Krull |
| 6,976,698 | B2 | 12/2005 | Kuiken |
| 6,976,941 | B2 | 12/2005 | Britt |
| 6,976,943 | B1 | 12/2005 | Hsiung |
| 6,979,283 | B2 | 12/2005 | Pan |
| 6,991,588 | B1 | 1/2006 | Adams |
| 6,994,306 | B1 | 2/2006 | Sweere et al. |
| 6,994,657 | B1 | 2/2006 | Eschenbach |
| 6,994,683 | B1 | 2/2006 | Starr |
| 6,997,852 | B2 | 2/2006 | Watterson et al. |
| 6,997,856 | B1 | 2/2006 | Krull |
| 7,001,288 | B2 | 2/2006 | Harrell |
| 7,003,122 | B2 | 2/2006 | Chen |
| 7,004,271 | B1 | 2/2006 | Kamen et al. |
| 7,004,887 | B2 | 2/2006 | Pan et al. |
| 7,004,888 | B1 | 2/2006 | Weng |
| 7,008,356 | B2 | 3/2006 | Hung |
| 7,008,359 | B2 | 3/2006 | Fan et al. |
| 7,011,326 | B1 | 3/2006 | Schroeder et al. |
| 7,011,607 | B2 | 3/2006 | Kolda et al. |
| 7,011,609 | B1 | 3/2006 | Kuo |
| 7,011,610 | B2 | 3/2006 | Wawrzyniak |
| 7,011,611 | B1 | 3/2006 | Ripley |
| 7,014,598 | B2 | 3/2006 | Fenelon et al. |
| 7,014,599 | B2 | 3/2006 | Ashley |
| 7,022,048 | B1 | 4/2006 | Fernandez |
| 7,022,049 | B2 | 4/2006 | Ryan et al. |
| 7,022,051 | B2 | 4/2006 | Ota |
| 7,029,425 | B2 | 4/2006 | Krull |
| 7,032,870 | B2 | 4/2006 | Sweere et al. |
| 7,033,176 | B2 | 4/2006 | Feldman |
| 7,033,306 | B2 | 4/2006 | Graber |
| 7,037,246 | B2 | 5/2006 | Kim |
| 7,039,263 | B2 | 5/2006 | Towle |
| 7,041,034 | B1 | 5/2006 | Stearns et al. |
| 7,041,038 | B2 | 5/2006 | Smith |
| 7,041,041 | B1 | 5/2006 | Evans |
| 7,044,066 | B1 | 5/2006 | Miller |
| 7,044,891 | B1 | 5/2006 | Rivera |
| 7,044,897 | B2 | 5/2006 | Myers et al. |
| 7,048,638 | B2 | 5/2006 | Novotny |
| 7,048,677 | B2 | 5/2006 | Mackert |
| 7,052,426 | B2 | 5/2006 | Battat et al. |
| 7,052,440 | B2 | 5/2006 | Pyles et al. |
| 7,052,444 | B2 | 5/2006 | Webber |
| 7,052,446 | B2 | 5/2006 | Morris et al. |
| 7,055,899 | B2 | 6/2006 | Zhurong et al. |
| 7,060,005 | B2 | 6/2006 | Carlsen et al. |
| 7,060,006 | B1 | 6/2006 | Watterson et al. |
| 7,060,011 | B1 | 6/2006 | Krull |
| 7,060,012 | B2 | 6/2006 | Howell et al. |
| 7,066,867 | B2 | 6/2006 | Krull |
| 7,070,542 | B2 | 7/2006 | Reyes et al. |
| 7,070,545 | B2 | 7/2006 | Lull et al. |
| 7,073,417 | B2 | 7/2006 | Beauchamp |
| 7,073,852 | B1 | 7/2006 | Zheng |
| 7,077,788 | B2 | 7/2006 | Chang |
| 7,077,791 | B2 | 7/2006 | Krull |
| 7,081,073 | B1 | 7/2006 | Smith |
| 7,082,703 | B2 | 8/2006 | Greene et al. |
| 7,083,536 | B2 | 8/2006 | Lu et al. |
| 7,083,549 | B1 | 8/2006 | Fan |
| 7,083,554 | B1 | 8/2006 | Lo Presti |
| 7,086,994 | B2 | 8/2006 | Turak et al. |
| 7,086,999 | B2 | 8/2006 | Jeneve et al. |
| 7,087,000 | B1 | 8/2006 | Walker |

(56) References Cited

U.S. PATENT DOCUMENTS

| | | | |
|---|---|---|---|
| 7,087,005 | B2 | 8/2006 | Rouillard |
| 7,090,621 | B2 | 8/2006 | Loane |
| 7,090,622 | B2 | 8/2006 | Hetrick |
| 7,090,625 | B2 | 8/2006 | Chermack |
| 7,094,183 | B2 | 8/2006 | Hsieh |
| 7,094,184 | B1 | 8/2006 | Chen et al. |
| 7,094,185 | B2 | 8/2006 | Greenland |
| 7,097,591 | B2 | 8/2006 | Moon |
| 7,097,593 | B2 | 8/2006 | Chang |
| 7,097,601 | B1 | 8/2006 | Ronnow |
| 7,100,517 | B1 | 9/2006 | Godwin |
| 7,101,124 | B2 | 9/2006 | Keightley |
| 7,101,319 | B1 | 9/2006 | Potts |
| 7,101,322 | B2 | 9/2006 | Carle |
| 7,101,330 | B2 | 9/2006 | Elbaz et al. |
| 7,104,926 | B2 | 9/2006 | Carlson |
| 7,104,937 | B2 | 9/2006 | Arbuckle |
| 7,108,636 | B1 | 9/2006 | Garcia |
| 7,108,641 | B2 | 9/2006 | Pertegaz-Esteban |
| 7,108,659 | B2 | 9/2006 | Ross et al. |
| 7,111,526 | B1 | 9/2006 | Flojo |
| 7,112,163 | B2 | 9/2006 | Krull |
| 7,113,166 | B1 | 9/2006 | Rosenberg et al. |
| 7,115,073 | B2 | 10/2006 | Nizamuddin |
| 7,115,078 | B1 | 10/2006 | Kalember et al. |
| 7,115,080 | B2 | 10/2006 | Cockrill, Jr. et al. |
| 7,118,517 | B1 | 10/2006 | Hale |
| 7,121,980 | B2 | 10/2006 | Chen |
| 7,125,371 | B2 | 10/2006 | Henderson |
| 7,125,373 | B1 | 10/2006 | Garza |
| 7,128,696 | B1 | 10/2006 | Krull |
| 7,128,697 | B1 | 10/2006 | Krull |
| 7,128,701 | B1 | 10/2006 | Ketcham |
| 7,132,939 | B2 | 11/2006 | Tybdall et al. |
| 7,134,987 | B2 | 11/2006 | Goldstein |
| 7,137,644 | B2 | 11/2006 | Kimberley |
| 7,137,931 | B2 | 11/2006 | Liu |
| 7,137,932 | B2 | 11/2006 | Doudiet |
| 7,137,935 | B2 | 11/2006 | Clarke |
| 7,137,936 | B1 | 11/2006 | Shaw |
| 7,140,626 | B1 | 11/2006 | Keay |
| 7,141,008 | B2 | 11/2006 | Krull et al. |
| 7,150,168 | B1 | 12/2006 | Kuo |
| 7,153,248 | B2 | 12/2006 | Chen |
| 7,156,776 | B2 | 1/2007 | Maser |
| 7,156,782 | B1 | 1/2007 | Krull |
| 7,156,783 | B2 | 1/2007 | Chen |
| 7,163,493 | B1 | 1/2007 | Kuo |
| 7,163,498 | B1 | 1/2007 | Abelbeck |
| 7,163,500 | B2 | 1/2007 | Endelman et al. |
| 7,166,062 | B1 | 1/2007 | Watterson et al. |
| 7,166,064 | B2 | 1/2007 | Watterson et al. |
| 7,166,066 | B2 | 1/2007 | Webber |
| 7,166,067 | B2 | 1/2007 | Talish et al. |
| 7,168,668 | B2 | 1/2007 | Coyle |
| 7,169,087 | B2 | 1/2007 | Ercanbrack et al. |
| 7,169,088 | B2 | 1/2007 | Rodgers, Jr. |
| 7,169,093 | B2 | 1/2007 | Simonson et al. |
| 7,172,531 | B2 | 2/2007 | Rodgers, Jr. |
| 7,172,536 | B2 | 2/2007 | Liu |
| 7,172,538 | B2 | 2/2007 | Keiser |
| 7,175,193 | B2 | 2/2007 | Wu |
| 7,178,637 | B2 | 2/2007 | Asano et al. |
| 7,179,207 | B2 | 2/2007 | Gerschefske |
| 7,179,208 | B1 | 2/2007 | Nalley |
| 7,179,209 | B2 | 2/2007 | Sechrest et al. |
| 7,179,212 | B2 | 2/2007 | Hsiung et al. |
| 7,186,189 | B2 | 3/2007 | Huang |
| 7,192,388 | B2 | 3/2007 | Dalebout et al. |
| 7,192,389 | B2 | 3/2007 | Allison |
| 7,195,568 | B2 | 3/2007 | Huang |
| 7,197,029 | B1 | 3/2007 | Osterhout et al. |
| 7,201,705 | B2 | 4/2007 | Rodgers, Jr. |
| 7,201,707 | B1 | 4/2007 | Moon |
| 7,204,328 | B2 | 4/2007 | LoPresti |
| 7,204,790 | B2 | 4/2007 | Sleamaker |
| 7,207,929 | B2 | 4/2007 | Hamilton |
| 7,207,930 | B2 | 4/2007 | Bonutti |
| 7,211,029 | B2 | 5/2007 | Kau |
| 7,211,030 | B1 | 5/2007 | Cao |
| 7,214,170 | B2 | 5/2007 | Sumners |
| 7,217,224 | B2 | 5/2007 | Thomas |
| 7,217,225 | B2 | 5/2007 | Husted et al. |
| 7,220,219 | B2 | 5/2007 | Papadopoulos et al. |
| 7,220,221 | B2 | 5/2007 | Mosimann et al. |
| 7,223,209 | B2 | 5/2007 | Lee |
| 7,223,213 | B2 | 5/2007 | Golesh |
| 7,223,214 | B2 | 5/2007 | Chen |
| 7,223,216 | B1 | 5/2007 | McBride |
| 7,225,694 | B2 | 6/2007 | Said |
| 7,226,402 | B1 | 6/2007 | Joya |
| 7,229,391 | B2 | 6/2007 | Francis |
| 7,232,404 | B2 | 6/2007 | Nelson |
| 7,235,942 | B2 | 6/2007 | Nagaoka et al. |
| 7,238,143 | B1 | 7/2007 | Sokolovos |
| 7,238,147 | B2 | 7/2007 | Mills et al. |
| 7,244,217 | B2 | 7/2007 | Rodgers, Jr. |
| 7,247,128 | B2 | 7/2007 | Oga |
| 7,249,540 | B1 | 7/2007 | Hacker et al. |
| 7,250,021 | B2 | 7/2007 | Leight |
| 7,250,022 | B2 | 7/2007 | Dalebout |
| 7,255,665 | B2 | 8/2007 | Ish, III |
| 7,255,666 | B2 | 8/2007 | Cardenas |
| 7,257,468 | B1 | 8/2007 | Costa et al. |
| 7,258,651 | B2 | 8/2007 | Clarke |
| 7,261,678 | B2 | 8/2007 | Crawford et al. |
| 7,264,554 | B2 | 9/2007 | Bentley |
| 7,264,578 | B1 | 9/2007 | Krull |
| 7,269,038 | B2 | 9/2007 | Shekhawat |
| 7,276,017 | B2 | 10/2007 | Chen |
| 7,278,934 | B2 | 10/2007 | McBride et al. |
| 7,278,955 | B2 | 10/2007 | Giannelli et al. |
| 7,278,958 | B2 | 10/2007 | Morgan |
| 7,278,966 | B2 | 10/2007 | Hjelt et al. |
| 7,279,868 | B2 | 10/2007 | Lanni |
| 7,282,016 | B2 | 10/2007 | Simonson |
| 7,284,466 | B1 | 10/2007 | Ho |
| 7,285,075 | B2 | 10/2007 | Cutler et al. |
| 7,287,770 | B2 | 10/2007 | Drabant et al. |
| 7,288,053 | B2 | 10/2007 | Endelman et al. |
| 7,290,760 | B1 | 11/2007 | Lindsay |
| 7,291,096 | B2 | 11/2007 | Ho |
| 7,291,098 | B1 | 11/2007 | Krull |
| 7,292,151 | B2 | 11/2007 | Ferguson |
| 7,293,510 | B1 | 11/2007 | Siao et al. |
| 7,294,094 | B1 | 11/2007 | Howle |
| 7,294,095 | B2 | 11/2007 | Charnitski |
| 7,294,100 | B2 | 11/2007 | Bull |
| 7,299,720 | B1 | 11/2007 | Schultz et al. |
| 7,300,390 | B1 | 11/2007 | Krull |
| 7,300,392 | B1 | 11/2007 | Curran |
| 7,303,508 | B2 | 12/2007 | Toyama et al. |
| 7,303,510 | B2 | 12/2007 | Gebhardt |
| 7,309,303 | B1 | 12/2007 | Proctor |
| 7,311,640 | B2 | 12/2007 | Baatz |
| 7,311,644 | B2 | 12/2007 | Hale |
| 7,314,438 | B1 | 1/2008 | Clark et al. |
| 7,316,633 | B2 | 1/2008 | Liao et al. |
| 7,318,810 | B1 | 1/2008 | Benson |
| 7,319,457 | B2 | 1/2008 | Lin et al. |
| 7,322,219 | B2 | 1/2008 | Armstrong et al. |
| 7,322,906 | B2 | 1/2008 | Webber |
| 7,322,907 | B2 | 1/2008 | Bowser |
| 7,322,909 | B1 | 1/2008 | Loccarini |
| 7,331,911 | B2 | 2/2008 | Webber et al. |
| 7,334,350 | B2 | 2/2008 | Ellis, III |
| 7,335,139 | B2 | 2/2008 | Bartholomew et al. |
| 7,335,140 | B2 | 2/2008 | Webber et al. |
| 7,335,141 | B2 | 2/2008 | Piane, Jr. |
| 7,335,147 | B2 | 2/2008 | Jones |
| 7,341,545 | B2 | 3/2008 | Cao |
| 7,344,481 | B2 | 3/2008 | Watterson et al. |
| 7,344,488 | B2 | 3/2008 | Weck et al. |
| 7,346,935 | B1 | 3/2008 | Patterson |

(56) References Cited

U.S. PATENT DOCUMENTS

| | | | |
|---|---|---|---|
| 7,347,806 | B2 | 3/2008 | Nakano et al. |
| 7,351,187 | B2 | 4/2008 | Seliber |
| 7,352,365 | B2 | 4/2008 | Trachte |
| 7,354,380 | B2 | 4/2008 | Volpe, Jr. |
| 7,357,758 | B2 | 4/2008 | Polk, III |
| 7,359,121 | B2 | 4/2008 | French et al. |
| 7,361,123 | B1 | 4/2008 | Krull |
| 7,361,125 | B2 | 4/2008 | Webber et al. |
| 7,361,127 | B2 | 4/2008 | Tremayne |
| 7,364,538 | B2 | 4/2008 | Aucamp |
| 7,366,921 | B2 | 4/2008 | Ranganathan |
| 7,367,926 | B2 | 5/2008 | Clark |
| 7,367,927 | B2 | 5/2008 | Krull |
| 7,369,121 | B2 | 5/2008 | Lane |
| 7,370,498 | B1 | 5/2008 | Miao |
| 7,374,519 | B2 | 5/2008 | Naidus |
| 7,377,881 | B2 | 5/2008 | Moon |
| 7,377,886 | B2 | 5/2008 | Wu |
| 7,384,013 | B2 | 6/2008 | Yen |
| 7,384,381 | B2 | 6/2008 | Webber et al. |
| 7,387,597 | B2 | 6/2008 | Krull |
| 7,387,867 | B2 | 6/2008 | Hasegawa et al. |
| 7,393,308 | B1 | 7/2008 | Huang |
| 7,396,319 | B1 | 7/2008 | Ellis |
| 7,402,145 | B1 | 7/2008 | Woggon |
| 7,413,056 | B2 | 8/2008 | Gonzi et al. |
| 7,413,065 | B2 | 8/2008 | Gauthier |
| 7,413,532 | B1 | 8/2008 | Monsrud et al. |
| 7,413,533 | B2 | 8/2008 | Lin |
| 7,425,189 | B1 | 9/2008 | Eschenbach |
| 7,428,760 | B2 | 9/2008 | McCrimmon |
| 7,429,235 | B2 | 9/2008 | Lin |
| 7,429,236 | B2 | 9/2008 | Dalebout et al. |
| 7,432,677 | B2 | 10/2008 | Heydt et al. |
| 7,435,202 | B2 | 10/2008 | Daly et al. |
| 7,435,205 | B2 | 10/2008 | Reyes et al. |
| 7,438,673 | B1 | 10/2008 | Jones |
| 7,448,823 | B2 | 11/2008 | Silva |
| 7,455,626 | B2 | 11/2008 | Trevino et al. |
| 7,455,628 | B1 | 11/2008 | Stearns |
| 7,455,633 | B2 | 11/2008 | Brown et al. |
| 7,462,141 | B1 | 12/2008 | Raboin et al. |
| 7,468,025 | B2 | 12/2008 | Hauser et al. |
| 7,470,234 | B1 | 12/2008 | Elhag et al. |
| 7,473,211 | B2 | 1/2009 | Lee |
| 7,475,613 | B2 | 1/2009 | Bailey |
| 7,475,641 | B2 | 1/2009 | Jin |
| 7,475,900 | B2 | 1/2009 | Cheng |
| 7,476,182 | B2 | 1/2009 | Denisco |
| 7,476,186 | B1 | 1/2009 | Steffee |
| 7,478,794 | B1 | 1/2009 | Gohlke et al. |
| 7,482,050 | B2 | 1/2009 | Olson |
| 7,485,077 | B2 | 2/2009 | Chen |
| 7,488,277 | B1 | 2/2009 | Knapp |
| 7,491,155 | B2 | 2/2009 | Fenelon et al. |
| 7,491,157 | B1 | 2/2009 | Lin |
| 7,491,159 | B2 | 2/2009 | Patterson |
| 7,494,450 | B2 | 2/2009 | Solomon |
| 7,497,784 | B2 | 3/2009 | Henry |
| 7,497,814 | B1 | 3/2009 | Krull |
| 7,503,883 | B2 | 3/2009 | Madden |
| 7,507,186 | B2 | 3/2009 | Stearns |
| 7,507,187 | B2 | 3/2009 | Dyer et al. |
| 7,507,189 | B2 | 3/2009 | Krull |
| 7,510,511 | B2 | 3/2009 | Von Detten |
| 7,517,303 | B2 | 4/2009 | Crawford et al. |
| 7,517,304 | B1 | 4/2009 | Swanson et al. |
| 7,520,840 | B2 | 4/2009 | Shifferaw |
| 7,520,845 | B2 | 4/2009 | Towley, III et al. |
| 7,524,272 | B2 | 4/2009 | Bruck et al. |
| 7,525,293 | B1 | 4/2009 | Notohamiprodjo et al. |
| 7,534,200 | B1 | 5/2009 | Martinez |
| 7,537,546 | B2 | 5/2009 | Watterson et al. |
| 7,537,549 | B2 | 5/2009 | Nelson et al. |
| 7,537,550 | B1 | 5/2009 | Krull |
| 7,537,551 | B2 | 5/2009 | Steffee |
| 7,537,552 | B2 | 5/2009 | Dalebout et al. |
| 7,540,828 | B2 | 6/2009 | Watterson et al. |
| 7,540,829 | B1 | 6/2009 | Lin |
| 7,544,153 | B2 | 6/2009 | Trevino et al. |
| 7,549,949 | B2 | 6/2009 | Webber et al. |
| 7,553,260 | B2 | 6/2009 | Piaget et al. |
| 7,553,262 | B2 | 6/2009 | Piane, Jr. |
| 7,553,267 | B1 | 6/2009 | Hauser |
| 7,556,590 | B2 | 7/2009 | Watterson et al. |
| 7,556,591 | B2 | 7/2009 | Chuang |
| 7,559,879 | B2 | 7/2009 | Anderson et al. |
| 7,563,203 | B2 | 7/2009 | Dalebout et al. |
| 7,563,205 | B2 | 7/2009 | Alling |
| 7,563,208 | B1 | 7/2009 | Chen |
| 7,563,209 | B2 | 7/2009 | Webber et al. |
| 7,563,213 | B2 | 7/2009 | Grant |
| 7,563,214 | B2 | 7/2009 | Webber et al. |
| 7,569,000 | B2 | 8/2009 | Wang |
| 7,569,004 | B2 | 8/2009 | Kolomeir |
| 7,569,005 | B2 | 8/2009 | Geeting |
| 7,571,517 | B2 | 8/2009 | Smith et al. |
| 7,575,537 | B2 | 8/2009 | Ellis |
| 7,575,538 | B1 | 8/2009 | Clark |
| 7,578,771 | B1 | 8/2009 | Towley, III et al. |
| 7,578,772 | B2 | 8/2009 | Lippitt |
| 7,584,673 | B2 | 9/2009 | Shimizu |
| 7,585,251 | B2 | 9/2009 | Doody, Jr. et al. |
| 7,585,254 | B1 | 9/2009 | Vittone |
| 7,585,258 | B2 | 9/2009 | Watson et al. |
| 7,585,262 | B1 | 9/2009 | Vayntraub |
| 7,588,520 | B2 | 9/2009 | Nalley |
| 7,591,763 | B1 | 9/2009 | Fucci |
| 7,591,770 | B2 | 9/2009 | Stewart et al. |
| 7,591,773 | B2 | 9/2009 | Weir |
| 7,591,795 | B2 | 9/2009 | Whalen et al. |
| 7,594,877 | B2 | 9/2009 | Anderson et al. |
| 7,594,878 | B1 | 9/2009 | Joannou |
| 7,594,881 | B2 | 9/2009 | Shifferaw |
| 7,601,101 | B2 | 10/2009 | Jackson et al. |
| 7,601,105 | B1 | 10/2009 | Gipson, III et al. |
| 7,602,301 | B1 | 10/2009 | Stirling et al. |
| 7,604,571 | B2 | 10/2009 | Wilkins et al. |
| 7,604,572 | B2 | 10/2009 | Stanford |
| 7,604,573 | B2 | 10/2009 | Dalebout et al. |
| 7,604,576 | B2 | 10/2009 | Drechsler |
| 7,604,578 | B2 | 10/2009 | Liu |
| 7,608,015 | B2 | 10/2009 | Radow |
| 7,608,020 | B2 | 10/2009 | Mason |
| 7,608,021 | B1 | 10/2009 | Nalley |
| 7,608,023 | B2 | 10/2009 | Casagrande |
| 7,608,024 | B2 | 10/2009 | Sechrest et al. |
| 7,611,445 | B2 | 11/2009 | Brown et al. |
| 7,611,450 | B2 | 11/2009 | Mancini |
| 7,614,639 | B2 | 11/2009 | Tholkes et al. |
| 7,614,981 | B2 | 11/2009 | Cao |
| 7,614,984 | B1 | 11/2009 | Krull |
| 7,618,346 | B2 | 11/2009 | Crawford et al. |
| 7,621,847 | B2 | 11/2009 | Lamle |
| 7,621,850 | B2 | 11/2009 | Piaget et al. |
| 7,621,855 | B1 | 11/2009 | Krull |
| 7,621,856 | B1 | 11/2009 | Keith |
| 7,621,858 | B2 | 11/2009 | Sheron |
| 7,624,956 | B2 | 12/2009 | Steigert et al. |
| 7,624,967 | B1 | 12/2009 | Doebler et al. |
| 7,625,033 | B2 | 12/2009 | Michelau et al. |
| 7,625,314 | B2 | 12/2009 | Ungari |
| 7,625,321 | B2 | 12/2009 | Simonson et al. |
| 7,625,322 | B1 | 12/2009 | Krull |
| 7,625,323 | B1 | 12/2009 | Lin |
| 7,628,730 | B1 | 12/2009 | Watterson et al. |
| 7,628,732 | B1 | 12/2009 | Porszasz et al. |
| 7,628,737 | B2 | 12/2009 | Kowallis et al. |
| 7,628,743 | B1 | 12/2009 | Flentye et al. |
| 7,632,221 | B1 | 12/2009 | Kolander |
| 7,637,847 | B1 | 12/2009 | Hickman |
| 7,637,850 | B2 | 12/2009 | Lin |
| 7,639,520 | B1 | 12/2009 | Zansky et al. |
| 7,645,212 | B2 | 1/2010 | Ashby et al. |

(56) References Cited

U.S. PATENT DOCUMENTS

| | | | |
|---|---|---|---|
| 7,645,214 | B2 | 1/2010 | Lull |
| 7,645,218 | B2 | 1/2010 | Potok et al. |
| 7,645,221 | B1 | 1/2010 | Curry |
| 7,647,196 | B2 | 1/2010 | Kahn et al. |
| 7,648,446 | B2 | 1/2010 | Chiles et al. |
| 7,651,442 | B2 | 1/2010 | Carlson |
| 7,651,450 | B2 | 1/2010 | Wehrell |
| 7,654,229 | B2 | 2/2010 | Smith |
| 7,654,940 | B2 | 2/2010 | Webber et al. |
| 7,658,694 | B2 | 2/2010 | Ungari |
| 7,658,695 | B1 | 2/2010 | Amsbury et al. |
| 7,658,698 | B2 | 2/2010 | Pacheco et al. |
| 7,670,263 | B2 | 3/2010 | Ellis |
| 7,670,269 | B2 | 3/2010 | Webber et al. |
| 7,670,270 | B2 | 3/2010 | Alessandri et al. |
| 7,674,205 | B2 | 3/2010 | Dalebout et al. |
| 7,674,206 | B2 | 3/2010 | Jones |
| 7,674,216 | B1 | 3/2010 | Bolling |
| 7,677,518 | B2 | 3/2010 | Chouinard et al. |
| 7,682,286 | B2 | 3/2010 | Badarneh et al. |
| 7,682,287 | B1 | 3/2010 | Hsieh |
| 7,682,290 | B2 | 3/2010 | Liao et al. |
| 7,682,291 | B2 | 3/2010 | Gill et al. |
| 7,690,556 | B1 | 4/2010 | Kahn et al. |
| 7,691,042 | B2 | 4/2010 | Pandozy |
| 7,695,409 | B2 | 4/2010 | Helie et al. |
| 7,704,191 | B2 | 4/2010 | Smith et al. |
| 7,704,192 | B2 | 4/2010 | Dyer et al. |
| 7,704,195 | B2 | 4/2010 | Alessandri et al. |
| 7,708,668 | B2 | 5/2010 | Rodgers, Jr. |
| 7,708,672 | B2 | 5/2010 | Gibson et al. |
| 7,713,172 | B2 | 5/2010 | Watterson et al. |
| 7,713,177 | B2 | 5/2010 | Lo |
| 7,717,826 | B2 | 5/2010 | Cox et al. |
| 7,717,827 | B2 | 5/2010 | Kurunmäki et al. |
| 7,717,828 | B2 | 5/2010 | Simonson et al. |
| 7,717,830 | B1 | 5/2010 | Charniga et al. |
| 7,717,833 | B1 | 5/2010 | Nelson et al. |
| 7,722,503 | B1 | 5/2010 | Smith et al. |
| 7,722,509 | B2 | 5/2010 | Eder |
| 7,730,588 | B1 | 6/2010 | Bernier |
| 7,731,634 | B2 | 6/2010 | Stewart et al. |
| 7,736,272 | B2 | 6/2010 | Martens |
| 7,736,273 | B2 | 6/2010 | Cox et al. |
| 7,736,279 | B2 | 6/2010 | Dalebout et al. |
| 7,736,280 | B2 | 6/2010 | Weier et al. |
| 7,736,281 | B2 | 6/2010 | Corbalis et al. |
| 7,736,283 | B2 | 6/2010 | Webb |
| 7,740,563 | B2 | 6/2010 | Dalebout et al. |
| 7,740,568 | B2 | 6/2010 | Webb |
| 7,740,570 | B2 | 6/2010 | Winston |
| 7,745,716 | B1 | 6/2010 | Murphy |
| 7,749,137 | B2 | 7/2010 | Watt et al. |
| 7,749,140 | B1 | 7/2010 | Lindemeier et al. |
| 7,753,830 | B1 | 7/2010 | Marsh et al. |
| 7,753,861 | B1 | 7/2010 | Kahn et al. |
| 7,758,469 | B2 | 7/2010 | Dyer et al. |
| 7,762,932 | B2 | 7/2010 | Hetrick |
| 7,762,934 | B1 | 7/2010 | Munson, Jr. et al. |
| 7,762,935 | B2 | 7/2010 | Doble |
| 7,762,952 | B2 | 7/2010 | Lee et al. |
| 7,764,641 | B2 | 7/2010 | Pelton et al. |
| 7,766,797 | B2 | 8/2010 | Dalebout |
| 7,771,319 | B1 | 8/2010 | Lannon |
| 7,771,320 | B2 | 8/2010 | Riley et al. |
| 7,771,325 | B2 | 8/2010 | Baker |
| 7,771,329 | B2 | 8/2010 | Dalebout et al. |
| 7,775,128 | B2 | 8/2010 | Roessingh et al. |
| 7,775,936 | B2 | 8/2010 | Wilkinson |
| 7,775,943 | B2 | 8/2010 | Vittone |
| 7,775,945 | B2 | 8/2010 | Smith |
| 7,775,952 | B1 | 8/2010 | Curran et al. |
| 7,775,953 | B2 | 8/2010 | Wang |
| 7,780,578 | B2 | 8/2010 | Packham |
| 7,780,583 | B2 | 8/2010 | Brown |
| 7,780,585 | B1 | 8/2010 | Rivas |
| 7,789,800 | B1 | 9/2010 | Watterson et al. |
| 7,789,806 | B2 | 9/2010 | Yang |
| 7,794,363 | B2 | 9/2010 | Wang |
| 7,794,371 | B2 | 9/2010 | Webber et al. |
| 7,795,824 | B2 | 9/2010 | Shen et al. |
| 7,798,946 | B2 | 9/2010 | Dalebout et al. |
| 7,803,096 | B2 | 9/2010 | Mehta |
| 7,806,780 | B1 | 10/2010 | Plunkett |
| 7,806,805 | B2 | 10/2010 | Barufka et al. |
| 7,806,815 | B2 | 10/2010 | Fernandez |
| 7,811,202 | B2 | 10/2010 | Planke |
| 7,811,209 | B2 | 10/2010 | Crawford et al. |
| 7,811,213 | B2 | 10/2010 | Chen |
| 7,815,548 | B2 | 10/2010 | Barre et al. |
| 7,815,550 | B2 | 10/2010 | Watterson et al. |
| 7,815,552 | B2 | 10/2010 | Dibble et al. |
| 7,815,554 | B2 | 10/2010 | Gibson et al. |
| 7,819,784 | B1 | 10/2010 | Caswell et al. |
| 7,819,785 | B2 | 10/2010 | Maiaro et al. |
| 7,828,703 | B1 | 11/2010 | Boesch |
| 7,833,138 | B1 | 11/2010 | Fulks |
| 7,833,141 | B2 | 11/2010 | Kulka |
| 7,837,161 | B2 | 11/2010 | Chase |
| 7,837,595 | B2 | 11/2010 | Rice |
| 7,837,598 | B1 | 11/2010 | Boozel, Jr. |
| 7,837,602 | B1 | 11/2010 | Drybread |
| 7,837,603 | B1 | 11/2010 | Carnell, Sr. |
| 7,839,058 | B1 | 11/2010 | Churchill et al. |
| 7,841,971 | B2 | 11/2010 | Smith |
| 7,846,070 | B2 | 12/2010 | Oglesby et al. |
| 7,850,584 | B2 | 12/2010 | Uygan |
| 7,854,669 | B2 | 12/2010 | Marty et al. |
| 7,862,483 | B2 | 1/2011 | Hendrickson et al. |
| 7,862,486 | B1 | 1/2011 | Watson |
| 7,862,489 | B2 | 1/2011 | Sa et al. |
| 7,871,355 | B2 | 1/2011 | Yeh |
| 7,871,357 | B2 | 1/2011 | Gibson et al. |
| 7,874,961 | B2 | 1/2011 | McKee et al. |
| 7,878,950 | B1 | 2/2011 | Bastian |
| 7,883,448 | B2 | 2/2011 | Wang |
| 7,887,465 | B2 | 2/2011 | Uffelman |
| 7,887,468 | B2 | 2/2011 | Ross et al. |
| 7,887,469 | B1 | 2/2011 | Chen |
| 7,887,471 | B2 | 2/2011 | Mcsorley |
| 7,892,148 | B1 | 2/2011 | Stauffer et al. |
| 7,892,149 | B2 | 2/2011 | Wu |
| 7,892,150 | B1 | 2/2011 | Colley |
| 7,892,155 | B2 | 2/2011 | Pearson et al. |
| 7,896,782 | B2 | 3/2011 | Tamari |
| 7,900,324 | B2 | 3/2011 | Ginocchio |
| 7,901,324 | B2 | 3/2011 | Kodama |
| 7,901,325 | B2 | 3/2011 | Henderson |
| 7,901,335 | B2 | 3/2011 | Webber et al. |
| 7,908,981 | B2 | 3/2011 | Agee |
| 7,909,742 | B2 | 3/2011 | Ish, III et al. |
| 7,909,743 | B1 | 3/2011 | Webber |
| 7,909,745 | B2 | 3/2011 | Mills et al. |
| 7,914,420 | B2 | 3/2011 | Daly et al. |
| 7,914,421 | B2 | 3/2011 | Weier et al. |
| 7,919,950 | B2 | 4/2011 | Uno et al. |
| 7,922,635 | B2 | 4/2011 | Lull et al. |
| 7,927,253 | B2 | 4/2011 | Vincent |
| 7,931,563 | B2 | 4/2011 | Shaw et al. |
| 7,931,570 | B2 | 4/2011 | Hoffman |
| 7,935,026 | B2 | 5/2011 | Mcsorley |
| 7,935,032 | B1 | 5/2011 | Jackson |
| 7,938,751 | B2 | 5/2011 | Nicolas et al. |
| 7,938,755 | B1 | 5/2011 | Dyer et al. |
| 7,938,760 | B1 | 5/2011 | Webber et al. |
| 7,938,761 | B2 | 5/2011 | Simonson |
| 7,942,788 | B2 | 5/2011 | Wu |
| 7,942,793 | B2 | 5/2011 | Mills et al. |
| 7,946,968 | B2 | 5/2011 | Kjellberg |
| 7,949,295 | B2 | 5/2011 | Kumar et al. |
| 7,951,046 | B1 | 5/2011 | Barber, Jr. |
| 7,959,124 | B2 | 6/2011 | Phifer |
| 7,963,892 | B2 | 6/2011 | Poblete Castro et al. |
| 7,967,734 | B1 | 6/2011 | Damian |

(56) References Cited

U.S. PATENT DOCUMENTS

| | | | |
|---|---|---|---|
| 7,972,249 | B1 | 7/2011 | Napalan |
| 7,976,437 | B1 | 7/2011 | Von Detten |
| 7,976,443 | B2 | 7/2011 | Krull |
| 7,978,081 | B2 | 7/2011 | Shears et al. |
| 7,980,996 | B2 | 7/2011 | Hickman |
| 7,981,010 | B1 | 7/2011 | Webber et al. |
| 7,981,011 | B1 | 7/2011 | Batca |
| 7,981,012 | B1 | 7/2011 | Krull |
| 7,981,013 | B2 | 7/2011 | Krull |
| 7,985,164 | B2 | 7/2011 | Ishibashi |
| 7,988,600 | B2 | 8/2011 | Rodgers, Jr. |
| 7,988,605 | B1 | 8/2011 | Wyeroski |
| 7,993,251 | B1 | 8/2011 | Webber et al. |
| 7,998,036 | B2 | 8/2011 | Ish, III |
| 7,998,042 | B2 | 8/2011 | Bowser et al. |
| 8,001,472 | B2 | 8/2011 | Gilley et al. |
| 8,002,674 | B2 | 8/2011 | Piaget et al. |
| 8,002,678 | B1 | 8/2011 | Krull |
| 8,002,684 | B2 | 8/2011 | Laurent |
| 8,006,711 | B2 | 8/2011 | Pietrzak et al. |
| 8,007,409 | B2 | 8/2011 | Elllis |
| 8,007,413 | B1 | 8/2011 | Wu |
| 8,007,415 | B1 | 8/2011 | Lundquist |
| RE42,698 | E | 9/2011 | Kuo et al. |
| 8,012,067 | B2 | 9/2011 | Joannou |
| 8,012,068 | B1 | 9/2011 | Malcolm |
| 8,012,071 | B2 | 9/2011 | Grisdale |
| 8,012,073 | B2 | 9/2011 | Barnett |
| 8,025,613 | B1 | 9/2011 | Wang |
| 8,029,415 | B2 | 10/2011 | Ashby et al. |
| 8,029,425 | B2 | 10/2011 | Bronston et al. |
| 8,033,960 | B1 | 10/2011 | Dalebout et al. |
| 8,033,965 | B1 | 10/2011 | Krull |
| 8,043,173 | B2 | 10/2011 | Menalagha et al. |
| 8,047,965 | B2 | 11/2011 | Shea |
| 8,047,966 | B2 | 11/2011 | Dorogusker et al. |
| 8,047,970 | B2 | 11/2011 | Nalley |
| 8,052,584 | B2 | 11/2011 | Keiser |
| 8,055,469 | B2 | 11/2011 | Kulach et al. |
| 8,056,687 | B2 | 11/2011 | Golden et al. |
| 8,057,367 | B2 | 11/2011 | Giannelli et al. |
| 8,057,368 | B1 | 11/2011 | Lyszczarz |
| 8,062,196 | B1 | 11/2011 | Khubani |
| 8,066,514 | B2 | 11/2011 | Clarke |
| 8,070,657 | B2 | 12/2011 | Loach |
| 8,072,902 | B2 | 12/2011 | Moon |
| 8,075,453 | B1 | 12/2011 | Wilkinson |
| 8,079,939 | B1 | 12/2011 | Wang |
| 8,082,029 | B2 | 12/2011 | Honda |
| 8,083,693 | B1 | 12/2011 | McKeon et al. |
| 8,092,351 | B1 | 1/2012 | Rodgers, Jr. |
| 8,096,926 | B1 | 1/2012 | Batca |
| 8,103,379 | B2 | 1/2012 | Biba et al. |
| 8,104,411 | B2 | 1/2012 | Fenton |
| 8,105,213 | B2 | 1/2012 | Stewart et al. |
| 8,106,563 | B2 | 1/2012 | Ritchey |
| 8,109,858 | B2 | 2/2012 | Redmann |
| 8,109,864 | B2 | 2/2012 | Tseng |
| 8,111,166 | B2 | 2/2012 | Flexer et al. |
| 8,113,994 | B2 | 2/2012 | Piaget et al. |
| 8,123,527 | B2 | 2/2012 | Holljes |
| 8,141,276 | B2 | 3/2012 | Ellis |
| 8,142,370 | B2 | 3/2012 | Weinberg et al. |
| 8,147,385 | B2 | 4/2012 | Crawford et al. |
| 8,147,386 | B2 | 4/2012 | Farnsworth et al. |
| 8,152,702 | B2 | 4/2012 | Pacheco |
| 8,162,804 | B2 | 4/2012 | Tagliabue |
| 8,172,729 | B2 | 5/2012 | Ellis |
| 8,177,688 | B2 | 5/2012 | Burnfield et al. |
| 8,177,693 | B2 | 5/2012 | Webber et al. |
| 8,182,399 | B2 | 5/2012 | Davis et al. |
| 8,188,700 | B2 | 5/2012 | Tseng et al. |
| 8,192,332 | B2 | 6/2012 | Baker et al. |
| 8,197,392 | B2 | 6/2012 | Silverman et al. |
| 8,200,323 | B2 | 6/2012 | Dibenedetto et al. |
| 8,206,274 | B2 | 6/2012 | Svenberg et al. |
| 8,212,445 | B2 | 7/2012 | Ritchey |
| 8,215,886 | B2 | 7/2012 | Campbell |
| 8,221,290 | B2 | 7/2012 | Vincent et al. |
| 8,240,430 | B2 | 8/2012 | Downey |
| 8,241,187 | B2 | 8/2012 | Moon et al. |
| 8,249,714 | B1 | 8/2012 | Hartman et al. |
| 8,251,874 | B2 | 8/2012 | Ashby et al. |
| 8,251,877 | B2 | 8/2012 | Rasmussen et al. |
| 8,260,858 | B2 | 9/2012 | Belz et al. |
| 8,262,546 | B1 | 9/2012 | Lashinske |
| 8,272,996 | B2 | 9/2012 | Weier |
| 8,275,265 | B2 | 9/2012 | Kobyakov et al. |
| 8,280,259 | B2 | 10/2012 | George et al. |
| 8,287,434 | B2 | 10/2012 | Zavadsky et al. |
| 8,298,125 | B2 | 10/2012 | Colledge et al. |
| 8,306,635 | B2 | 11/2012 | Pryor |
| 8,308,620 | B2 | 11/2012 | Lyszczarz |
| 8,315,636 | B2 | 11/2012 | Moon et al. |
| 8,315,823 | B2 | 11/2012 | Berme et al. |
| 8,320,578 | B2 | 11/2012 | Kahn et al. |
| 8,323,157 | B2 | 12/2012 | Campanaro et al. |
| 8,333,681 | B2 | 12/2012 | Schmidt |
| 8,343,016 | B1 | 1/2013 | Astilean |
| 8,360,904 | B2 | 1/2013 | Oleson et al. |
| 8,360,935 | B2 | 1/2013 | Olsen et al. |
| 8,360,936 | B2 | 1/2013 | Dibenedetto et al. |
| 8,368,329 | B1 | 2/2013 | Depew et al. |
| 8,378,647 | B2 | 2/2013 | Yonezawa et al. |
| 8,394,005 | B2 | 3/2013 | Solow et al. |
| 8,395,366 | B2 | 3/2013 | Uno |
| 8,398,529 | B2 | 3/2013 | Ellis |
| 8,435,160 | B1 | 5/2013 | Clum |
| 8,444,537 | B1 | 5/2013 | Santoro |
| 8,446,275 | B2 | 5/2013 | Utter, II |
| 8,449,620 | B2 | 5/2013 | Hakansson et al. |
| 8,454,437 | B2 | 6/2013 | Dugan |
| 8,454,483 | B1 | 6/2013 | Bradley et al. |
| 8,459,479 | B2 | 6/2013 | Yourist |
| 8,475,338 | B2 | 7/2013 | Greenhill et al. |
| 8,475,346 | B2 | 7/2013 | Gerschefske et al. |
| 8,475,367 | B1 | 7/2013 | Yuen et al. |
| 8,480,541 | B1 | 7/2013 | Brunts |
| 8,485,576 | B2 | 7/2013 | Melville et al. |
| 8,485,944 | B2 | 7/2013 | Drazan |
| 8,485,945 | B2 | 7/2013 | Leonhard |
| 8,485,946 | B2 | 7/2013 | Ross et al. |
| 8,485,947 | B2 | 7/2013 | Nizam |
| 8,485,996 | B2 | 7/2013 | Bluman |
| 8,487,759 | B2 | 7/2013 | Hill |
| 8,500,608 | B1 | 8/2013 | Bonomi |
| 8,505,597 | B2 | 8/2013 | Sharperson |
| 8,506,459 | B2 | 8/2013 | Cassidy et al. |
| 8,512,210 | B2 | 8/2013 | Shauli |
| 8,512,212 | B2 | 8/2013 | Ish, III |
| 8,516,723 | B2 | 8/2013 | Ferrigan et al. |
| 8,517,899 | B2 | 8/2013 | Zhou |
| 8,523,743 | B1 | 9/2013 | Miles et al. |
| 8,523,789 | B2 | 9/2013 | Keiser |
| 8,529,415 | B2 | 9/2013 | Svenberg |
| 8,535,204 | B2 | 9/2013 | Stacey |
| 8,535,247 | B2 | 9/2013 | Williams |
| 8,540,560 | B2 | 9/2013 | Crowley et al. |
| 8,550,962 | B2 | 10/2013 | Piaget et al. |
| 8,550,964 | B2 | 10/2013 | Ish, III et al. |
| 8,562,489 | B2 | 10/2013 | Burton et al. |
| 8,562,496 | B2 | 10/2013 | Webber et al. |
| 8,568,279 | B2 | 10/2013 | Golesh |
| 8,572,764 | B2 | 11/2013 | Thellmann |
| 8,572,820 | B2 | 11/2013 | Richards |
| 8,573,572 | B2 | 11/2013 | Bowen et al. |
| 8,573,982 | B1 | 11/2013 | Chuang |
| 8,588,476 | B1 | 11/2013 | Spicola, Jr. |
| 8,590,120 | B2 | 11/2013 | Sakai |
| 8,591,386 | B2 | 11/2013 | Meyer |
| 8,602,951 | B2 | 12/2013 | Morris |
| 8,608,624 | B2 | 12/2013 | Shabodyash et al. |
| 8,613,689 | B2 | 12/2013 | Dyer et al. |
| 8,614,595 | B2 | 12/2013 | Acatrinei |

(56) References Cited

U.S. PATENT DOCUMENTS

| | | | |
|---|---|---|---|
| 8,614,902 | B2 | 12/2013 | Pansier et al. |
| 8,617,008 | B2 | 12/2013 | Marty et al. |
| 8,631,544 | B1 | 1/2014 | Shotey et al. |
| 8,647,239 | B1 | 2/2014 | Sokolovas |
| 8,655,004 | B2 | 2/2014 | Prest et al. |
| 8,657,724 | B2 | 2/2014 | Yang |
| 8,690,578 | B1 | 4/2014 | Nusbaum et al. |
| 8,690,735 | B2 | 4/2014 | Watterson et al. |
| 8,690,738 | B1 | 4/2014 | Astilian |
| 8,696,527 | B2 | 4/2014 | Wu |
| 8,701,567 | B1 | 4/2014 | Esfandiari et al. |
| 8,702,430 | B2 | 4/2014 | Dibenedetto et al. |
| 8,702,567 | B2 | 4/2014 | Hu |
| 8,708,870 | B2 | 4/2014 | Nalley |
| 8,715,140 | B1 | 5/2014 | Gertz |
| 8,734,157 | B1 | 5/2014 | Hummel, III |
| 8,734,301 | B2 | 5/2014 | Remelius |
| 8,734,302 | B2 | 5/2014 | Hsieh |
| 8,734,304 | B2 | 5/2014 | Webber et al. |
| 8,734,308 | B1 | 5/2014 | Joslin |
| 8,740,753 | B2 | 6/2014 | Olson et al. |
| 8,740,756 | B2 | 6/2014 | Shabodyash et al. |
| 8,749,380 | B2 | 6/2014 | Vock et al. |
| 8,758,201 | B2 | 6/2014 | Ashby et al. |
| 8,762,101 | B2 | 6/2014 | Yuen et al. |
| 8,764,609 | B1 | 7/2014 | Elahmadie |
| 8,771,153 | B2 | 7/2014 | Dalebout et al. |
| 8,777,820 | B2 | 7/2014 | Lo |
| 8,783,326 | B1 | 7/2014 | Vaninger et al. |
| 8,784,274 | B1 | 7/2014 | Chuang |
| 8,784,286 | B2 | 7/2014 | Reyes |
| 8,790,222 | B2 | 7/2014 | Burger |
| 8,801,581 | B2 | 8/2014 | Lai et al. |
| 8,815,189 | B2 | 8/2014 | Arnold et al. |
| 8,821,354 | B1 | 9/2014 | Tabahi |
| 8,821,359 | B1 | 9/2014 | Kassel |
| 8,821,870 | B2 | 9/2014 | Robinson et al. |
| 8,824,697 | B2 | 9/2014 | Christoph |
| 8,825,445 | B2 | 9/2014 | Hoffman et al. |
| 8,827,879 | B2 | 9/2014 | Nicholas |
| 8,845,497 | B2 | 9/2014 | Turner |
| 8,845,498 | B2 | 9/2014 | Webb |
| 8,845,499 | B1 | 9/2014 | Boatwright |
| 8,847,988 | B2 | 9/2014 | Geisner et al. |
| 8,851,565 | B2 | 10/2014 | Hontz et al. |
| 8,864,627 | B2 | 10/2014 | Bayerlein et al. |
| 8,870,720 | B1 | 10/2014 | Webber et al. |
| 8,876,131 | B1 | 11/2014 | Gomes |
| 8,876,661 | B2 | 11/2014 | Lu |
| 8,876,674 | B2 | 11/2014 | Webb et al. |
| 8,888,660 | B1 | 11/2014 | Oteman |
| 8,894,551 | B2 | 11/2014 | Kerdjoudj |
| 8,920,291 | B2 | 12/2014 | Chen et al. |
| 8,926,475 | B2 | 1/2015 | Lin et al. |
| 8,926,479 | B2 | 1/2015 | Chen et al. |
| 8,932,188 | B2 | 1/2015 | Svenberg |
| 8,956,290 | B2 | 2/2015 | Gilley et al. |
| 8,956,715 | B2 | 2/2015 | Kim |
| 8,968,155 | B2 | 3/2015 | Bird |
| 8,968,163 | B1 | 3/2015 | Vidmar |
| 8,979,709 | B2 | 3/2015 | Toback et al. |
| 8,986,165 | B2 | 3/2015 | Ashby |
| 9,005,085 | B2 | 4/2015 | Astilean |
| 9,010,222 | B2 | 4/2015 | Peirce |
| 9,011,291 | B2 | 4/2015 | Birrell |
| 9,011,301 | B2 | 4/2015 | Balandis et al. |
| 9,015,952 | B2 | 4/2015 | Magosaki |
| 9,017,230 | B1 | 4/2015 | Pitts |
| 9,022,906 | B1 | 5/2015 | Nelson |
| 9,022,907 | B2 | 5/2015 | Wang |
| 9,028,368 | B2 | 5/2015 | Ashby et al. |
| 9,028,381 | B2 | 5/2015 | Mestemaker |
| 9,038,218 | B1 | 5/2015 | Heil et al. |
| 9,038,549 | B1 | 5/2015 | Zebarjad |
| 9,039,578 | B2 | 5/2015 | Dalebout |
| 9,050,491 | B2 | 6/2015 | Gordon et al. |
| 9,050,497 | B2 | 6/2015 | Reyes |
| 9,050,498 | B2 | 6/2015 | Lu et al. |
| 9,072,930 | B2 | 7/2015 | Ashby et al. |
| 9,072,932 | B2 | 7/2015 | Piaget et al. |
| 9,079,068 | B2 | 7/2015 | Muehl |
| 9,089,732 | B2 | 7/2015 | Andon et al. |
| 9,095,740 | B2 | 8/2015 | Wu |
| 9,108,079 | B2 | 8/2015 | Solow et al. |
| 9,114,275 | B2 | 8/2015 | Lu et al. |
| 9,114,276 | B2 | 8/2015 | Bayerlein et al. |
| 9,119,983 | B2 | 9/2015 | Rhea |
| 9,125,620 | B2 | 9/2015 | Walke |
| 9,126,072 | B2 | 9/2015 | Watterson |
| 9,132,051 | B2 | 9/2015 | Heil |
| 9,135,347 | B2 | 9/2015 | Damman et al. |
| 9,138,612 | B2 | 9/2015 | Breaux |
| 9,138,614 | B2 | 9/2015 | Lu et al. |
| 9,138,615 | B2 | 9/2015 | Olson et al. |
| 9,144,703 | B2 | 9/2015 | Dalebout et al. |
| 9,144,709 | B2 | 9/2015 | Reich |
| 9,162,102 | B1 | 10/2015 | Eder et al. |
| 9,162,104 | B1 | 10/2015 | Lee |
| 9,162,106 | B1 | 10/2015 | Scheiman |
| 9,168,414 | B2 | 10/2015 | Liu et al. |
| 9,174,085 | B2 | 11/2015 | Foley |
| 9,186,537 | B2 | 11/2015 | Arnold et al. |
| 9,186,549 | B2 | 11/2015 | Watterson et al. |
| 9,186,552 | B1 | 11/2015 | Deal |
| 9,192,800 | B1 | 11/2015 | Meyer et al. |
| 9,199,115 | B2 | 12/2015 | Yim et al. |
| 9,199,123 | B2 | 12/2015 | Solow |
| 9,201,458 | B2 | 12/2015 | Hunt et al. |
| 9,211,431 | B2 | 12/2015 | Hornback et al. |
| 9,220,940 | B2 | 12/2015 | Al Kuwari |
| 9,221,545 | B2 | 12/2015 | Popescu et al. |
| 9,224,291 | B2 | 12/2015 | Moll-Carrillo et al. |
| 9,226,692 | B2 | 1/2016 | Haas |
| 9,227,101 | B2 | 1/2016 | Maguire |
| 9,248,329 | B2 | 2/2016 | Heideman |
| 9,259,633 | B2 | 2/2016 | Meyers |
| 9,265,984 | B2 | 2/2016 | Huber |
| 9,272,186 | B2 | 3/2016 | Reich |
| 9,289,063 | B2 | 3/2016 | Baugh et al. |
| 9,289,644 | B2 | 3/2016 | Carson |
| 9,292,935 | B2 | 3/2016 | Koduri et al. |
| 9,295,302 | B1 | 3/2016 | Reed et al. |
| 9,308,409 | B2 | 4/2016 | Beaver et al. |
| 9,308,415 | B2 | 4/2016 | Crawford et al. |
| 9,308,417 | B2 | 4/2016 | Grundy |
| 9,311,802 | B1 | 4/2016 | Chin et al. |
| 9,314,658 | B2 | 4/2016 | Kaye |
| 9,314,659 | B2 | 4/2016 | Gvoich |
| 9,320,935 | B1 | 4/2016 | Paris |
| 9,320,938 | B1 | 4/2016 | Belmore |
| 9,320,940 | B2 | 4/2016 | Rainey |
| 9,327,159 | B1 | 5/2016 | Medina |
| 9,333,388 | B2 | 5/2016 | Lee et al. |
| 9,339,681 | B1 | 5/2016 | Nalley |
| 9,339,682 | B2 | 5/2016 | Braier et al. |
| 9,339,683 | B2 | 5/2016 | Dilli et al. |
| 9,339,692 | B2 | 5/2016 | Hashish |
| 9,352,181 | B2 | 5/2016 | O'Neil |
| 9,352,185 | B2 | 5/2016 | Hendrickson et al. |
| 9,352,186 | B2 | 5/2016 | Watterson |
| 9,352,187 | B2 | 5/2016 | Piaget et al. |
| 9,357,551 | B2 | 5/2016 | Gutman |
| 9,358,422 | B2 | 6/2016 | Brontman |
| 9,364,703 | B1 | 6/2016 | Kuka |
| 9,364,706 | B2 | 6/2016 | Lo |
| 9,364,708 | B2 | 6/2016 | Luger et al. |
| 9,364,712 | B2 | 6/2016 | Wu |
| 9,364,714 | B2 | 6/2016 | Koduri et al. |
| 9,367,668 | B2 | 6/2016 | Flynt et al. |
| 9,370,687 | B2 | 6/2016 | Hao |
| 9,375,602 | B2 | 6/2016 | Krull |
| 9,378,336 | B2 | 6/2016 | Ohnemus et al. |
| 9,387,355 | B1 | 7/2016 | Joya |
| 9,387,357 | B2 | 7/2016 | Mueller |

(56) References Cited

U.S. PATENT DOCUMENTS

| | | | |
|---|---|---|---|
| 9,387,387 | B2 | 7/2016 | Dalebout |
| 9,389,718 | B1 | 7/2016 | Letourneur |
| 9,393,453 | B2 | 7/2016 | Watterson |
| 9,403,048 | B2 | 8/2016 | Balandis |
| 9,409,047 | B2 | 8/2016 | Kamenskikh |
| 9,415,257 | B2 | 8/2016 | Habing |
| 9,427,611 | B1 | 8/2016 | Balentine |
| 9,452,315 | B1 | 9/2016 | Murray et al. |
| 9,452,320 | B2 | 9/2016 | Yang |
| 9,455,784 | B2 | 9/2016 | Cune et al. |
| 9,457,220 | B2 | 10/2016 | Olson |
| 9,457,224 | B2 | 10/2016 | Giannelli et al. |
| 9,463,345 | B2 | 10/2016 | Simonetti |
| 9,463,349 | B1 | 10/2016 | Chang |
| 9,468,792 | B2 | 10/2016 | Simonetti |
| 9,474,666 | B1 | 10/2016 | Smith |
| 9,480,874 | B2 | 11/2016 | Cutler |
| 9,486,658 | B2 | 11/2016 | Alexander |
| 9,498,666 | B1 | 11/2016 | Boatwright |
| 9,498,668 | B2 | 11/2016 | Smith |
| 9,498,671 | B1 | 11/2016 | Softky |
| 9,505,241 | B2 | 11/2016 | Lyon |
| 9,506,528 | B2 | 11/2016 | Tucker et al. |
| 9,506,529 | B2 | 11/2016 | Tucker et al. |
| 9,526,937 | B2 | 12/2016 | Uygan |
| 9,539,458 | B1 | 1/2017 | Ross |
| 9,540,071 | B2 | 1/2017 | Jordan et al. |
| 9,540,174 | B2 | 1/2017 | Josserond et al. |
| 9,545,540 | B1 | 1/2017 | Moschel |
| 9,550,091 | B2 | 1/2017 | Emerson |
| 9,555,278 | B2 | 1/2017 | Kaye et al. |
| 9,555,280 | B2 | 1/2017 | Kaye et al. |
| 9,560,917 | B2 | 2/2017 | Roslund, Jr. |
| 9,573,017 | B2 | 2/2017 | Chang |
| 9,579,534 | B2 | 2/2017 | Sutkowski et al. |
| 9,579,544 | B2 | 2/2017 | Watterson |
| 9,582,976 | B2 | 2/2017 | Chin et al. |
| 9,593,992 | B2 | 3/2017 | Wu |
| 9,604,092 | B2 | 3/2017 | Krull |
| 9,604,099 | B2 | 3/2017 | Taylor |
| 9,610,475 | B1 | 4/2017 | DeKnock et al. |
| 9,616,274 | B2 | 4/2017 | Wehrell |
| 9,616,284 | B1 | 4/2017 | Aganyan et al. |
| 9,616,292 | B2 | 4/2017 | Orfield |
| 9,623,285 | B1 | 4/2017 | Ruiz |
| 9,623,286 | B1 | 4/2017 | Chen |
| 9,630,048 | B2 | 4/2017 | Kaye et al. |
| 9,636,539 | B1 | 5/2017 | Brumit |
| 9,636,540 | B2 | 5/2017 | Mueller et al. |
| 9,643,042 | B2 | 5/2017 | Madden |
| 9,656,115 | B2 | 5/2017 | Young |
| 9,656,144 | B2 | 5/2017 | Jafarifesharaki |
| 9,656,591 | B1 | 5/2017 | Dumenigo |
| 9,669,261 | B2 | 6/2017 | Eder |
| 9,673,904 | B2 | 6/2017 | Palanisamy et al. |
| 9,675,836 | B2 | 6/2017 | Babon |
| 9,681,313 | B2 | 6/2017 | Malach |
| 9,682,267 | B2 | 6/2017 | Kaye et al. |
| 9,682,306 | B2 | 6/2017 | Lin et al. |
| 9,687,689 | B2 | 6/2017 | Lin |
| 9,694,234 | B2 | 7/2017 | Dalebout et al. |
| 9,700,752 | B1 | 7/2017 | Powers |
| 9,700,753 | B1 | 7/2017 | Boatwright |
| 9,700,780 | B2 | 7/2017 | Riley et al. |
| 9,707,435 | B1 | 7/2017 | Ferlito et al. |
| 9,707,441 | B2 | 7/2017 | Lopez Babodilla et al. |
| 9,707,447 | B1 | 7/2017 | Lopez Babodilla et al. |
| 9,720,912 | B2 | 8/2017 | Morimoto et al. |
| 9,724,553 | B2 | 8/2017 | Kaye et al. |
| 9,724,563 | B2 | 8/2017 | Schmidt |
| 9,731,158 | B1 | 8/2017 | Lo |
| 9,737,747 | B1 | 8/2017 | Walsh et al. |
| 9,750,454 | B2 | 9/2017 | Walke et al. |
| 9,757,605 | B2 | 9/2017 | Olson et al. |
| 9,757,611 | B1 | 9/2017 | Colburn |
| 9,764,184 | B2 | 9/2017 | Kueker et al. |
| 9,764,188 | B1 | 9/2017 | Aganyan et al. |
| 9,776,032 | B2 | 10/2017 | Moran et al. |
| 9,776,039 | B1 | 10/2017 | Xu |
| 9,782,625 | B1 | 10/2017 | Blum et al. |
| 9,795,819 | B2 | 10/2017 | Wehrell |
| 9,795,822 | B2 | 10/2017 | Smith et al. |
| 9,795,827 | B2 | 10/2017 | Wiener et al. |
| 9,795,855 | B2 | 10/2017 | Jafarifesharaki |
| 9,802,075 | B2 | 10/2017 | Gvoich |
| 9,808,673 | B2 | 11/2017 | Robinson |
| 9,814,920 | B1 | 11/2017 | Monterrey |
| 9,814,922 | B2 | 11/2017 | Moran et al. |
| 9,814,927 | B2 | 11/2017 | Forystek |
| 9,814,929 | B2 | 11/2017 | Moser |
| 9,814,930 | B2 | 11/2017 | Manzke et al. |
| 9,827,458 | B2 | 11/2017 | Dalton |
| 9,829,068 | B2 | 11/2017 | Marchetti |
| 9,833,654 | B1 | 12/2017 | Gant |
| 9,833,658 | B2 | 12/2017 | Wiener et al. |
| 9,841,077 | B2 | 12/2017 | Modrezejewski et al. |
| 9,849,330 | B2 | 12/2017 | Lagree |
| 9,868,006 | B1 | 1/2018 | Epler |
| 9,878,201 | B1 | 1/2018 | Moschel |
| 9,884,224 | B2 | 2/2018 | Spoeth et al. |
| 9,885,575 | B2 | 2/2018 | Collin |
| 9,889,334 | B2 | 2/2018 | Ashby et al. |
| 9,895,571 | B2 | 2/2018 | Wang |
| 9,901,766 | B2 | 2/2018 | Ross |
| 9,901,767 | B2 | 2/2018 | Kuo |
| 9,901,772 | B2 | 2/2018 | Crowley et al. |
| 9,901,780 | B2 | 2/2018 | DeLuca et al. |
| 9,901,805 | B2 | 2/2018 | Hughes, Jr. |
| 9,907,396 | B1 | 3/2018 | Labrosse et al. |
| 9,914,011 | B2 | 3/2018 | Downey et al. |
| 9,914,014 | B2 | 3/2018 | Lagree et al. |
| 9,919,183 | B1 | 3/2018 | Moschel |
| 9,921,726 | B1 | 3/2018 | Sculley et al. |
| 9,937,375 | B2 | 4/2018 | Zhu |
| 9,943,719 | B2 | 4/2018 | Smith et al. |
| 9,948,349 | B2 | 4/2018 | Malach |
| 9,950,205 | B2 | 4/2018 | Simonetti |
| 9,950,209 | B2 | 4/2018 | Yim et al. |
| 9,951,904 | B2 | 4/2018 | Perez et al. |
| 9,956,450 | B2 | 5/2018 | Bayerlein et al. |
| 9,968,821 | B2 | 5/2018 | Finlayson et al. |
| 9,968,823 | B2 | 5/2018 | Cutler |
| 9,987,513 | B2 | 6/2018 | Yim et al. |
| 9,987,517 | B1 | 6/2018 | Kuo |
| 9,993,680 | B2 | 6/2018 | Gordon |
| 9,993,683 | B2 | 6/2018 | Moschel |
| 10,004,934 | B2 | 6/2018 | Pennington |
| 10,004,940 | B2 | 6/2018 | Badarneh |
| 10,010,745 | B1 | 7/2018 | Brumit |
| 10,016,646 | B2 | 7/2018 | Butler |
| 10,022,583 | B2 | 7/2018 | Wang |
| 10,022,590 | B2 | 7/2018 | Foley et al. |
| 10,038,952 | B2 | 7/2018 | Labrosse et al. |
| 2001/0001303 | A1 | 5/2001 | Ohsuga et al. |
| 2001/0008053 | A1 | 7/2001 | Belli |
| 2001/0024998 | A1 | 9/2001 | Novak |
| 2001/0041647 | A1 | 11/2001 | Itoh |
| 2001/0049470 | A1 | 12/2001 | Mault et al. |
| 2001/0051564 | A1 | 12/2001 | Iund |
| 2001/0051566 | A1 | 12/2001 | Krull |
| 2002/0013200 | A1 | 1/2002 | Sechrest |
| 2002/0016235 | A1 | 2/2002 | Ashby et al. |
| 2002/0019298 | A1 | 2/2002 | Eschenbach |
| 2002/0022559 | A1 | 2/2002 | Krull |
| 2002/0024521 | A1 | 2/2002 | Goden |
| 2002/0025888 | A1 | 2/2002 | Germanton |
| 2002/0025891 | A1 | 2/2002 | Colosky et al. |
| 2002/0026130 | A1 | 2/2002 | West |
| 2002/0028733 | A1 | 3/2002 | Martens |
| 2002/0035017 | A1 | 3/2002 | Pertegaz-Esteban |
| 2002/0039952 | A1 | 4/2002 | Clem |
| 2002/0043909 | A1 | 4/2002 | Nielsen |
| 2002/0045519 | A1 | 4/2002 | Watterson |
| 2002/0049123 | A1 | 4/2002 | Krull |

(56) References Cited

U.S. PATENT DOCUMENTS

2002/0052268 A1 5/2002 Morcillo-Quintero
2002/0055418 A1 5/2002 Pyles et al.
2002/0055419 A1 5/2002 Hinnebusch
2002/0055420 A1 5/2002 Stearns et al.
2002/0055422 A1 5/2002 Airmet
2002/0055426 A1 5/2002 Krull
2002/0066735 A1 6/2002 Hewlitt et al.
2002/0072436 A1 6/2002 Liu
2002/0077221 A1 6/2002 Dalebout et al.
2002/0086779 A1 7/2002 Wilkinson
2002/0091043 A1 7/2002 Rexach
2002/0094914 A1 7/2002 Maresh et al.
2002/0098957 A1 7/2002 Webber
2002/0101880 A1 8/2002 Kim
2002/0107058 A1 8/2002 Namba et al.
2002/0115536 A1 8/2002 Hojo
2002/0119870 A1 8/2002 Chen
2002/0128127 A1 9/2002 Chen
2002/0132703 A1 9/2002 Martinez
2002/0132706 A1 9/2002 Sleamaker
2002/0137605 A1 9/2002 Olsen
2002/0142890 A1 10/2002 Ohrt
2002/0147078 A1 10/2002 Wu
2002/0151413 A1 10/2002 Dalebout
2002/0160883 A1 10/2002 Dugan
2002/0160891 A1 10/2002 Gallagher
2002/0171070 A1 11/2002 Shim
2002/0187879 A1 12/2002 Ball
2002/0193213 A1 12/2002 Batca
2002/0193214 A1 12/2002 Ish
2002/0193215 A1 12/2002 Cheng
2002/0198084 A1 12/2002 Stearns et al.
2003/0008731 A1 1/2003 Anderson et al.
2003/0017918 A1 1/2003 Webb et al.
2003/0022765 A1 1/2003 Wu
2003/0022770 A1 1/2003 Lee
2003/0032524 A1 2/2003 Lamar et al.
2003/0032528 A1 2/2003 Wu
2003/0032531 A1 2/2003 Simonson
2003/0032535 A1 2/2003 Wang
2003/0045406 A1 3/2003 Stone
2003/0060331 A1 3/2003 Polk
2003/0060344 A1 3/2003 David
2003/0060345 A1 3/2003 Piane
2003/0069108 A1 4/2003 Kaiserman et al.
2003/0073545 A1 4/2003 Liu
2003/0078138 A1 4/2003 Toyama
2003/0087737 A1 5/2003 Studdard
2003/0089596 A1 5/2003 Tao et al.
2003/0092532 A1 5/2003 Giannelli et al.
2003/0092533 A1 5/2003 Hippensteel
2003/0092540 A1 5/2003 Gillen
2003/0092542 A1 5/2003 Bartholomew et al.
2003/0096675 A1 5/2003 Wang
2003/0096683 A1 5/2003 Fenelon
2003/0097878 A1 5/2003 Farringdon et al.
2003/0100406 A1 5/2003 Millington
2003/0100413 A1 5/2003 Huang
2003/0100415 A1 5/2003 Augustine et al.
2003/0104908 A1 6/2003 Tung
2003/0114276 A1 6/2003 Schiff
2003/0114281 A1 6/2003 Mackert
2003/0115955 A1 6/2003 Keiser
2003/0119635 A1 6/2003 Arbuckle
2003/0122384 A1 7/2003 Swanson et al.
2003/0125165 A1 7/2003 Trevino
2003/0128186 A1 7/2003 Laker
2003/0134714 A1 7/2003 Oishi et al.
2003/0134718 A1 7/2003 Kim
2003/0148853 A1 8/2003 Alessandri
2003/0148862 A1 8/2003 Chen
2003/0153434 A1 8/2003 Dalebout
2003/0153439 A1 8/2003 Krull
2003/0158016 A1 8/2003 Kolda
2003/0158019 A1 8/2003 Giannelli
2003/0158024 A1 8/2003 Saure
2003/0166434 A1 9/2003 Lopez-Santillana et al.
2003/0171189 A1 9/2003 Kaufman
2003/0171190 A1 9/2003 Rice
2003/0176261 A1 9/2003 Simonson et al.
2003/0176815 A1 9/2003 Baba et al.
2003/0181289 A1 9/2003 Oscar Moavro
2003/0181293 A1 9/2003 Baatz
2003/0183027 A1 10/2003 Koch
2003/0186792 A1 10/2003 Keeler
2003/0195089 A1 10/2003 Schroeder
2003/0199368 A1 10/2003 Krull
2003/0211916 A1 11/2003 Capuano
2003/0216227 A1 11/2003 Smith
2003/0216229 A1 11/2003 Bastyr
2003/0216230 A1 11/2003 Wang
2003/0222419 A1 12/2003 Geary
2003/0232703 A1 12/2003 Webber
2003/0232707 A1 12/2003 Dalebout et al.
2003/0236153 A1 12/2003 Pan et al.
2004/0005958 A1 1/2004 Kamen et al.
2004/0005961 A1 1/2004 Iund
2004/0005965 A1 1/2004 Panatta
2004/0009855 A1 1/2004 Webber
2004/0009856 A1 1/2004 Hammer
2004/0014567 A1 1/2004 Mendel
2004/0014571 A1 1/2004 Haynes
2004/0018915 A1 1/2004 Reyes
2004/0018917 A1 1/2004 Corbalis
2004/0018918 A1 1/2004 Reyes
2004/0018920 A1 1/2004 Simonson
2004/0021046 A1 2/2004 Hutchison
2004/0023759 A1 2/2004 Duncan et al.
2004/0023761 A1 2/2004 Emery
2004/0023762 A1 2/2004 Lull
2004/0023766 A1 2/2004 Slone
2004/0023778 A1 2/2004 Kusumoto et al.
2004/0025754 A1 2/2004 Dye
2004/0025993 A1 2/2004 Russell
2004/0029645 A1 2/2004 Chen
2004/0033865 A1 2/2004 Wu
2004/0033866 A1 2/2004 Shapiro
2004/0043873 A1 3/2004 Wilkinson et al.
2004/0051392 A1 3/2004 Badarneh
2004/0053748 A1 3/2004 Lo et al.
2004/0053752 A1 3/2004 Yang
2004/0053756 A1 3/2004 Tremayne
2004/0063549 A1 4/2004 Kuo
2004/0067821 A1 4/2004 Kehrbaum
2004/0067833 A1 4/2004 Talish
2004/0072659 A1 4/2004 Alessandri
2004/0072661 A1 4/2004 Krull
2004/0072662 A1 4/2004 Landfair
2004/0077468 A1 4/2004 Myles
2004/0082444 A1 4/2004 Golesh
2004/0087420 A1 5/2004 Montesquieux
2004/0092367 A1 5/2004 Corbalis
2004/0097331 A1 5/2004 Zillig
2004/0097337 A1 5/2004 Chuang
2004/0097353 A1 5/2004 Mencis
2004/0100484 A1 5/2004 Barrett
2004/0103432 A1 5/2004 Barrett
2004/0114768 A1 6/2004 Luo
2004/0116258 A1 6/2004 Hyder
2004/0127335 A1 7/2004 Watterson
2004/0132586 A1 7/2004 Leighton et al.
2004/0132587 A1 7/2004 Leighton et al.
2004/0136750 A1 7/2004 Yoshioka et al.
2004/0138030 A1 7/2004 Wang
2004/0138032 A1 7/2004 Van Straaten
2004/0142799 A1 7/2004 Yeo
2004/0142800 A1 7/2004 Gerschefske
2004/0142801 A1 7/2004 Lin
2004/0144626 A1 7/2004 Saeki
2004/0152566 A1 8/2004 Yeh
2004/0155622 A1 8/2004 Mayhew et al.
2004/0157709 A1 8/2004 Olson
2004/0160336 A1 8/2004 Hoch
2004/0162189 A1 8/2004 Hickman

(56) References Cited

U.S. PATENT DOCUMENTS

| | | | |
|---|---|---|---|
| 2004/0162191 | A1 | 8/2004 | Ercanbrack |
| 2004/0162194 | A1 | 8/2004 | Habing |
| 2004/0162196 | A1 | 8/2004 | Degroot |
| 2004/0162198 | A1 | 8/2004 | Towley |
| 2004/0163574 | A1 | 8/2004 | Schoenbach |
| 2004/0166996 | A1 | 8/2004 | Kolda |
| 2004/0166999 | A1 | 8/2004 | Dodge |
| 2004/0171460 | A1 | 9/2004 | Park |
| 2004/0171464 | A1 | 9/2004 | Ashby et al. |
| 2004/0171465 | A1 | 9/2004 | Hald |
| 2004/0176215 | A1 | 9/2004 | Gramaccioni |
| 2004/0176217 | A1 | 9/2004 | Watterson |
| 2004/0177531 | A1 | 9/2004 | Dibenedetto et al. |
| 2004/0180719 | A1 | 9/2004 | Feldman |
| 2004/0181972 | A1 | 9/2004 | Csorba |
| 2004/0185988 | A1 | 9/2004 | Hsiung |
| 2004/0192514 | A1 | 9/2004 | Piaget et al. |
| 2004/0198555 | A1 | 10/2004 | Anderson |
| 2004/0198559 | A1 | 10/2004 | Grossi |
| 2004/0198569 | A1 | 10/2004 | Sanford-Schwentke |
| 2004/0198571 | A1 | 10/2004 | Howell et al. |
| 2004/0204294 | A2 | 10/2004 | Wilkinson |
| 2004/0208943 | A1 | 10/2004 | Miketin |
| 2004/0214693 | A1 | 10/2004 | Piaget et al. |
| 2004/0220025 | A1 | 11/2004 | Krull |
| 2004/0224740 | A1 | 11/2004 | Ball et al. |
| 2004/0224825 | A1 | 11/2004 | Giannelli et al. |
| 2004/0224827 | A1 | 11/2004 | Ashley |
| 2004/0242378 | A1 | 12/2004 | Pan |
| 2004/0242379 | A1 | 12/2004 | Juva |
| 2004/0242380 | A1 | 12/2004 | Kuivala |
| 2004/0242388 | A1 | 12/2004 | Kusminsky |
| 2004/0248699 | A1 | 12/2004 | Colley |
| 2004/0248713 | A1 | 12/2004 | Campanaro |
| 2004/0254020 | A1 | 12/2004 | Dragusin |
| 2004/0256524 | A1 | 12/2004 | Beck et al. |
| 2004/0259689 | A1 | 12/2004 | Wilkins et al. |
| 2004/0260191 | A1 | 12/2004 | Stubbs |
| 2004/0266587 | A1 | 12/2004 | Miller |
| 2004/0266591 | A1 | 12/2004 | Alessandri et al. |
| 2004/0266961 | A1 | 12/2004 | Solan |
| 2005/0003931 | A1 | 1/2005 | Mills et al. |
| 2005/0003933 | A1 | 1/2005 | Kau |
| 2005/0003938 | A1 | 1/2005 | Henderson |
| 2005/0008992 | A1 | 1/2005 | Westergaard et al. |
| 2005/0009668 | A1 | 1/2005 | Savettiere |
| 2005/0009672 | A1 | 1/2005 | Yeh |
| 2005/0013658 | A1 | 1/2005 | Muders et al. |
| 2005/0014616 | A1 | 1/2005 | Tiahrt |
| 2005/0023292 | A1 | 2/2005 | Market et al. |
| 2005/0032610 | A1 | 2/2005 | Nelson |
| 2005/0032611 | A1 | 2/2005 | Webber |
| 2005/0037898 | A1 | 2/2005 | Chang |
| 2005/0037904 | A1 | 2/2005 | Chang |
| 2005/0043145 | A1 | 2/2005 | Anderson et al. |
| 2005/0043146 | A1 | 2/2005 | Lo et al. |
| 2005/0043155 | A1 | 2/2005 | Yannitte |
| 2005/0044984 | A1 | 3/2005 | Jones |
| 2005/0049117 | A1 | 3/2005 | Rodgers |
| 2005/0049121 | A1 | 3/2005 | Dalebout |
| 2005/0049123 | A1 | 3/2005 | Dalebout et al. |
| 2005/0054492 | A1 | 3/2005 | Neff |
| 2005/0061587 | A1 | 3/2005 | Tsai |
| 2005/0064994 | A1 | 3/2005 | Matsumoto |
| 2005/0065003 | A1 | 3/2005 | Klotzki |
| 2005/0075213 | A1 | 4/2005 | Arick |
| 2005/0079961 | A1 | 4/2005 | Dalebout |
| 2005/0085348 | A1 | 4/2005 | Kiefer |
| 2005/0085352 | A1 | 4/2005 | Baxter |
| 2005/0090770 | A1 | 4/2005 | Chen |
| 2005/0096187 | A1 | 5/2005 | Hsu |
| 2005/0096189 | A1 | 5/2005 | Chen |
| 2005/0096196 | A1 | 5/2005 | Webber |
| 2005/0096197 | A1 | 5/2005 | Webber |
| 2005/0096198 | A1 | 5/2005 | Webber |
| 2005/0101458 | A1 | 5/2005 | Huang |
| 2005/0101463 | A1 | 5/2005 | Chen |
| 2005/0107220 | A1 | 5/2005 | Wang |
| 2005/0113158 | A1 | 5/2005 | Sterchi et al. |
| 2005/0113223 | A1 | 5/2005 | Dovner et al. |
| 2005/0124471 | A1 | 6/2005 | Wilkinson |
| 2005/0129253 | A1 | 6/2005 | Chen |
| 2005/0129903 | A1 | 6/2005 | Carr |
| 2005/0130807 | A1 | 6/2005 | Cutler |
| 2005/0130814 | A1 | 6/2005 | Nitta et al. |
| 2005/0131319 | A1 | 6/2005 | Der Meer |
| 2005/0132838 | A1 | 6/2005 | Lin |
| 2005/0143226 | A1 | 6/2005 | Heidecke |
| 2005/0143228 | A1 | 6/2005 | Lee |
| 2005/0143230 | A1 | 6/2005 | Dalebout |
| 2005/0148398 | A1 | 7/2005 | Lochtefeld et al. |
| 2005/0148439 | A1 | 7/2005 | Wu |
| 2005/0148440 | A1 | 7/2005 | Denton |
| 2005/0148442 | A1 | 7/2005 | Watterson |
| 2005/0148443 | A1 | 7/2005 | Watterson |
| 2005/0148445 | A1 | 7/2005 | Carle |
| 2005/0159273 | A1 | 7/2005 | Chen |
| 2005/0159278 | A1 | 7/2005 | Mcvay |
| 2005/0164837 | A1 | 7/2005 | Anderson |
| 2005/0164838 | A1 | 7/2005 | Watterson |
| 2005/0164839 | A1 | 7/2005 | Watterson |
| 2005/0164853 | A1 | 7/2005 | Naidus |
| 2005/0170935 | A1 | 8/2005 | Manser |
| 2005/0170936 | A1 | 8/2005 | Quinn |
| 2005/0170937 | A1 | 8/2005 | van Straaten |
| 2005/0172311 | A1 | 8/2005 | Hjelt et al. |
| 2005/0176560 | A1 | 8/2005 | Chen |
| 2005/0178210 | A1 | 8/2005 | Lanham |
| 2005/0181347 | A1 | 8/2005 | Barnes et al. |
| 2005/0181911 | A1 | 8/2005 | Porth |
| 2005/0181916 | A1 | 8/2005 | Frost et al. |
| 2005/0187075 | A1 | 8/2005 | Bellamy |
| 2005/0187082 | A1 | 8/2005 | Bowser |
| 2005/0192162 | A1 | 9/2005 | Pan |
| 2005/0192163 | A1 | 9/2005 | Pan et al. |
| 2005/0196737 | A1 | 9/2005 | Mann |
| 2005/0202934 | A1 | 9/2005 | Olrik et al. |
| 2005/0209050 | A1 | 9/2005 | Bartels |
| 2005/0209051 | A1 | 9/2005 | Santomassimo et al. |
| 2005/0209052 | A1 | 9/2005 | Ashby |
| 2005/0209060 | A1 | 9/2005 | Lull |
| 2005/0209062 | A1 | 9/2005 | Anderson et al. |
| 2005/0215397 | A1 | 9/2005 | Watterson |
| 2005/0221962 | A1 | 10/2005 | Warner |
| 2005/0227820 | A1 | 10/2005 | Dyer |
| 2005/0227826 | A1 | 10/2005 | Oga |
| 2005/0227831 | A1 | 10/2005 | Mills |
| 2005/0227832 | A1 | 10/2005 | Wu |
| 2005/0229367 | A1 | 10/2005 | Thompson |
| 2005/0233861 | A1 | 10/2005 | Hickman |
| 2005/0233871 | A1 | 10/2005 | Anders |
| 2005/0233873 | A1 | 10/2005 | Chen |
| 2005/0239600 | A1 | 10/2005 | Liang |
| 2005/0239607 | A1 | 10/2005 | Chang |
| 2005/0239612 | A1 | 10/2005 | Keiser |
| 2005/0245365 | A1 | 11/2005 | Rolli |
| 2005/0245370 | A1 | 11/2005 | Boland |
| 2005/0248713 | A1 | 11/2005 | Hirosue et al. |
| 2005/0250619 | A1 | 11/2005 | Daikeler et al. |
| 2005/0250622 | A1 | 11/2005 | Chang |
| 2005/0266961 | A1 | 12/2005 | Shum et al. |
| 2005/0272562 | A1 | 12/2005 | Alessandri et al. |
| 2005/0272564 | A1 | 12/2005 | Pyles et al. |
| 2005/0272575 | A1 | 12/2005 | Melegati |
| 2005/0272577 | A1 | 12/2005 | Olson |
| 2005/0277520 | A1 | 12/2005 | Van Waes |
| 2005/0277525 | A1 | 12/2005 | Liu |
| 2005/0281963 | A1 | 12/2005 | Cook |
| 2005/0283051 | A1 | 12/2005 | Chen |
| 2005/0283911 | A1 | 12/2005 | Roussy |
| 2005/0288155 | A1 | 12/2005 | Yang |
| 2006/0003869 | A1 | 1/2006 | Huang et al. |
| 2006/0003872 | A1 | 1/2006 | Chiles et al. |
| 2006/0003876 | A1 | 1/2006 | Duhamel |

(56) References Cited

U.S. PATENT DOCUMENTS

2006/0003877 A1 1/2006 Harmon
2006/0004265 A1 1/2006 Pulkkinen et al.
2006/0009332 A1 1/2006 Jones
2006/0019804 A1 1/2006 Young
2006/0019806 A1 1/2006 Mikulski
2006/0021155 A1 2/2006 Lang et al.
2006/0025287 A1 2/2006 Chermack
2006/0030462 A1 2/2006 Ish, III
2006/0030465 A1 2/2006 Johnson
2006/0033392 A1 2/2006 Ritchey
2006/0035755 A1 2/2006 Dalebout
2006/0035757 A1 2/2006 Flick et al.
2006/0035758 A1 2/2006 Rogozinski
2006/0035764 A1 2/2006 Webber
2006/0035768 A1 2/2006 Kowallis
2006/0035772 A1 2/2006 Golesh et al.
2006/0040797 A1 2/2006 Chang
2006/0040798 A1 2/2006 Weier et al.
2006/0040810 A1 2/2006 Chu
2006/0046905 A1 3/2006 Doody, Jr.
2006/0047447 A1 3/2006 Brady et al.
2006/0052220 A1 3/2006 Jackson et al.
2006/0052222 A1 3/2006 Cardenas
2006/0053586 A1 3/2006 Chase
2006/0053587 A1 3/2006 Chase
2006/0058158 A1 3/2006 McAvoy
2006/0058162 A1 3/2006 Vieno et al.
2006/0063644 A1 3/2006 Yang
2006/0068978 A1 3/2006 Moon
2006/0075544 A1 4/2006 Kriesel
2006/0079800 A1 4/2006 Martikka et al.
2006/0084422 A1 4/2006 Huang et al.
2006/0084556 A1 4/2006 Payne
2006/0100069 A1 5/2006 Dibble et al.
2006/0100070 A1 5/2006 Abdo
2006/0100546 A1 5/2006 Silk
2006/0105889 A1 5/2006 Webb
2006/0116253 A1 6/2006 Nizam
2006/0116254 A1 6/2006 Webber
2006/0122035 A1 6/2006 Felix
2006/0122038 A1 6/2006 Chou Lin
2006/0122044 A1 6/2006 Ho
2006/0123814 A1 6/2006 Choi et al.
2006/0128534 A1 6/2006 Roque
2006/0128540 A1 6/2006 Engle
2006/0132070 A1 6/2006 Heydt et al.
2006/0135274 A1 6/2006 Henry
2006/0135322 A1 6/2006 Rocker
2006/0148622 A1 7/2006 Chen
2006/0151303 A1 7/2006 Motoda
2006/0160665 A1 7/2006 Tai
2006/0160666 A1 7/2006 Wang
2006/0160677 A1 7/2006 Piane
2006/0160681 A1 7/2006 McBride et al.
2006/0166791 A1 7/2006 Liao
2006/0166798 A1 7/2006 Nelson
2006/0166799 A1 7/2006 Boland et al.
2006/0172862 A1 8/2006 Badarneh et al.
2006/0189439 A1 8/2006 Baudhuin
2006/0189440 A1 8/2006 Gravagne
2006/0189458 A1 8/2006 Walkerdine
2006/0189460 A1 8/2006 Katterjohn
2006/0189462 A1 8/2006 Pearson et al.
2006/0194679 A1 8/2006 Hatcher
2006/0199706 A1 9/2006 Wehrell
2006/0205568 A1 9/2006 Huang
2006/0205569 A1 9/2006 Watterson
2006/0205571 A1 9/2006 Krull
2006/0217236 A1 9/2006 Watterson
2006/0217240 A1 9/2006 White
2006/0217242 A1 9/2006 Karpachev
2006/0217245 A1 9/2006 Golesh et al.
2006/0223680 A1 10/2006 Chang
2006/0229163 A1 10/2006 Waters
2006/0232147 A1 10/2006 Cheng
2006/0234832 A1 10/2006 Toyama et al.
2006/0240947 A1 10/2006 Qu
2006/0240951 A1 10/2006 Wang
2006/0240956 A1 10/2006 Piane, Jr.
2006/0240959 A1 10/2006 Huang
2006/0244187 A1 11/2006 Downey
2006/0247107 A1 11/2006 Carter
2006/0247109 A1 11/2006 Powell
2006/0248965 A1 11/2006 Wyatt
2006/0251638 A1 11/2006 Guenzler-Pukall
2006/0252602 A1 11/2006 Brown
2006/0252608 A1 11/2006 Kang et al.
2006/0252612 A1 11/2006 Sofun
2006/0258513 A1 11/2006 Routley
2006/0258515 A1 11/2006 Kang et al.
2006/0258519 A1 11/2006 Ardito et al.
2006/0264306 A1 11/2006 Tischler
2006/0270522 A1 11/2006 Yonehana et al.
2006/0276306 A1 12/2006 Pan et al.
2006/0279294 A1 12/2006 Cehelnik
2006/0281608 A1 12/2006 Tumminello
2006/0287089 A1 12/2006 Addington et al.
2006/0287147 A1 12/2006 Kriesel
2006/0287161 A1 12/2006 Dalebout
2006/0287163 A1 12/2006 Wang
2006/0288846 A1 12/2006 Logan
2006/0293156 A1 12/2006 Trees
2007/0004561 A1 1/2007 Yoo
2007/0004562 A1 1/2007 Pan et al.
2007/0004569 A1 1/2007 Cao
2007/0006489 A1 1/2007 Case et al.
2007/0010383 A1 1/2007 Pertegaz-Esteban
2007/0013655 A1 1/2007 Rosenberg et al.
2007/0015635 A1 1/2007 Donner
2007/0015636 A1 1/2007 Molter
2007/0015644 A1 1/2007 Aucamp
2007/0017025 A1 1/2007 Myer
2007/0018465 A1 1/2007 Vassilakos
2007/0021280 A1 1/2007 Tyree
2007/0027002 A1 2/2007 Clark et al.
2007/0027003 A1 2/2007 Clark
2007/0032353 A1 2/2007 Wilkins
2007/0037667 A1 2/2007 Gordon
2007/0037676 A1 2/2007 Denisco
2007/0038137 A1 2/2007 Arand et al.
2007/0042868 A1 2/2007 Fisher
2007/0042878 A1 2/2007 Lundquist
2007/0049462 A1 3/2007 Asukai et al.
2007/0049464 A1 3/2007 Chou
2007/0049465 A1 3/2007 Wu
2007/0049466 A1 3/2007 Hubbard
2007/0049470 A1 3/2007 Pyles et al.
2007/0054790 A1 3/2007 Dodge et al.
2007/0057001 A1 3/2007 Wang
2007/0060449 A1 3/2007 Lo
2007/0060450 A1 3/2007 Lo
2007/0060451 A1 3/2007 Lucas
2007/0066448 A1 3/2007 Pan et al.
2007/0072748 A1 3/2007 Lee
2007/0072752 A1 3/2007 Koch
2007/0079691 A1 4/2007 Turner
2007/0087908 A1 4/2007 Pan et al.
2007/0087918 A1 4/2007 Towley et al.
2007/0087920 A1 4/2007 Dachraoui et al.
2007/0093369 A1 4/2007 Bocchicchio
2007/0099780 A1 5/2007 Bowser
2007/0111858 A1 5/2007 Dugan
2007/0111866 A1 5/2007 McVay et al.
2007/0117683 A1 5/2007 Ercanbrack et al.
2007/0123389 A1 5/2007 Martin
2007/0123390 A1 5/2007 Mathis
2007/0123395 A1 5/2007 Ellis
2007/0123396 A1 5/2007 Ellis
2007/0131409 A1 6/2007 Asahi
2007/0135272 A1 6/2007 Stuckey
2007/0135276 A1 6/2007 Alessandri
2007/0135279 A1 6/2007 Purdy et al.
2007/0137331 A1 6/2007 Kachouh
2007/0141871 A1 6/2007 Scherer et al.

(56) References Cited

U.S. PATENT DOCUMENTS

2007/0142177 A1 6/2007 Simms et al.
2007/0142179 A1 6/2007 Terao et al.
2007/0142183 A1 6/2007 Chang
2007/0142187 A1 6/2007 Kolomeir
2007/0149363 A1 6/2007 Wang
2007/0151489 A1 7/2007 Byrne
2007/0155277 A1 7/2007 Amitai et al.
2007/0155495 A1 7/2007 Goo
2007/0155600 A1 7/2007 Cunningham et al.
2007/0161466 A1 7/2007 Oglesby et al.
2007/0161468 A1 7/2007 Yanagisawa et al.
2007/0161470 A1 7/2007 Berryman
2007/0161472 A1 7/2007 Drechsler
2007/0161480 A1 7/2007 Trancart
2007/0167292 A1 7/2007 Kuo
2007/0167299 A1 7/2007 Simonson et al.
2007/0167300 A1 7/2007 Krull
2007/0173384 A1 7/2007 Sechrest et al.
2007/0176035 A1 8/2007 Campbell
2007/0179023 A1 8/2007 Dyer
2007/0179030 A1 8/2007 Slawinski
2007/0184944 A1 8/2007 Huang
2007/0184953 A1 8/2007 Luberski et al.
2007/0190508 A1 8/2007 Dalton
2007/0191141 A1 8/2007 Weber
2007/0191190 A1 8/2007 Kuo
2007/0191197 A1 8/2007 Vittone
2007/0197274 A1 8/2007 Dugan
2007/0197345 A1 8/2007 Wallace et al.
2007/0197346 A1 8/2007 Seliber
2007/0197353 A1* 8/2007 Hundley ..... A63B 22/02
482/93
2007/0197920 A1 8/2007 Adams
2007/0201727 A1 8/2007 Birrell et al.
2007/0202992 A1 8/2007 Grasshoff
2007/0203001 A1 8/2007 Krull
2007/0204430 A1 9/2007 Chase
2007/0207902 A1 9/2007 Tiahrt
2007/0213185 A1 9/2007 Habing
2007/0214630 A1 9/2007 Kim
2007/0219062 A1 9/2007 Rodgers
2007/0219066 A1 9/2007 Wang
2007/0225119 A1 9/2007 Schenk
2007/0225120 A1 9/2007 Schenk
2007/0225126 A1 9/2007 Yoo
2007/0225127 A1 9/2007 Pan et al.
2007/0225136 A1 9/2007 Roman
2007/0225622 A1 9/2007 Huang et al.
2007/0232455 A1 10/2007 Hanoun
2007/0232461 A1 10/2007 Jenkins et al.
2007/0232462 A1 10/2007 Webber
2007/0232463 A1 10/2007 Wu
2007/0243975 A1 10/2007 Gearon
2007/0245612 A1 10/2007 Tresenfeld
2007/0247320 A1 10/2007 Morahan
2007/0249467 A1 10/2007 Hong et al.
2007/0254785 A1 11/2007 Lin
2007/0259759 A1 11/2007 Sumners et al.
2007/0259763 A1 11/2007 McKeown et al.
2007/0260184 A1 11/2007 Justis et al.
2007/0260255 A1 11/2007 Haddock et al.
2007/0270284 A1 11/2007 Lin
2007/0270294 A1 11/2007 Sheets
2007/0270667 A1 11/2007 Coppi et al.
2007/0270726 A1 11/2007 Chou
2007/0281828 A1 12/2007 Rice
2007/0281831 A1 12/2007 Wang
2007/0281836 A1 12/2007 Gearon
2007/0284495 A1 12/2007 Charles
2007/0287600 A1 12/2007 Prenatt
2007/0287601 A1 12/2007 Burck et al.
2007/0287606 A1 12/2007 MacMillan
2007/0287611 A1 12/2007 Januszek
2007/0293377 A1 12/2007 Webber
2007/0293378 A1 12/2007 Webber
2007/0296313 A1 12/2007 Wang
2007/0298935 A1 12/2007 Badarneh
2007/0298937 A1 12/2007 Shah
2007/0298941 A1 12/2007 Egger
2007/0298945 A1 12/2007 Mehta
2007/0298947 A1 12/2007 Eksteen
2008/0001772 A1 1/2008 Saito
2008/0001866 A1 1/2008 Martin
2008/0004162 A1 1/2008 Chen
2008/0015089 A1 1/2008 Hurwitz
2008/0015094 A1 1/2008 Casagrande
2008/0018211 A1 1/2008 Dye
2008/0020898 A1 1/2008 Pyles et al.
2008/0020902 A1 1/2008 Arnold
2008/0020907 A1 1/2008 Lin
2008/0020911 A1 1/2008 Castello Neto
2008/0020912 A1 1/2008 Dalebout
2008/0026658 A1 1/2008 Kriesel
2008/0026838 A1 1/2008 Dunstan et al.
2008/0032864 A1 2/2008 Hakki
2008/0032870 A1 2/2008 Wu
2008/0032871 A1 2/2008 Yeh
2008/0032873 A1 2/2008 Towley
2008/0039301 A1 2/2008 Halbridge
2008/0039302 A1 2/2008 Grant
2008/0046246 A1 2/2008 Hakki
2008/0051260 A1 2/2008 Simonson et al.
2008/0057889 A1 3/2008 Jan
2008/0058169 A1 3/2008 Fox
2008/0058170 A1 3/2008 Giannascoli et al.
2008/0058172 A1 3/2008 Tyree
2008/0058176 A1 3/2008 Webber et al.
2008/0058177 A1 3/2008 Webber
2008/0064576 A1 3/2008 Tyree
2008/0067302 A1 3/2008 Olivera
2008/0070755 A1 3/2008 Mckee
2008/0070756 A1 3/2008 Chu
2008/0070761 A1 3/2008 Lin
2008/0070765 A1 3/2008 Brown et al.
2008/0070766 A1 3/2008 Brown et al.
2008/0076637 A1 3/2008 Gilley et al.
2008/0076972 A1 3/2008 Dorogusker et al.
2008/0077619 A1 3/2008 Gilley et al.
2008/0085819 A1 4/2008 Yang et al.
2008/0085820 A1 4/2008 Majkrzak
2008/0085821 A1 4/2008 Webb
2008/0086318 A1 4/2008 Gilley et al.
2008/0090703 A1 4/2008 Rosenberg
2008/0096726 A1 4/2008 Riley et al.
2008/0096735 A1 4/2008 Grider
2008/0096745 A1 4/2008 Perry
2008/0103024 A1 5/2008 Habing
2008/0103034 A1 5/2008 Mihara et al.
2008/0108483 A1 5/2008 Fife
2008/0108917 A1 5/2008 Joutras et al.
2008/0119333 A1 5/2008 Bowser
2008/0132386 A1 6/2008 Helie
2008/0132389 A1 6/2008 Webber et al.
2008/0132391 A1 6/2008 Edeker
2008/0139370 A1 6/2008 Charnitski
2008/0146418 A1 6/2008 Summers
2008/0153670 A1 6/2008 Mckirdy
2008/0153676 A1 6/2008 Krietzman
2008/0153677 A1 6/2008 Webber et al.
2008/0153682 A1 6/2008 Chen et al.
2008/0155077 A1 6/2008 James
2008/0161168 A1 7/2008 Hsiao
2008/0161170 A1 7/2008 Lumpee
2008/0171640 A1 7/2008 Chang
2008/0171922 A1 7/2008 Teller
2008/0176717 A1 7/2008 Wang
2008/0176718 A1 7/2008 Wang
2008/0176722 A1 7/2008 Steffee
2008/0182724 A1 7/2008 Guthrie
2008/0182731 A1 7/2008 Vittone
2008/0182732 A1 7/2008 Webber et al.
2008/0187689 A1 8/2008 Dierkens et al.
2008/0188362 A1 8/2008 Chen
2008/0190745 A1 8/2008 Taniguchi et al.

(56) References Cited

U.S. PATENT DOCUMENTS

2008/0191864 A1 8/2008 Wolfson
2008/0200287 A1 8/2008 Marty et al.
2008/0200310 A1 8/2008 Tagliabue
2008/0200314 A1 8/2008 Dalebout et al.
2008/0200853 A1 8/2008 Tielve
2008/0204225 A1 8/2008 Kitchen
2008/0207407 A1 8/2008 Yeh
2008/0207415 A1 8/2008 Tsai
2008/0214358 A1 9/2008 Ogg et al.
2008/0214365 A1 9/2008 Webber et al.
2008/0214367 A1 9/2008 Webber et al.
2008/0214971 A1 9/2008 Talish
2008/0216717 A1 9/2008 Jones
2008/0220941 A1 9/2008 Shaw
2008/0227607 A1 9/2008 Nizam
2008/0229875 A1 9/2008 Ray
2008/0234110 A1 9/2008 Webber et al.
2008/0234111 A1 9/2008 Packham
2008/0242511 A1 10/2008 Munoz et al.
2008/0242512 A1 10/2008 Kim
2008/0242520 A1 10/2008 Hubbard
2008/0244870 A1 10/2008 Chase
2008/0245944 A1 10/2008 Chase
2008/0248926 A1 10/2008 Cole et al.
2008/0248929 A1 10/2008 Webber et al.
2008/0248935 A1 10/2008 Solow
2008/0250729 A1 10/2008 Kriesel
2008/0255794 A1 10/2008 Levine
2008/0261785 A1 10/2008 Albanese
2008/0269017 A1 10/2008 Ungari
2008/0279896 A1 11/2008 Heinen et al.
2008/0280731 A1 11/2008 Dalebout et al.
2008/0280732 A1 11/2008 Jones
2008/0280733 A1 11/2008 Dickie et al.
2008/0280734 A1 11/2008 Dickie et al.
2008/0280735 A1 11/2008 Dickie et al.
2008/0287262 A1 11/2008 Chou
2008/0287270 A1 11/2008 Carter
2008/0300110 A1 12/2008 Smith et al.
2008/0300114 A1 12/2008 Dalebout
2008/0300115 A1 12/2008 Erlandson
2008/0300116 A1 12/2008 Eder
2008/0300118 A1 12/2008 Wehrell
2008/0300914 A1 12/2008 Karkanias et al.
2008/0305936 A1 12/2008 Cao
2008/0312047 A1 12/2008 Feng
2008/0312052 A1 12/2008 Krietzman
2008/0318737 A1 12/2008 Chu
2008/0318738 A1 12/2008 Chen
2008/0318743 A1 12/2008 Bizzell
2008/0318744 A1 12/2008 Barra
2009/0005224 A1 1/2009 Davis et al.
2009/0018000 A1 1/2009 Brown
2009/0023553 A1 1/2009 Shim
2009/0023556 A1 1/2009 Daly
2009/0023562 A1 1/2009 Lamarque
2009/0027925 A1 1/2009 Kanouda et al.
2009/0029831 A1 1/2009 Weier
2009/0029834 A1 1/2009 Isom
2009/0036276 A1 2/2009 Loach
2009/0036277 A1 2/2009 Ish et al.
2009/0042696 A1 2/2009 Wang
2009/0042698 A1 2/2009 Wang
2009/0047645 A1 2/2009 Dibenedetto et al.
2009/0048044 A1 2/2009 Oleson et al.
2009/0048073 A1 2/2009 Roimicher
2009/0048074 A1 2/2009 Kamins
2009/0048079 A1 2/2009 Nalley
2009/0048493 A1 2/2009 James et al.
2009/0053682 A1 2/2009 Stern
2009/0054214 A1 2/2009 Kadar
2009/0054751 A1 2/2009 Babashan et al.
2009/0062072 A1 3/2009 Packham
2009/0069159 A1 3/2009 Wang
2009/0075781 A1 3/2009 Schwarzberg et al.
2009/0075784 A1 3/2009 Hoggan
2009/0075793 A1 3/2009 Trainor
2009/0080808 A1 3/2009 Hagen
2009/0082176 A1 3/2009 Watterson et al.
2009/0088301 A1 4/2009 Alling
2009/0093319 A1 4/2009 Omidi
2009/0093347 A1 4/2009 Wang
2009/0100718 A1 4/2009 Gerber
2009/0105047 A1 4/2009 Guidi et al.
2009/0105052 A1 4/2009 Dalebout et al.
2009/0105548 A1 4/2009 Bart
2009/0111658 A1 4/2009 Juan
2009/0111664 A1 4/2009 Kau
2009/0111665 A1 4/2009 Wang
2009/0111666 A1 4/2009 Wang
2009/0111670 A1 4/2009 Williams
2009/0118098 A1 5/2009 Yeh
2009/0118103 A1 5/2009 Ellis
2009/0118105 A1 5/2009 Schiff
2009/0119032 A1 5/2009 Meyer
2009/0120208 A1 5/2009 Meyer
2009/0120210 A1 5/2009 Phillips et al.
2009/0124463 A1 5/2009 Lin
2009/0124464 A1 5/2009 Kastelic
2009/0124465 A1 5/2009 Wang
2009/0124466 A1 5/2009 Zhang
2009/0124470 A1 5/2009 Yu
2009/0128516 A1 5/2009 Rimon et al.
2009/0131230 A1 5/2009 Cole
2009/0131231 A1 5/2009 Smith
2009/0137367 A1 5/2009 Hendrickson et al.
2009/0137370 A1 5/2009 Kushnir
2009/0143201 A1 6/2009 Uygan
2009/0144639 A1 6/2009 Nims et al.
2009/0149302 A1 6/2009 Thuma
2009/0156363 A1 6/2009 Guidi et al.
2009/0156364 A1 6/2009 Simeoni
2009/0158871 A1 6/2009 Chuo
2009/0163326 A1 6/2009 Wang
2009/0163327 A1 6/2009 Huang et al.
2009/0163331 A1 6/2009 Lacher
2009/0163334 A1 6/2009 Gibson et al.
2009/0170663 A1 7/2009 Cox et al.
2009/0170667 A1 7/2009 Irving et al.
2009/0170668 A1 7/2009 Giannelli et al.
2009/0170669 A1 7/2009 Giannelli et al.
2009/0170672 A1 7/2009 Mcmullen
2009/0170675 A1 7/2009 Giannelli et al.
2009/0176625 A1 7/2009 Giannelli et al.
2009/0176628 A1 7/2009 Radding et al.
2009/0180646 A1 7/2009 Vulfson et al.
2009/0181829 A1 7/2009 Wu
2009/0181830 A1 7/2009 Wu
2009/0181831 A1 7/2009 Kuo
2009/0181833 A1 7/2009 Cassidy
2009/0186748 A1 7/2009 Golesh et al.
2009/0186749 A1 7/2009 Zhou
2009/0193796 A1 8/2009 Wei et al.
2009/0196417 A1 8/2009 Beaver et al.
2009/0197739 A1 8/2009 Hashimoto
2009/0197740 A1 8/2009 Julskjaer et al.
2009/0197745 A1 8/2009 Olson
2009/0203501 A1 8/2009 Rodgers, Jr.
2009/0209393 A1 8/2009 Crater et al.
2009/0215594 A1 8/2009 Panaiotov
2009/0221405 A1 9/2009 Wang
2009/0221407 A1 9/2009 Hauk
2009/0227424 A1 9/2009 Hirata et al.
2009/0227428 A1 9/2009 Tamari
2009/0227432 A1 9/2009 Pacheco
2009/0232420 A1 9/2009 Eisenberg et al.
2009/0240858 A1 9/2009 Takebayashi
2009/0246746 A1 10/2009 Roerdink et al.
2009/0247376 A1 10/2009 Merrithew et al.
2009/0253554 A1 10/2009 Mcintosh
2009/0258710 A1 10/2009 Quatrochi et al.
2009/0258763 A1 10/2009 Richter
2009/0264258 A1 10/2009 Lo
2009/0264260 A1 10/2009 Piaget et al.

(56) References Cited

U.S. PATENT DOCUMENTS

2009/0269728 A1 10/2009 Verstegen et al.
2009/0270234 A1 10/2009 Alessandri et al.
2009/0280964 A1 11/2009 Lin
2009/0286653 A1 11/2009 Wiber
2009/0293319 A1 12/2009 Avni
2009/0305852 A1 12/2009 Svenberg
2009/0312158 A1 12/2009 Trevino et al.
2010/0003573 A1 1/2010 Jeanne et al.
2010/0004104 A1 1/2010 Gustafson
2010/0005624 A1 1/2010 Swearingen
2010/0009810 A1 1/2010 Trzecieski
2010/0015585 A1 1/2010 Baker
2010/0016127 A1 1/2010 Farnsworth
2010/0016129 A1 1/2010 Chou
2010/0019593 A1 1/2010 Ritchey
2010/0022354 A1 1/2010 Fisher
2010/0024590 A1 2/2010 O'neill
2010/0031803 A1 2/2010 Lozada et al.
2010/0032533 A1 2/2010 Chen
2010/0034665 A1 2/2010 Zhong et al.
2010/0035726 A1 2/2010 Fisher et al.
2010/0041516 A1 2/2010 Kodama
2010/0041526 A1 2/2010 Bowser
2010/0048358 A1 2/2010 Tchao et al.
2010/0048368 A1 2/2010 Donofrio
2010/0056345 A1 3/2010 Liu
2010/0062904 A1 3/2010 Crawford et al.
2010/0062914 A1 3/2010 Splane
2010/0063426 A1 3/2010 Planke
2010/0064255 A1 3/2010 Rottler et al.
2010/0069202 A1 3/2010 Olsen
2010/0075812 A1 3/2010 Piaget et al.
2010/0079291 A1 4/2010 Kroll et al.
2010/0081548 A1 4/2010 Labedz
2010/0087298 A1 4/2010 Zaccherini
2010/0093492 A1 4/2010 Watterson et al.
2010/0093493 A1 4/2010 Eldridge
2010/0099541 A1 4/2010 Patel
2010/0105527 A1 4/2010 Johnson
2010/0105530 A1 4/2010 Inaizumi
2010/0113223 A1 5/2010 Chiles et al.
2010/0125026 A1 5/2010 Zavadsky et al.
2010/0130337 A1 5/2010 Stewart
2010/0137105 A1 6/2010 McLaughlin
2010/0137114 A1 6/2010 Keiser
2010/0144500 A1 6/2010 Canali
2010/0144501 A1 6/2010 Berhanu
2010/0156625 A1 6/2010 Ruha
2010/0156760 A1 6/2010 Cheswick
2010/0164579 A1 7/2010 Acatrinei
2010/0167883 A1 7/2010 Grind
2010/0173276 A1 7/2010 Vasin
2010/0173755 A1 7/2010 Erez De Lazarraga
2010/0173759 A1 7/2010 Lalaoua
2010/0175634 A1 7/2010 Chang et al.
2010/0178981 A1 7/2010 Holcomb
2010/0179032 A1 7/2010 Perry
2010/0179035 A1 7/2010 Carnahan
2010/0184568 A1 7/2010 Schippers
2010/0184570 A1 7/2010 Cheng
2010/0190615 A1 7/2010 Baker et al.
2010/0192715 A1 8/2010 Aircelle
2010/0197462 A1 8/2010 Piane, Jr.
2010/0197465 A1 8/2010 Stevenson
2010/0210418 A1 8/2010 Park
2010/0216599 A1 8/2010 Watterson
2010/0216600 A1 8/2010 Noffsinger
2010/0216607 A1 8/2010 Mueller
2010/0216610 A1 8/2010 Gedeon-Janvier
2010/0222179 A1 9/2010 Temple et al.
2010/0222182 A1 9/2010 Park
2010/0227740 A1 9/2010 Liu
2010/0233664 A1 9/2010 Wroclawsky
2010/0234184 A1 9/2010 Le Page
2010/0234185 A1 9/2010 Watt et al.
2010/0234193 A1 9/2010 Friedman
2010/0235667 A1 9/2010 Mucignat et al.
2010/0240458 A1 9/2010 Gaiba et al.
2010/0240493 A1 9/2010 Wang
2010/0248899 A1 9/2010 Bedell et al.
2010/0248900 A1 9/2010 Ashby
2010/0248917 A1 9/2010 Reyes
2010/0255959 A1 10/2010 Dalebout et al.
2010/0255965 A1 10/2010 Chen
2010/0267524 A1 10/2010 Stewart et al.
2010/0279822 A1 11/2010 Ford
2010/0285933 A1 11/2010 Nalley
2010/0285935 A1 11/2010 Barnett
2010/0289466 A1 11/2010 Telefus
2010/0289772 A1 11/2010 Miller
2010/0292050 A1 11/2010 DiBenedetto et al.
2010/0292056 A1 11/2010 Birch
2010/0292600 A1 11/2010 Dibenedetto et al.
2010/0298104 A1 11/2010 Turner
2010/0298106 A1 11/2010 Bowser
2010/0302250 A1 12/2010 Hoebel
2010/0304931 A1 12/2010 Stumpf
2010/0304932 A1 12/2010 Kolman et al.
2010/0304934 A1 12/2010 Woodson
2010/0304938 A1 12/2010 Olson
2010/0304939 A1 12/2010 Svenberg
2010/0304940 A1 12/2010 Svenberg
2010/0311552 A1 12/2010 Sumners
2010/0317488 A1 12/2010 Cartaya
2010/0317496 A1 12/2010 Abranchess
2010/0320956 A1 12/2010 Lumsden et al.
2010/0323852 A1 12/2010 Locsin
2010/0327603 A1 12/2010 Suaan
2010/0331151 A1 12/2010 Signorile et al.
2010/0331153 A1 12/2010 Johnson
2011/0000024 A1 1/2011 Johnson et al.
2011/0003664 A1 1/2011 Richard
2011/0009249 A1 1/2011 Campanaro et al.
2011/0021319 A1 1/2011 Nissila et al.
2011/0021323 A1 1/2011 Wu
2011/0028282 A1 2/2011 Sbragia
2011/0028286 A1 2/2011 Nortje
2011/0034300 A1 2/2011 Hall
2011/0045956 A1 2/2011 Colledge
2011/0048141 A1 3/2011 Svenberg
2011/0054359 A1 3/2011 Sazonov
2011/0056328 A1 3/2011 Ko
2011/0061840 A1 3/2011 Goldmann
2011/0065371 A1 3/2011 Leff
2011/0065373 A1 3/2011 Goldmann
2011/0067361 A1 3/2011 Sloan
2011/0073743 A1 3/2011 Shamie
2011/0075835 A1 3/2011 Hill
2011/0077055 A1 3/2011 Pakula et al.
2011/0077128 A1 3/2011 Hamada
2011/0082006 A1 4/2011 Ishii
2011/0082011 A1 4/2011 Ellis
2011/0082013 A1 4/2011 Bastian
2011/0082015 A1 4/2011 Dreissigacker et al.
2011/0082017 A1 4/2011 Arlie
2011/0086707 A1 4/2011 Loveland
2011/0087137 A1 4/2011 Hanoun
2011/0087445 A1 4/2011 Sobolewski
2011/0087446 A1 4/2011 Redmond
2011/0093100 A1 4/2011 Ramsay
2011/0098157 A1 4/2011 Whalen et al.
2011/0098615 A1 4/2011 Whalen et al.
2011/0109283 A1 5/2011 Kapels et al.
2011/0111925 A1 5/2011 Hobson
2011/0112771 A1 5/2011 French
2011/0118089 A1 5/2011 Ellis
2011/0118090 A1 5/2011 Ellis
2011/0119027 A1 5/2011 Zhu et al.
2011/0124466 A1 5/2011 Nishimura
2011/0124476 A1 5/2011 Holley
2011/0131005 A1 6/2011 Ueshima et al.
2011/0136627 A1 6/2011 Williams
2011/0143769 A1 6/2011 Jones et al.
2011/0143890 A1 6/2011 Reyes

(56) References Cited

U.S. PATENT DOCUMENTS

| | | | |
|---|---|---|---|
| 2011/0143898 | A1 | 6/2011 | Trees |
| 2011/0152032 | A1 | 6/2011 | Barnett |
| 2011/0152037 | A1 | 6/2011 | Tsou |
| 2011/0152038 | A1 | 6/2011 | Freitag |
| 2011/0152039 | A1 | 6/2011 | Hendrickson et al. |
| 2011/0152635 | A1 | 6/2011 | Morris et al. |
| 2011/0163206 | A1 | 7/2011 | Bandera |
| 2011/0165995 | A1 | 7/2011 | Paulus |
| 2011/0165996 | A1 | 7/2011 | Paulus |
| 2011/0165997 | A1 | 7/2011 | Reich |
| 2011/0172058 | A1 | 7/2011 | Deaconu |
| 2011/0172060 | A1 | 7/2011 | Morales et al. |
| 2011/0172068 | A1 | 7/2011 | Tyson, III |
| 2011/0175744 | A1 | 7/2011 | Englert et al. |
| 2011/0177921 | A1 | 7/2011 | Olson |
| 2011/0181420 | A1 | 7/2011 | Mack et al. |
| 2011/0185309 | A1 | 7/2011 | Challinor et al. |
| 2011/0188269 | A1 | 8/2011 | Hosotani |
| 2011/0188980 | A1 | 8/2011 | Pumroy |
| 2011/0190096 | A1 | 8/2011 | Clarke |
| 2011/0195819 | A1 | 8/2011 | Shaw |
| 2011/0195825 | A1 | 8/2011 | Liester |
| 2011/0197157 | A1 | 8/2011 | Hoffman et al. |
| 2011/0199799 | A1 | 8/2011 | Hui et al. |
| 2011/0201481 | A1 | 8/2011 | Lo |
| 2011/0202236 | A1 | 8/2011 | Galasso et al. |
| 2011/0205164 | A1 | 8/2011 | Hansen et al. |
| 2011/0207584 | A1 | 8/2011 | Webber et al. |
| 2011/0221672 | A1 | 9/2011 | Osterhout |
| 2011/0224058 | A1 | 9/2011 | Webber et al. |
| 2011/0227268 | A1 | 9/2011 | Zheng |
| 2011/0237396 | A1 | 9/2011 | Lu |
| 2011/0237399 | A1 | 9/2011 | Toback |
| 2011/0237405 | A1 | 9/2011 | Reyes |
| 2011/0237407 | A1 | 9/2011 | Kaleal |
| 2011/0240403 | A1 | 10/2011 | Meillet |
| 2011/0247530 | A1 | 10/2011 | Coffman |
| 2011/0251021 | A1 | 10/2011 | Zavadsky et al. |
| 2011/0251023 | A1 | 10/2011 | Fedriga |
| 2011/0251033 | A1 | 10/2011 | Blancher |
| 2011/0252597 | A1 | 10/2011 | Burris et al. |
| 2011/0256988 | A1 | 10/2011 | Weier |
| 2011/0257797 | A1 | 10/2011 | Burris et al. |
| 2011/0263384 | A1 | 10/2011 | Drazan |
| 2011/0269604 | A1 | 11/2011 | Tseng |
| 2011/0275482 | A1 | 11/2011 | Brodess et al. |
| 2011/0275489 | A1 | 11/2011 | Apau |
| 2011/0275496 | A1 | 11/2011 | Chou |
| 2011/0275499 | A1 | 11/2011 | Eschenbach |
| 2011/0281249 | A1 | 11/2011 | Gammell et al. |
| 2011/0281691 | A1 | 11/2011 | Ellis |
| 2011/0283188 | A1 | 11/2011 | Farrenkopf et al. |
| 2011/0283231 | A1 | 11/2011 | Richstein et al. |
| 2011/0287905 | A1 | 11/2011 | Reyes |
| 2011/0306480 | A1 | 12/2011 | Beaulieu et al. |
| 2011/0308919 | A1 | 12/2011 | Hahn |
| 2011/0312473 | A1 | 12/2011 | Chu et al. |
| 2011/0312475 | A1 | 12/2011 | Towley, III |
| 2011/0319229 | A1 | 12/2011 | Corbalis et al. |
| 2011/0319230 | A1 | 12/2011 | Brendle |
| 2012/0004074 | A1 | 1/2012 | Schelzig |
| 2012/0004075 | A1 | 1/2012 | Kissel et al. |
| 2012/0004080 | A1 | 1/2012 | Webb |
| 2012/0010053 | A1 | 1/2012 | Bayerlein et al. |
| 2012/0015778 | A1 | 1/2012 | Lee et al. |
| 2012/0015779 | A1 | 1/2012 | Powch et al. |
| 2012/0015784 | A1 | 1/2012 | Reed |
| 2012/0015787 | A2 | 1/2012 | Crawley |
| 2012/0020135 | A1 | 1/2012 | McCune |
| 2012/0021873 | A1 | 1/2012 | Brunner |
| 2012/0021875 | A1 | 1/2012 | Karl |
| 2012/0021876 | A1 | 1/2012 | Hsiung |
| 2012/0021877 | A1 | 1/2012 | Lundquist et al. |
| 2012/0029666 | A1 | 2/2012 | Crowley et al. |
| 2012/0032896 | A1 | 2/2012 | Vesely |
| 2012/0035024 | A1 | 2/2012 | Price |
| 2012/0046144 | A1 | 2/2012 | Lin et al. |
| 2012/0053024 | A1 | 3/2012 | Mendoza |
| 2012/0071301 | A1 | 3/2012 | Kaylor et al. |
| 2012/0083395 | A1 | 4/2012 | Carson |
| 2012/0083396 | A1 | 4/2012 | Aquino |
| 2012/0088633 | A1 | 4/2012 | Crafton |
| 2012/0088634 | A1 | 4/2012 | Heidecke |
| 2012/0088638 | A1 | 4/2012 | Lull |
| 2012/0088640 | A1 | 4/2012 | Wissink |
| 2012/0094809 | A1 | 4/2012 | Nishimura |
| 2012/0115682 | A1 | 5/2012 | Homsi |
| 2012/0115689 | A1 | 5/2012 | Dalebout et al. |
| 2012/0115691 | A1 | 5/2012 | Munroe |
| 2012/0115695 | A1 | 5/2012 | Watterson et al. |
| 2012/0116684 | A1 | 5/2012 | Ingrassia et al. |
| 2012/0129653 | A1 | 5/2012 | Shalev |
| 2012/0132877 | A1 | 5/2012 | Wang |
| 2012/0133192 | A1 | 5/2012 | Simpson |
| 2012/0142503 | A1 | 6/2012 | Sevadjian |
| 2012/0158238 | A1 | 6/2012 | Daley |
| 2012/0165162 | A1 | 6/2012 | Lu |
| 2012/0169603 | A1 | 7/2012 | Peterson et al. |
| 2012/0174833 | A1 | 7/2012 | Early |
| 2012/0178590 | A1 | 7/2012 | Lu |
| 2012/0178591 | A1 | 7/2012 | Remelius |
| 2012/0178596 | A1 | 7/2012 | Vittone |
| 2012/0183939 | A1 | 7/2012 | Aragones et al. |
| 2012/0183940 | A1 | 7/2012 | Aragones et al. |
| 2012/0187012 | A1 | 7/2012 | TeVault et al. |
| 2012/0190502 | A1 | 7/2012 | Paulus et al. |
| 2012/0212505 | A1 | 8/2012 | Burroughs et al. |
| 2012/0216524 | A1 | 8/2012 | Browne |
| 2012/0218184 | A1 | 8/2012 | Wissmar |
| 2012/0220434 | A1 | 8/2012 | Lien |
| 2012/0225758 | A1 | 9/2012 | Shaw |
| 2012/0230504 | A1 | 9/2012 | Kuroda |
| 2012/0238411 | A1 | 9/2012 | McBride et al. |
| 2012/0238418 | A1 | 9/2012 | Reyes |
| 2012/0242774 | A1 | 9/2012 | Numano et al. |
| 2012/0248263 | A1 | 10/2012 | Grotenhuis |
| 2012/0252580 | A1 | 10/2012 | Dugan |
| 2012/0252642 | A1 | 10/2012 | Chen |
| 2012/0253234 | A1 | 10/2012 | Yang et al. |
| 2012/0253485 | A1 | 10/2012 | Weast et al. |
| 2012/0253489 | A1 | 10/2012 | Dugan |
| 2012/0263892 | A1 | 10/2012 | Rodgers |
| 2012/0264575 | A1 | 10/2012 | Towley, III |
| 2012/0270705 | A1 | 10/2012 | Lo |
| 2012/0271143 | A1 | 10/2012 | Aragones et al. |
| 2012/0277040 | A1 | 11/2012 | Vincent et al. |
| 2012/0277068 | A1 | 11/2012 | Zhou et al. |
| 2012/0277070 | A1 | 11/2012 | Sienna |
| 2012/0277891 | A1 | 11/2012 | Aragones et al. |
| 2012/0283071 | A1 | 11/2012 | Nalley |
| 2012/0283074 | A1 | 11/2012 | Hutchins |
| 2012/0289386 | A1 | 11/2012 | Yu |
| 2012/0293141 | A1 | 11/2012 | Zhang et al. |
| 2012/0295774 | A1 | 11/2012 | Dalebout et al. |
| 2012/0296455 | A1 | 11/2012 | Ohnemus et al. |
| 2012/0298017 | A1 | 11/2012 | Chen |
| 2012/0300515 | A1 | 11/2012 | Carletti et al. |
| 2012/0302408 | A1 | 11/2012 | Burger |
| 2012/0319604 | A1 | 12/2012 | Walters |
| 2012/0322625 | A1 | 12/2012 | Park |
| 2012/0322629 | A1 | 12/2012 | Webb |
| 2012/0326873 | A1 | 12/2012 | Utter |
| 2012/0329615 | A1 | 12/2012 | Jeong |
| 2013/0002533 | A1 | 1/2013 | Burroughs et al. |
| 2013/0004010 | A1 | 1/2013 | Royer |
| 2013/0009993 | A1 | 1/2013 | Horseman |
| 2013/0017929 | A1 | 1/2013 | Hendrickson et al. |
| 2013/0023933 | A1 | 1/2013 | Haas |
| 2013/0034671 | A1 | 2/2013 | George |
| 2013/0035219 | A1 | 2/2013 | Williams |
| 2013/0035220 | A1 | 2/2013 | Adams |
| 2013/0035612 | A1 | 2/2013 | Mason et al. |
| 2013/0040783 | A1 | 2/2013 | Duda et al. |
| 2013/0041590 | A1 | 2/2013 | Burich et al. |

(56) References Cited

U.S. PATENT DOCUMENTS

| | | | |
|---|---|---|---|
| 2013/0041617 | A1 | 2/2013 | Pease et al. |
| 2013/0044521 | A1 | 2/2013 | Zhao et al. |
| 2013/0050973 | A1 | 2/2013 | Rohrbach |
| 2013/0053220 | A1 | 2/2013 | Monaco |
| 2013/0053222 | A1 | 2/2013 | Lo |
| 2013/0053990 | A1 | 2/2013 | Ackland |
| 2013/0090212 | A1 | 4/2013 | Wang |
| 2013/0092647 | A1 | 4/2013 | Chen |
| 2013/0095959 | A1 | 4/2013 | Marty |
| 2013/0095978 | A1 | 4/2013 | Sauter |
| 2013/0102443 | A1 | 4/2013 | Lundquist et al. |
| 2013/0110264 | A1 | 5/2013 | Weast et al. |
| 2013/0116093 | A1 | 5/2013 | Kehoe |
| 2013/0116095 | A1 | 5/2013 | Hsieh |
| 2013/0116605 | A1 | 5/2013 | Dephouse |
| 2013/0123073 | A1 | 5/2013 | Olson et al. |
| 2013/0123083 | A1 | 5/2013 | Sip |
| 2013/0130868 | A1 | 5/2013 | Hou |
| 2013/0130869 | A1 | 5/2013 | Hou |
| 2013/0139736 | A1 | 6/2013 | Flaherty |
| 2013/0141235 | A1 | 6/2013 | Utter, II |
| 2013/0143721 | A1 | 6/2013 | Dalebout |
| 2013/0147411 | A1 | 6/2013 | Pang et al. |
| 2013/0150214 | A1 | 6/2013 | Wu |
| 2013/0154441 | A1 | 6/2013 | Redmond |
| 2013/0165297 | A1 | 6/2013 | Daly |
| 2013/0172152 | A1 | 7/2013 | Watterson |
| 2013/0178338 | A1 | 7/2013 | Ross |
| 2013/0178346 | A1 | 7/2013 | Lin |
| 2013/0182781 | A1 | 7/2013 | Matsutani |
| 2013/0185003 | A1 | 7/2013 | Carbeck et al. |
| 2013/0190136 | A1 | 7/2013 | Watterson |
| 2013/0190143 | A1 | 7/2013 | Greenhill et al. |
| 2013/0190657 | A1 | 7/2013 | Flaction et al. |
| 2013/0193655 | A1 | 8/2013 | Kaye et al. |
| 2013/0196821 | A1 | 8/2013 | Watterson et al. |
| 2013/0196826 | A1 | 8/2013 | Colledge |
| 2013/0196827 | A1 | 8/2013 | Chang |
| 2013/0203561 | A1 | 8/2013 | Lee et al. |
| 2013/0211858 | A1 | 8/2013 | Ohnemus et al. |
| 2013/0225373 | A1 | 8/2013 | Poat |
| 2013/0225377 | A1 | 8/2013 | Lee et al. |
| 2013/0228063 | A1 | 9/2013 | Turner |
| 2013/0228422 | A1 | 9/2013 | Mathieu |
| 2013/0231219 | A1 | 9/2013 | Huang |
| 2013/0231224 | A1 | 9/2013 | Svenberg |
| 2013/0231226 | A1 | 9/2013 | Bonutti |
| 2013/0237383 | A1 | 9/2013 | Chen |
| 2013/0245966 | A1 | 9/2013 | Burroughs et al. |
| 2013/0263418 | A1 | 10/2013 | Johnson |
| 2013/0267386 | A1 | 10/2013 | Her |
| 2013/0267392 | A1 | 10/2013 | Miranda |
| 2013/0274040 | A1 | 10/2013 | Coza et al. |
| 2013/0274064 | A1 | 10/2013 | Liang |
| 2013/0274067 | A1 | 10/2013 | Watterson et al. |
| 2013/0274069 | A1 | 10/2013 | Watterson et al. |
| 2013/0274071 | A1 | 10/2013 | Wang |
| 2013/0274074 | A1 | 10/2013 | Ghandour |
| 2013/0274075 | A1 | 10/2013 | Habing et al. |
| 2013/0280682 | A1 | 10/2013 | Levine et al. |
| 2013/0296144 | A1 | 11/2013 | Gvoich |
| 2013/0310230 | A1 | 11/2013 | Norris |
| 2013/0324368 | A1 | 12/2013 | Aragones et al. |
| 2013/0325394 | A1 | 12/2013 | Yuen et al. |
| 2013/0337974 | A1 | 12/2013 | Yanev et al. |
| 2013/0337980 | A1 | 12/2013 | Himmelrick et al. |
| 2013/0337981 | A1 | 12/2013 | Habing |
| 2013/0338802 | A1 | 12/2013 | Winsper et al. |
| 2013/0346043 | A1 | 12/2013 | Mewes et al. |
| 2014/0005009 | A1 | 1/2014 | Giannelli |
| 2014/0005811 | A1 | 1/2014 | Mikan et al. |
| 2014/0011645 | A1 | 1/2014 | Johnson et al. |
| 2014/0026788 | A1 | 1/2014 | Kallio, III et al. |
| 2014/0031181 | A1 | 1/2014 | Agostini |
| 2014/0031703 | A1 | 1/2014 | Rayner et al. |
| 2014/0039840 | A1 | 2/2014 | Yuen et al. |
| 2014/0052280 | A1 | 2/2014 | Yuen et al. |
| 2014/0056461 | A1 | 2/2014 | Afshar |
| 2014/0073488 | A1 | 3/2014 | Wu |
| 2014/0077494 | A1 | 3/2014 | Sutkowski |
| 2014/0080678 | A1 | 3/2014 | Wu |
| 2014/0085077 | A1 | 3/2014 | Luna et al. |
| 2014/0100464 | A1 | 4/2014 | Kaleal et al. |
| 2014/0102340 | A1 | 4/2014 | Kooistra |
| 2014/0106943 | A1 | 4/2014 | Simonetti |
| 2014/0106948 | A1 | 4/2014 | Agostini |
| 2014/0106949 | A1 | 4/2014 | Mestemaker |
| 2014/0113776 | A1 | 4/2014 | Jaguan |
| 2014/0113779 | A1 | 4/2014 | Loach |
| 2014/0121066 | A1 | 5/2014 | Huang et al. |
| 2014/0121071 | A1 | 5/2014 | Strom et al. |
| 2014/0121072 | A1 | 5/2014 | Ercanbrack |
| 2014/0135593 | A1 | 5/2014 | Jayalth et al. |
| 2014/0139450 | A1 | 5/2014 | Levesque et al. |
| 2014/0156228 | A1 | 6/2014 | Molettiere et al. |
| 2014/0162854 | A1 | 6/2014 | Watterson |
| 2014/0162856 | A1 | 6/2014 | Kramer |
| 2014/0171266 | A1 | 6/2014 | Hawkins, III et al. |
| 2014/0187383 | A1 | 7/2014 | Martin |
| 2014/0195103 | A1 | 7/2014 | Nassef |
| 2014/0200122 | A1 | 7/2014 | Hallmark |
| 2014/0221160 | A1 | 8/2014 | Hardy et al. |
| 2014/0221175 | A1 | 8/2014 | Liu |
| 2014/0221881 | A1 | 8/2014 | Schlauder et al. |
| 2014/0222173 | A1 | 8/2014 | Giedwoyn et al. |
| 2014/0228175 | A1 | 8/2014 | Lemos et al. |
| 2014/0228181 | A1 | 8/2014 | Powell |
| 2014/0235937 | A1 | 8/2014 | Plath |
| 2014/0265690 | A1 | 9/2014 | Henderson |
| 2014/0270375 | A1 | 9/2014 | Canavan et al. |
| 2014/0274564 | A1 | 9/2014 | Greenbaum |
| 2014/0274579 | A1 | 9/2014 | Olson |
| 2014/0274596 | A1 | 9/2014 | Krull |
| 2014/0274600 | A1 | 9/2014 | Dalebout et al. |
| 2014/0287886 | A1 | 9/2014 | Patti |
| 2014/0309087 | A1 | 10/2014 | Uygan |
| 2014/0309092 | A1 | 10/2014 | De Michele |
| 2014/0338120 | A1 | 11/2014 | Baugh et al. |
| 2014/0358473 | A1 | 12/2014 | Goel et al. |
| 2014/0360413 | A1 | 12/2014 | Schenk |
| 2015/0001048 | A1 | 1/2015 | Koppes et al. |
| 2015/0003621 | A1 | 1/2015 | Trammell |
| 2015/0004579 | A1 | 1/2015 | Shelton |
| 2015/0016623 | A1 | 1/2015 | Trammell |
| 2015/0038300 | A1 | 2/2015 | Forhan et al. |
| 2015/0044648 | A1 | 2/2015 | White et al. |
| 2015/0048807 | A1 | 2/2015 | Fan et al. |
| 2015/0051051 | A1 | 2/2015 | Liu et al. |
| 2015/0059257 | A1 | 3/2015 | Beaver |
| 2015/0065301 | A1 | 3/2015 | Oteman |
| 2015/0069738 | A1 | 3/2015 | Knight |
| 2015/0072842 | A1 | 3/2015 | Segal |
| 2015/0105220 | A1 | 4/2015 | Hong |
| 2015/0111708 | A1 | 4/2015 | Smith |
| 2015/0126348 | A1 | 5/2015 | Kaye et al. |
| 2015/0148204 | A1 | 5/2015 | Sleppy |
| 2015/0165259 | A1 | 6/2015 | Huppee et al. |
| 2015/0165270 | A1 | 6/2015 | Allos |
| 2015/0181314 | A1 | 6/2015 | Swanson |
| 2015/0182782 | A1 | 7/2015 | Cutler |
| 2015/0192929 | A1 | 7/2015 | Rihn et al. |
| 2015/0199494 | A1 | 7/2015 | Koduri et al. |
| 2015/0201722 | A1 | 7/2015 | Brouard |
| 2015/0202487 | A1 | 7/2015 | Wu |
| 2015/0209610 | A1 | 7/2015 | Dalebout et al. |
| 2015/0209617 | A1 | 7/2015 | Hsiao |
| 2015/0238801 | A1 | 8/2015 | Meredith |
| 2015/0246751 | A1 | 9/2015 | Spivack et al. |
| 2015/0250304 | A1 | 9/2015 | Dalebout |
| 2015/0251048 | A1 | 9/2015 | Dalebout |
| 2015/0251055 | A1 | 9/2015 | Ashby |
| 2015/0253210 | A1 | 9/2015 | Ashby et al. |
| 2015/0265903 | A1 | 9/2015 | Kolen et al. |
| 2015/0273267 | A1 | 10/2015 | Manzke |

(56) References Cited

U.S. PATENT DOCUMENTS

| | | | |
|---|---|---|---|
| 2015/0283420 | A1 | 10/2015 | Chang |
| 2015/0283421 | A1 | 10/2015 | Gaylord |
| 2015/0295397 | A1 | 10/2015 | Lin et al. |
| 2015/0297932 | A1 | 10/2015 | Wehrell |
| 2015/0297936 | A1 | 10/2015 | Madden |
| 2015/0314184 | A1 | 11/2015 | Moya Saez |
| 2015/0335941 | A1 | 11/2015 | Lo |
| 2015/0346994 | A1 | 12/2015 | Chanyontpatanakul |
| 2015/0352396 | A1 | 12/2015 | Dalebout |
| 2015/0352401 | A1 | 12/2015 | Johnson |
| 2015/0352402 | A1 | 12/2015 | Arnold et al. |
| 2015/0360073 | A1 | 12/2015 | Moran et al. |
| 2015/0367158 | A1 | 12/2015 | Pretz et al. |
| 2015/0367176 | A1 | 12/2015 | Bejestan et al. |
| 2015/0369326 | A1 | 12/2015 | Modrezejewski et al. |
| 2015/0375028 | A1 | 12/2015 | Oteman et al. |
| 2016/0001123 | A1 | 1/2016 | Parrish, Jr. |
| 2016/0008650 | A1 | 1/2016 | Jue et al. |
| 2016/0016035 | A1 | 1/2016 | Hao |
| 2016/0023043 | A1 | 1/2016 | Grundy |
| 2016/0027325 | A1 | 1/2016 | Malhotra |
| 2016/0038785 | A1 | 2/2016 | Netter |
| 2016/0047446 | A1 | 2/2016 | Hung |
| 2016/0051857 | A1 | 2/2016 | Rasner |
| 2016/0061300 | A1 | 3/2016 | Aoto et al. |
| 2016/0066818 | A1 | 3/2016 | Cowley et al. |
| 2016/0074691 | A1 | 3/2016 | Pearce et al. |
| 2016/0074701 | A1 | 3/2016 | Wiener |
| 2016/0074705 | A1 | 3/2016 | Wiener |
| 2016/0089559 | A1 | 3/2016 | Smith et al. |
| 2016/0089560 | A1 | 3/2016 | Smith et al. |
| 2016/0089575 | A1 | 3/2016 | Smith et al. |
| 2016/0096064 | A1 | 4/2016 | Gatti |
| 2016/0101311 | A1 | 4/2016 | Workman |
| 2016/0107019 | A1 | 4/2016 | Shah |
| 2016/0114205 | A1 | 4/2016 | Giunchi |
| 2016/0114211 | A1 | 4/2016 | Schmidt |
| 2016/0121156 | A1 | 5/2016 | Bach |
| 2016/0166872 | A1 | 6/2016 | Cervone et al. |
| 2016/0175643 | A1 | 6/2016 | Kueker et al. |
| 2016/0184625 | A1 | 6/2016 | Chang |
| 2016/0199683 | A1 | 7/2016 | Shamlin |
| 2016/0206248 | A1 | 7/2016 | Sartor et al. |
| 2016/0211841 | A1 | 7/2016 | Harrison |
| 2016/0219968 | A1 | 8/2016 | Martin |
| 2016/0250514 | A1 | 9/2016 | Gvoich |
| 2016/0256728 | A1 | 9/2016 | Tang |
| 2016/0263426 | A1 | 9/2016 | Mueller et al. |
| 2016/0278487 | A1 | 9/2016 | Postolek |
| 2016/0287930 | A1 | 10/2016 | Moser |
| 2016/0303414 | A1 | 10/2016 | Werner |
| 2016/0303421 | A1 | 10/2016 | Tyger et al. |
| 2016/0317861 | A1 | 11/2016 | Dalebout |
| 2016/0319850 | A1 | 11/2016 | Kamen et al. |
| 2016/0321075 | A1 | 11/2016 | Catherwood et al. |
| 2016/0346586 | A1 | 12/2016 | Pullins et al. |
| 2016/0346598 | A1 | 12/2016 | Manzke et al. |
| 2016/0346617 | A1 | 12/2016 | Srugo |
| 2016/0367851 | A1 | 12/2016 | Astilean et al. |
| 2017/0014661 | A1 | 1/2017 | Lin |
| 2017/0021218 | A1 | 1/2017 | Peritz |
| 2017/0050069 | A1 | 2/2017 | Ky |
| 2017/0050074 | A1 | 2/2017 | Olson |
| 2017/0056711 | A1 | 3/2017 | Dalebout et al. |
| 2017/0056712 | A1 | 3/2017 | Johnson |
| 2017/0056715 | A1 | 3/2017 | Dalebout et al. |
| 2017/0056716 | A1 | 3/2017 | Cutler |
| 2017/0056726 | A1 | 3/2017 | Dalebout et al. |
| 2017/0065852 | A1 | 3/2017 | Cygan et al. |
| 2017/0068782 | A1 | 3/2017 | Pillai et al. |
| 2017/0106227 | A1 | 4/2017 | Lalaoua |
| 2017/0106240 | A1 | 4/2017 | Chuang |
| 2017/0113093 | A1 | 4/2017 | Bellavista et al. |
| 2017/0120102 | A1 | 5/2017 | Chen |
| 2017/0128784 | A1 | 5/2017 | Molins et al. |
| 2017/0136280 | A1 | 5/2017 | Lee |
| 2017/0136288 | A1 | 5/2017 | Huang |
| 2017/0136289 | A1 | 5/2017 | Frank |
| 2017/0136291 | A1 | 5/2017 | Huang |
| 2017/0136339 | A1 | 5/2017 | Habiche |
| 2017/0165523 | A1 | 6/2017 | Chou |
| 2017/0165552 | A1 | 6/2017 | Martin |
| 2017/0173394 | A1 | 6/2017 | Rider |
| 2017/0189745 | A1 | 7/2017 | Hamilton et al. |
| 2017/0197103 | A1 | 7/2017 | Rau et al. |
| 2017/0197106 | A1 | 7/2017 | Dalebout et al. |
| 2017/0216660 | A1 | 8/2017 | Lernihan |
| 2017/0239509 | A1 | 8/2017 | Wang |
| 2017/0252599 | A1 | 9/2017 | Wang |
| 2017/0266481 | A1 | 9/2017 | Dalebout |
| 2017/0266483 | A1 | 9/2017 | Dalebout |
| 2017/0266503 | A1 | 9/2017 | Watterson et al. |
| 2017/0266532 | A1 | 9/2017 | Watterson |
| 2017/0266533 | A1 | 9/2017 | Dalebout |
| 2017/0266534 | A1 | 9/2017 | Watterson |
| 2017/0266535 | A1 | 9/2017 | Watterson |
| 2017/0274237 | A1 | 9/2017 | Chang |
| 2017/0274242 | A1 | 9/2017 | Corbalis |
| 2017/0312580 | A1 | 11/2017 | Chang |
| 2017/0319906 | A1 | 11/2017 | Chang et al. |
| 2017/0340917 | A1 | 11/2017 | Chang |
| 2017/0361145 | A1 | 12/2017 | Olson et al. |
| 2017/0367480 | A1 | 12/2017 | Dickerson et al. |
| 2017/0368442 | A1 | 12/2017 | Baudhuin |
| 2018/0001135 | A1 | 1/2018 | Powell |
| 2018/0036572 | A1 | 2/2018 | Hsu |
| 2018/0036585 | A1 | 2/2018 | Powell |
| 2018/0056111 | A1 | 3/2018 | Chiang |
| 2018/0085622 | A1 | 3/2018 | Ivan |
| 2018/0092603 | A1 | 4/2018 | Duan et al. |
| 2018/0099179 | A1 | 4/2018 | Chatterton et al. |
| 2018/0099180 | A1 | 4/2018 | Wilkinson |
| 2018/0099181 | A1 | 4/2018 | Powell et al. |
| 2018/0104533 | A1 | 4/2018 | Powell et al. |
| 2018/0111018 | A1 | 4/2018 | Lee |
| 2018/0117385 | A1 | 5/2018 | Watterson et al. |
| 2018/0117388 | A1 | 5/2018 | Porter |
| 2018/0117419 | A1 | 5/2018 | Jackson |
| 2018/0140886 | A1 | 5/2018 | Hetrick et al. |
| 2018/0147440 | A1 | 5/2018 | Lin |

FOREIGN PATENT DOCUMENTS

| | | |
|---|---|---|
| WO | 20000030717 | 6/2000 |
| WO | 200914330 | 1/2009 |
| WO | 2009014330 | 1/2009 |
| WO | 2011094649 | 8/2011 |

OTHER PUBLICATIONS

International Search Report and Written Opinion issued for PCT/US2016/048692 dated Dec. 1, 2016.

International Search Report and Written Opinion issued for PCT/US2017/022989 dated May 23, 2017.

U.S. Appl. No. 15/245,953, dated Jul. 26, 2018, Non-final Rejection.

U.S. Appl. No. 15/245,473, dated Sep. 22, 2017, Non-final Rejection.

U.S. Appl. No. 15/245,473, dated May 11, 2018, Non-final Rejection.

U.S. Appl. No. 15/245,953, dated Jan. 3, 2018, Non-final Rejection.

U.S. Appl. No. 15/245,453, dated Aug. 31, 2018, Non-final Rejection.

* cited by examiner

WEIGHT PLATFORM TREADMILL

CROSS-REFERENCE TO RELATED APPLICATIONS

This application claims priority to U.S. Provisional Patent Application No. 62/336,567, filed on May 13, 2016, which application is incorporated herein by reference in its entirety.

BACKGROUND

Aerobic exercise is a popular form of exercise that improves one's cardiovascular health by reducing blood pressure and providing other benefits to the human body. Aerobic exercise generally involves low intensity physical exertion over a long duration of time. Typically, the human body can adequately supply enough oxygen to meet the body's demands at the intensity levels involved with aerobic exercise. Popular forms of aerobic exercise include running, jogging, swimming, and cycling among others activities. In contrast, anaerobic exercise typically involves high intensity exercises over a short duration of time. Popular forms of anaerobic exercise include strength training and short distance running.

Many choose to perform aerobic exercises indoors, such as in a gym or their home. Often, a user uses an aerobic exercise machine to perform an aerobic workout indoors. One type of aerobic exercise machine is a treadmill, which is a machine that has a running deck attached to a support frame. The running deck can support the weight of a person using the machine. The running deck incorporates a tread belt that is driven by a motor. A user can run or walk in place on the tread belt by running or walking at the tread belt's speed. The speed and other operations of the treadmill are generally controlled through a control module that is also attached to the support frame and within a convenient reach of the user. The control module can include a display, buttons for increasing or decreasing a speed of the conveyor belt, controls for adjusting a tilt angle of the running deck, or other controls. Other popular exercise machines that allow a user to perform aerobic exercises indoors include elliptical machines, rowing machines, stepper machines, and stationary bikes to name a few.

One type of treadmill is disclosed in U.S. Pat. No. 4,729,558 issued to Hai P. Kuo. In this reference, an improved running exerciser comprises a base frame having a first shaft and second shaft, a pair of inverted U-shaped members each mounted at one side of the base frame, a track in the form of endless loop around the first shaft and the second shaft, a pulley fastened on one end of the first shaft, a motor assembly having a tubular rod enclosing the first shaft, a pair of conical clutch discs put over a driving shaft of the motor assembly, a belt connecting the pulley to the clutch discs, a speed control mechanism mounted on one of the inverted U-shaped members for regulating speed of the track, and a stand for lifting a front end of the base frame to incline the endless loop to form a slope.

SUMMARY

In one embodiment, a treadmill includes a deck, a first pulley disposed in a first portion of the deck, a second pulley disposed in a second portion of the deck, a tread belt surrounding the first pulley and the second pulley, a scale mechanism incorporated into the deck, and a repetition counter incorporated into the treadmill.

The treadmill may include a motor in mechanical communication with at least one of the first pulley and the second pulley, a cover superjacent the motor, wherein the scale mechanism is incorporated into the cover over the motor.

The repetition counter may include a piezoelectric material.

The piezoelectric material may be incorporated into the cover.

The treadmill may include a free weight rack connected to the deck.

The treadmill may include a processor and memory and a display in communication with the processor where the processor is in communication with the scale mechanism and the repetition counter. The memory may include programmed instructions that, when executed, cause the processor to display a weight of a user.

The programmed instructions, when executed, may cause the processor to determine whether the user is holding a weight.

Determining whether the user is holding the weight may include measuring an increase with the scale mechanism.

The programmed instructions, when executed, may cause the processor to determine whether the user is executing an anaerobic exercise with a weight.

The programmed instructions, when executed, may cause the processor to count anaerobic exercise repetitions performed by the user with the repetition counter.

The programmed instructions, when executed, may cause the display to present a count of the anaerobic exercise repetitions.

The programmed instructions, when executed, may cause the processor to instruct the user to select a weight.

The programmed instructions, when executed, may cause the processor to instruct the user to perform an exercise with the weight.

The programmed instructions, when executed, may cause the processor to instruct the user to perform a pre-determined repetition count with the weight.

The programmed instructions, when executed, may cause the processor to verify that user selected weight by measuring the increase with the scale mechanism.

The programmed instructions, when executed, may cause the processor to verify that user performed the pre-determined repetitions with the repetition counter.

In one embodiment, a treadmill includes a deck, a first pulley disposed in a first portion of the deck, a second pulley disposed in a second portion of the deck, a tread belt surrounding the first pulley and the second pulley, a motor in mechanical communication with at least one of the first pulley and the second pulley, a cover superjacent the motor, a scale mechanism incorporated into the cover over the motor, a repetition counter having a piezoelectric material that is incorporated into the cover, and a free weight rack connected to the deck.

The treadmill may further include a processor and memory, a display in communication with the processor where the processor is also in communication with the scale mechanism and the repetition counter, and where the memory includes programmed instructions that, when executed, cause the processor to display a weight of a user.

The programmed instructions, when executed, may cause the processor to instruct the user to select a weight and verify that user selected the weight by measuring the increase with the scale mechanism.

In one embodiment, a treadmill includes a deck, a first pulley disposed in a first portion of the deck, a second pulley disposed in a second portion of the deck, a tread belt surrounding the first pulley and the second pulley, a motor in mechanical communication with at least one of the first pulley and the second pulley, a cover superjacent the motor, a scale mechanism incorporated into the cover over the motor, a repetition counter having a piezoelectric material that is incorporated into the cover, a free weight rack connected to the deck, a processor and memory, and a display in communication with the processor. The processor is in communication with the scale mechanism and the repetition counter and the memory includes programmed instructions that, when executed, cause the processor to instruct the user to select a weight, instruct the user to perform an exercise with the weight, instruct the user to perform a pre-determined repetition count with the weight, verify that user selected weight by measuring the increase with the scale mechanism, and verify that user performed the pre-determined repetitions with the repetition counter.

In one embodiment, a treadmill includes a deck, a first pulley disposed in a first portion of the deck, a second pulley disposed in a second portion of the deck, a tread belt surrounding the first pulley and the second pulley, a platform incorporated into the deck, and a vibration sensor is communication with the platform.

The platform may include a vibration mechanism.

The treadmill may further include a vibration isolator connecting the platform to at least one of the first portion and the second portion of the deck. The vibration isolator may at least mitigate a strength of a vibration passing from the platform to the at least one of the first portion and the second portion when the vibration mechanism is active.

The treadmill may further include an upright portion connected to the deck. The vibration isolator may at least mitigate a strength of a vibration passing from the platform to the upright structure when the vibration mechanism is active.

The treadmill may include a display connected to the upright portion.

The treadmill may include a repetition count of an exercise performed on the platform.

The display may include a type of exercise performed on the platform.

The display may include instruction for performing an exercise on the platform.

The vibration isolator may be a passive vibration isolator.

The vibration isolator may be an active vibration isolator.

The treadmill may include a free weight rack connected to the deck.

The treadmill may further include a processor, memory in communication with the processor, a display in communication with the processor, and a vibration sensor in communication with the processor. The memory may include programmed instructions that, when executed, cause the processor to record a vibration signature of the platform when a user is on the platform and the vibration mechanism is active, perform a comparison the vibration signature to a baseline signature when no user is on the platform and the vibration mechanism is active, and determine at least one parameter about the user based on the comparison.

The at least one parameter may be a weight of the user.

The at least one parameter may be an amount of weight held by the user.

The at least one parameter may be a type of exercise performed by a user.

The at least one parameter may be a repetition count of an exercise performed by the user.

In one embodiment, a treadmill includes a deck, a first pulley disposed in a first portion of the deck, a second pulley disposed in a second portion of the deck, a tread belt surrounding the first pulley and the second pulley, a platform incorporated into the deck, a vibration mechanism incorporated into the platform, a processor, a memory in communication with the processor, a display in communication with the processor, and a vibration sensor in communication with the processor. The memory includes programmed instructions that, when executed, cause the processor to record a vibration signature of the platform when a user is on the platform and the vibration mechanism is active, perform a comparison of the vibration signature to a baseline signature when no user is on the platform and the vibration mechanism is active, and determine at least one parameter about the user based on the comparison.

The at least one parameter may be a weight of the user.

The at least one parameter may be a type of exercise performed by a user.

The at least one parameter may be a repetition count of an exercise performed by the user.

In one embodiment, a treadmill includes a deck, an upright portion connected to the deck, a display connected to the upright portion, a first pulley disposed in a first portion of the deck, a second pulley disposed in a second portion of the deck, a tread belt surrounding the first pulley and the second pulley, a platform incorporated into the deck, a vibration mechanism incorporated into the platform, a processor, a memory in communication with the processor, a display in communication with the processor, a vibration sensor in communication with the processor, and a vibration isolator connecting the platform to at least one of the first portion of the deck, the second portion, the upright structure, and the display. The vibration isolator at least mitigates a strength of a vibration passing from the platform to the at least one of the first portion, the second portion, the upright portion, and the display when the vibration mechanism is active. The memory includes programmed instructions that, when executed, cause the processor to record a vibration signature of the platform when a user is on the platform and the vibration mechanism is active, perform a comparison the vibration signature to a baseline signature when no user is on the platform and the vibration mechanism is active, and determine at least one parameter about the user based on the comparison.

BRIEF DESCRIPTION OF THE DRAWINGS

The accompanying drawings illustrate various embodiments of the present apparatus and are a part of the specification. The illustrated embodiments are merely examples of the present apparatus and do not limit the scope thereof.

Throughout the drawings, identical reference numbers designate similar, but not necessarily identical, elements.

DETAILED DESCRIPTION

For purposes of this disclosure, the term "aligned" means parallel, substantially parallel, or forming an angle of less than 35.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

Figure 1:
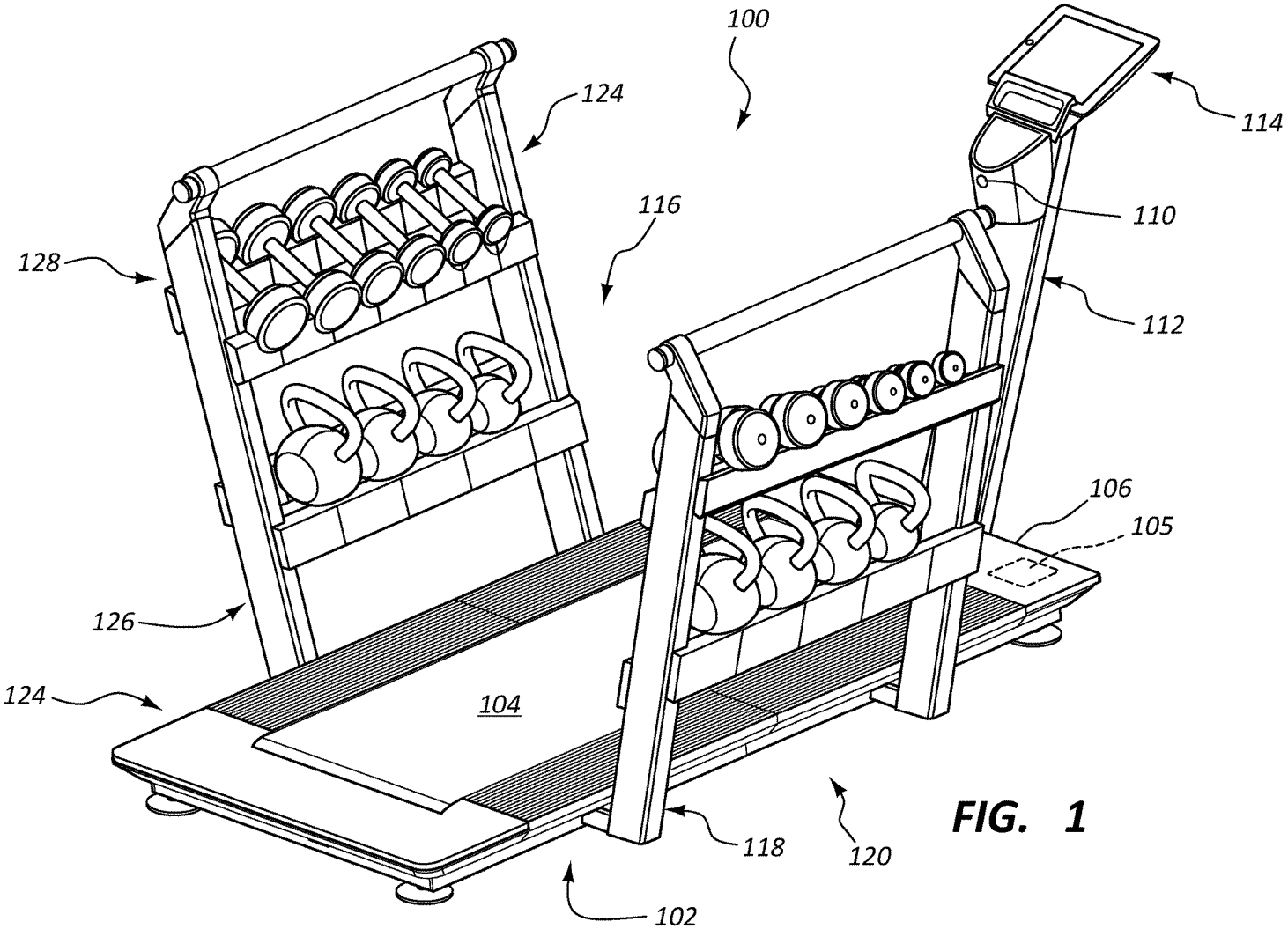
FIG. 1 illustrates a perspective view of an example of a treadmill in accordance with the present disclosure.

Particularly, with reference to the figures, FIG. 1 depicts an example of a treadmill 100 having a deck 102 with a first pulley disposed in a first portion of the deck 102 and a second pulley incorporated into a second portion of the deck 102. A tread belt 104 surrounds the first pulley and the second pulley. A motor 105 is in mechanical communication with either the first pulley or the second pulley. A cover 106 is superjacent the motor 105. A scale mechanism is incorporated into the deck 102, and a repetition counter 110 is also incorporated into the treadmill.

The treadmill 100 also includes an upright portion 112 that supports a console 114. In this example, the repetition counter 110 is incorporated into the upright portion 112. In this example, the scale mechanism is obscured from view, but is incorporated into the cover 106 near the base of the upright portion 112.

Also incorporated into the treadmill 100 is a free weight rack 116. In this example, a first portion 118 of the free weight rack 120 is connected to a first side 120 of the deck 102, and a second portion 122 of the free weight rack 120 is connected to a second side 124 of the deck 102. The free weight rack 120 may include multiple tiers. In this example, each of the portions of the free weight rack 120 include a first tier 126 and a second tier 128. In some cases, each of the tiers include a cross member that includes features that prevent the free weights from slipping off of the rack. For example, the feature may include a lip, a recess, another type of feature, or combinations thereof.

Figure 2:
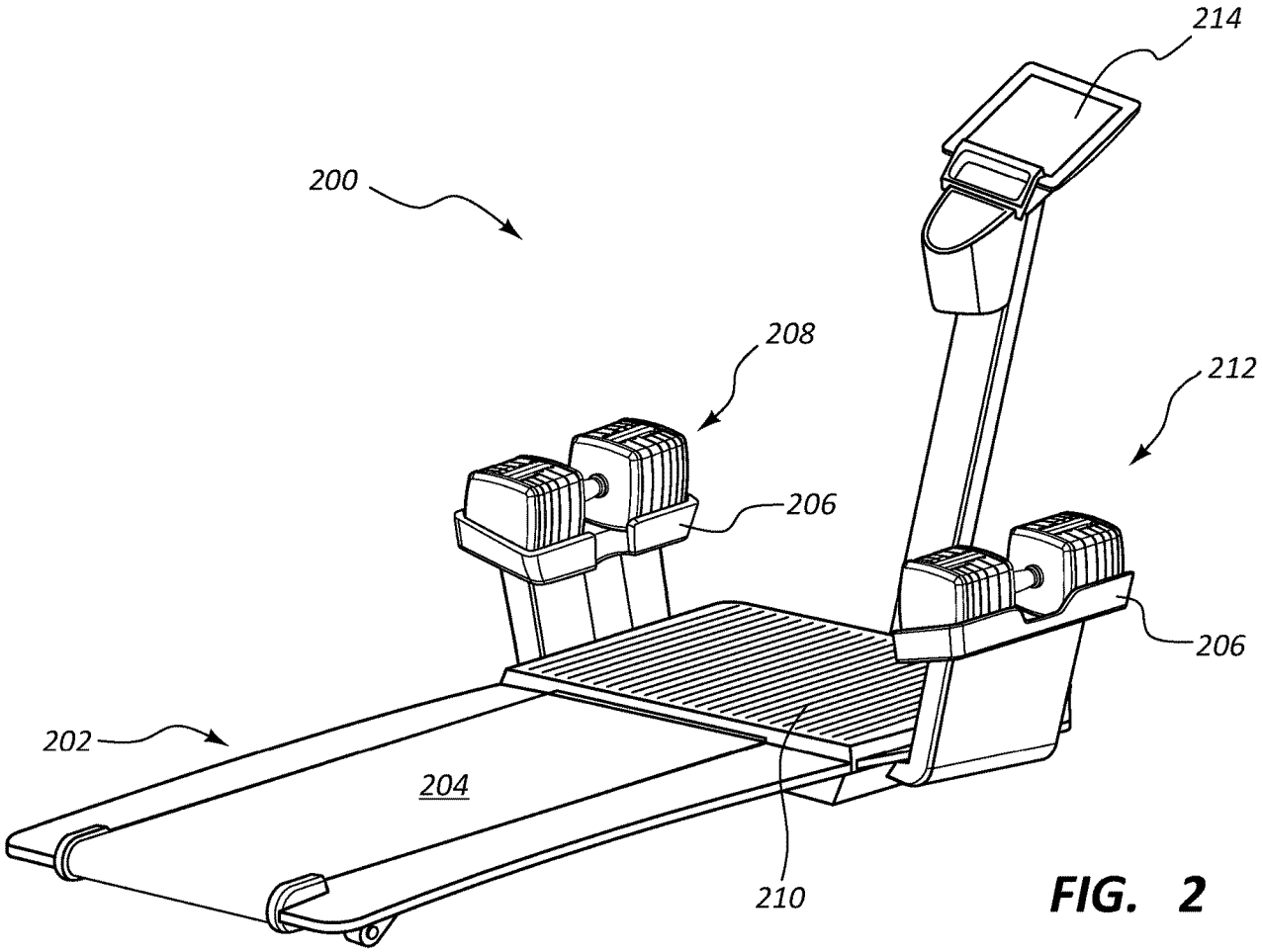
FIG. 2 illustrates a perspective view of an example of a treadmill in accordance with the present disclosure.

FIG. 2 depicts an example of a treadmill 200. In this example, the treadmill 200 includes a deck 202, and a tread belt 204 that surrounds a first pulley and second pulley incorporated into the deck 202. A free weight rack 206 is also incorporated into the treadmill 200. In this example, the free weight rack 206 includes a single tier and supports an adjustable dumbbell 208.

A weight scale 210 is incorporated into the deck 202 at a front end 212 of the treadmill 200. In this example, the weight scale 210 is positioned over the motor that drives the first pulley and therefore drives the tread belt 204. As a user stands on the weight scale 210, the weight of the user can be presented in the console 214, in a display incorporated into the weight scale 210, in a mobile device, or in another computing device in communication with the weight scale, or combinations thereof. Additionally, when the user lifts the free weights off of the rack 206, the weight scale measures the combined weight of the user and the free weights. In some cases, the dynamic fluctuation of the weight scale's measurements that occur as the user performs an anaerobic exercise with the free weights is used by the repetition counter to determine how many lifts the user has performed.

Figure 3:
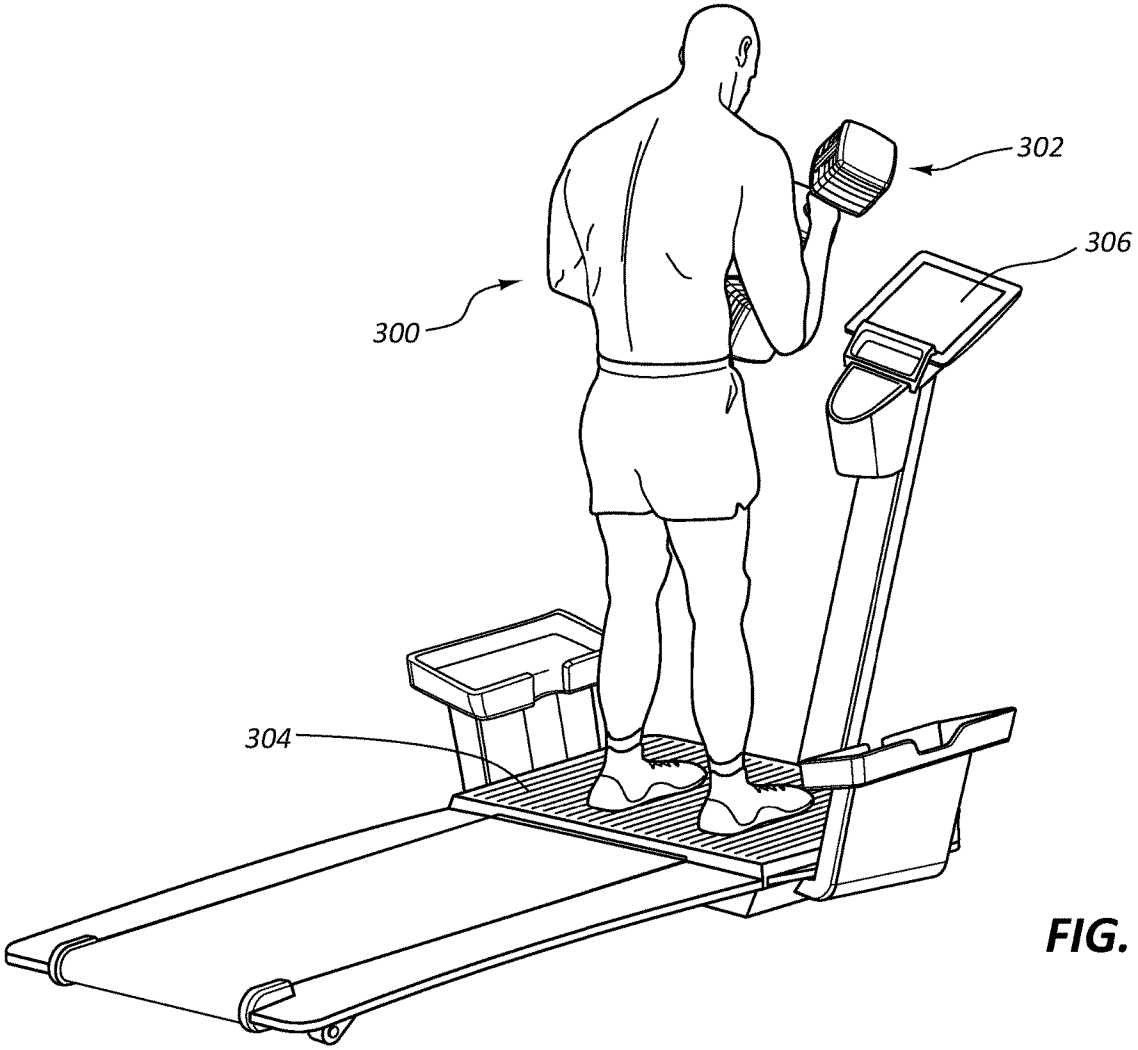
FIG. 3 illustrates a perspective view of an example of a treadmill in accordance with the present disclosure.

FIG. 3 depicts an example of a user 300 performing an anaerobic workout with the free weights 302 on the weight scale 304. In this situation, the dynamic fluctuation of the weight scale's measurements while the user performs lifts with the free weights is used by the repetition counter to determine how many lifts the user has performed. In this example, the amount of weight lifted by the user 300 is depicted in the console 306.

Figure 4:
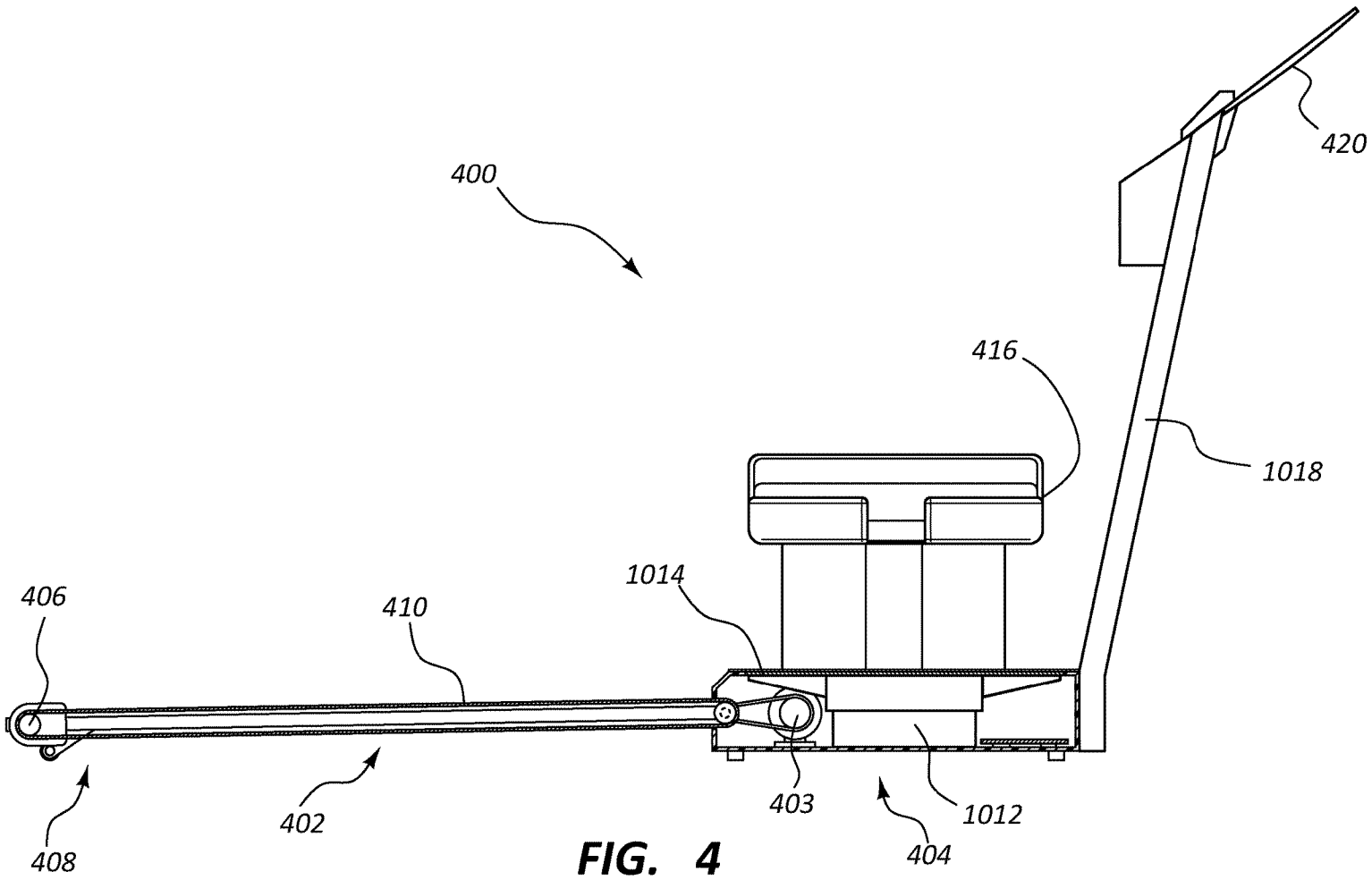
FIG. 4 illustrates a cross sectional view of an example of a treadmill in accordance with the present disclosure.

FIG. 4 depicts a cross sectional view of a treadmill 400. In this example, the treadmill 400 includes a deck 402 with a first pulley 403 in a first portion 404 of the deck 402 and a second pulley 406 in a second portion 408 of the deck. A tread belt 410 surrounds the first pulley 403 and the second pulley 406. A motor 412 drives the first pulley 403 to move the tread belt 410. A weight scale 414 is positioned over the motor 412. A rack 416 is attached to the deck 402 adjacent to the weight scale 414. An upright portion 418 of the treadmill 400 is attached to the deck 402, and a console 420 is attached to the upright portion 418.

Figure 5:
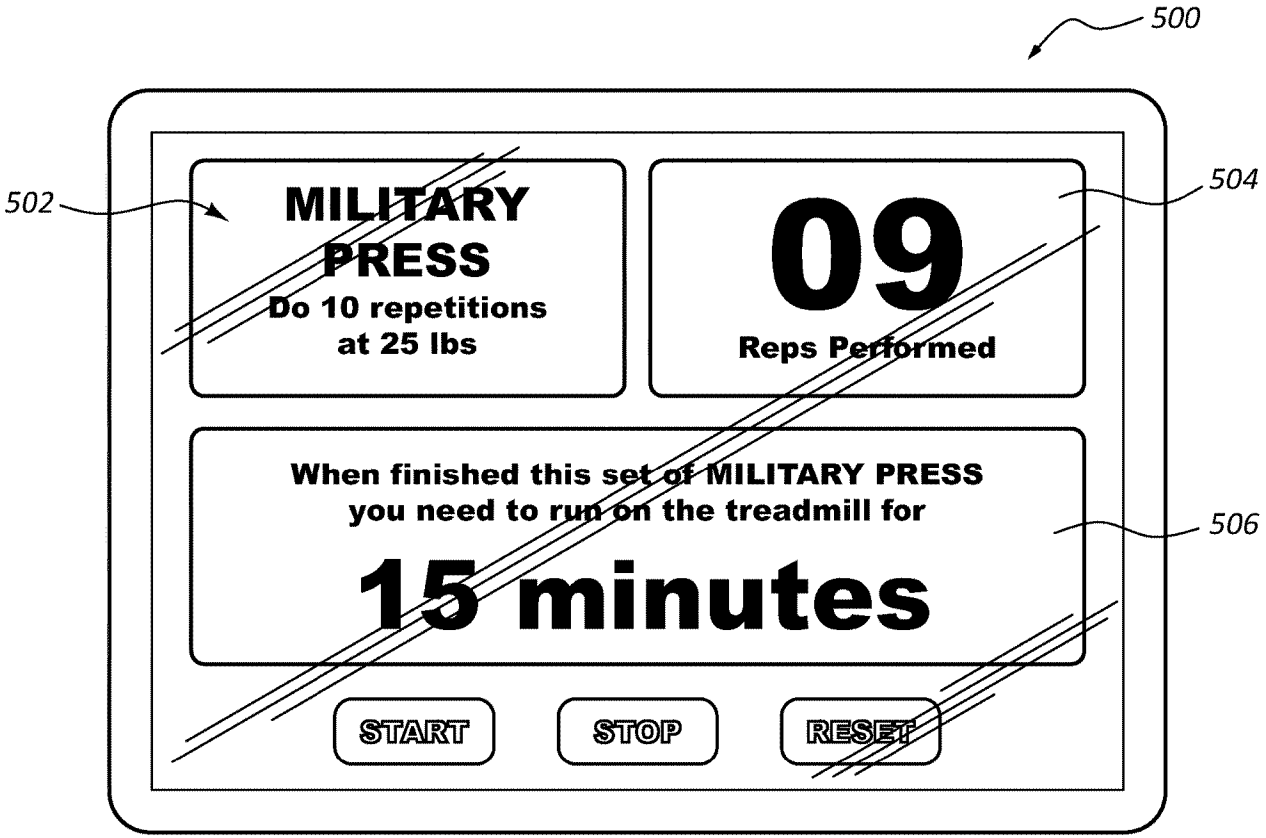
FIG. 5 illustrates a view of an example of display incorporated into an exercise device in accordance with the present disclosure.

FIG. 5 depicts an example of a display 500 incorporated into a console of an exercise device. The exercise device may be like the exercise device depicted in the other figures that incorporate a weight scale. In this example, the display includes instructions 502 to perform a certain type of lift, including the weight amount to be lifted and the number of repetitions. The display 500 also includes a repetition counter 504, which presents the number of repetitions that the user has already performed. The display 500 also includes instructions 506 for what the user is to do after the anaerobic exercise is completed. In this case, the instructions includes running on the treadmill for 15 minutes.

Figure 6:
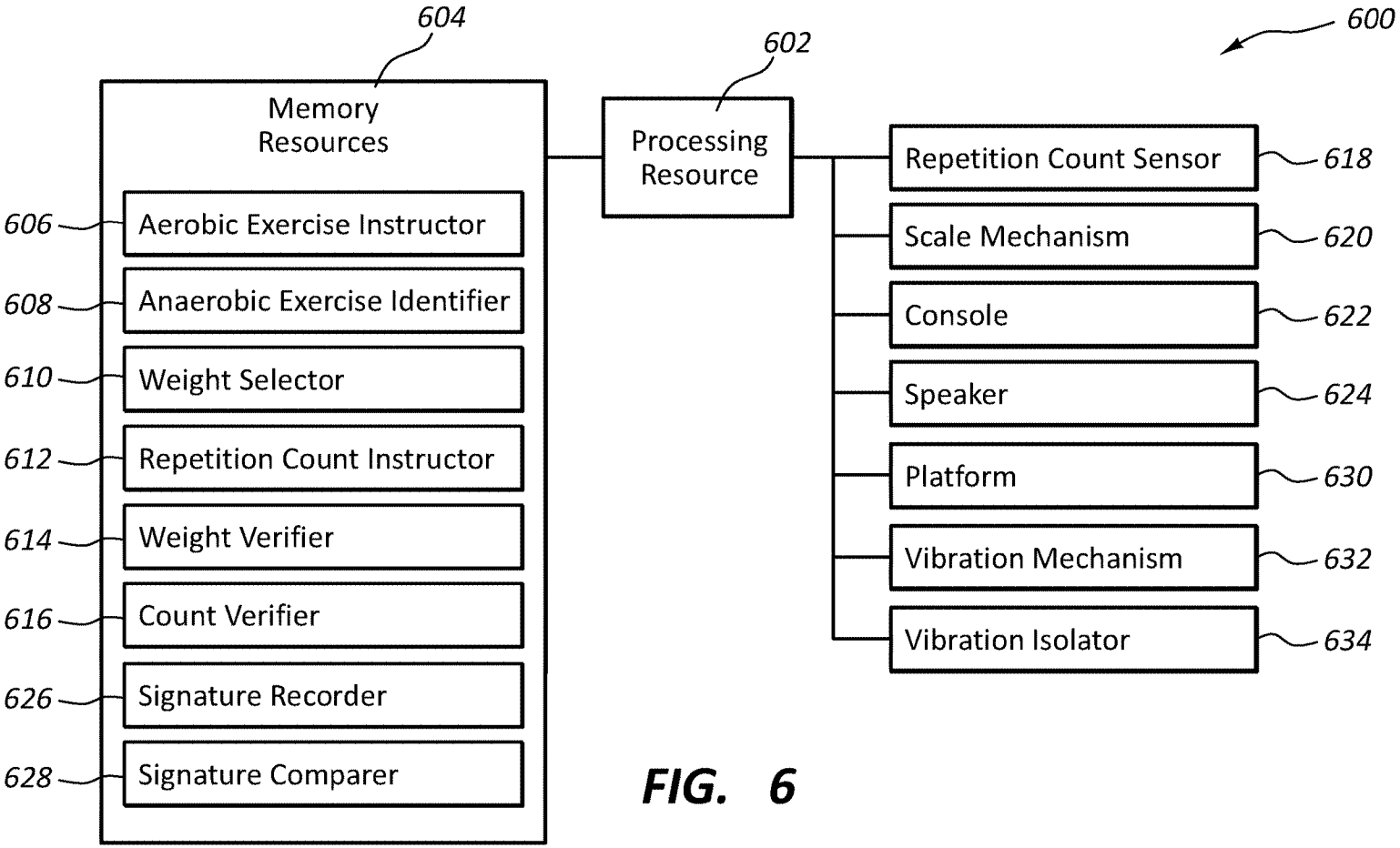
FIG. 6 illustrates a perspective view of an example of an instruction system incorporated into an exercise device in accordance with the present disclosure.

FIG. 6 depicts an example of an instruction system 600. In this example, the instruction system 600 includes processing resources 602, such as a processor, and memory resources 604, such as memory. The memory resources 604 may cause the processing resources 602 to carry out functions programmed in the memory resources 604. In this example, the memory resources 604 include an aerobic exercise instructor 606, an anaerobic exercise instructor 608, a weight selector 610, a repetition count instructor 612, a weight verifier 614, a count verifier 616 signature recorder 626, and signature comparer 628. Further, the processing resources 602 may be in communication with a repetition count sensor 618, a scale mechanism 620, a console 622, a speaker 624, platform 630, vibration mechanism 632, vibration isolator 634, and/or combinations thereof.

Figure 7:
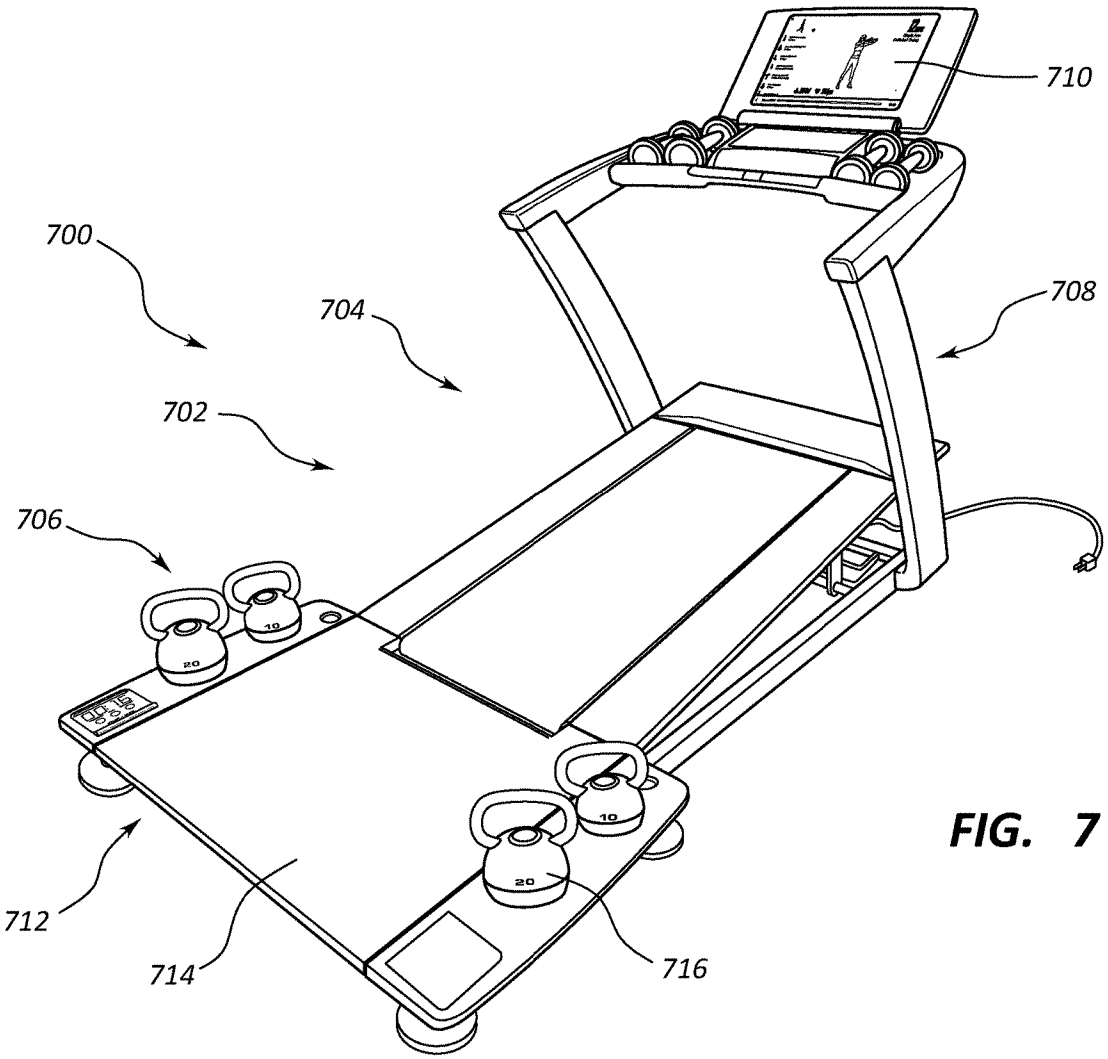
FIG. 7 illustrates a perspective view of an example of a treadmill incorporated into an exercise device in accordance with the present disclosure.

FIG. 7 depicts an example of a treadmill 700 with a deck 702. The deck 702 includes a first pulley in a first portion 704 and a second pulley in a second portion 706. A tread belt 704 surrounds the first pulley and the second pulley. The treadmill 700 also includes an upright structure 708, and a display 710 connected to the upright structure 708.

The deck 702 also includes a platform 712. The platform 712 includes a vibration mechanism that causes the top surface 714 of the platform to vibrate. Free weights 716, such as dumbbells, kettlebells, or other types of weights, may be positioned adjacent to the top surface 714 to be within a convenient reach of the user. The user may use the weights to perform an anaerobic exercise on the platform. The anaerobic exercise may constitute the entire exercise routine. In other examples, the anaerobic exercise may constitute a portion of the exercise routine. In some cases, the exercise routine includes anaerobic components and aerobic components. The aerobic components of the exercise may include exercises that are performed on the tread belt of the deck.

Figure 8:
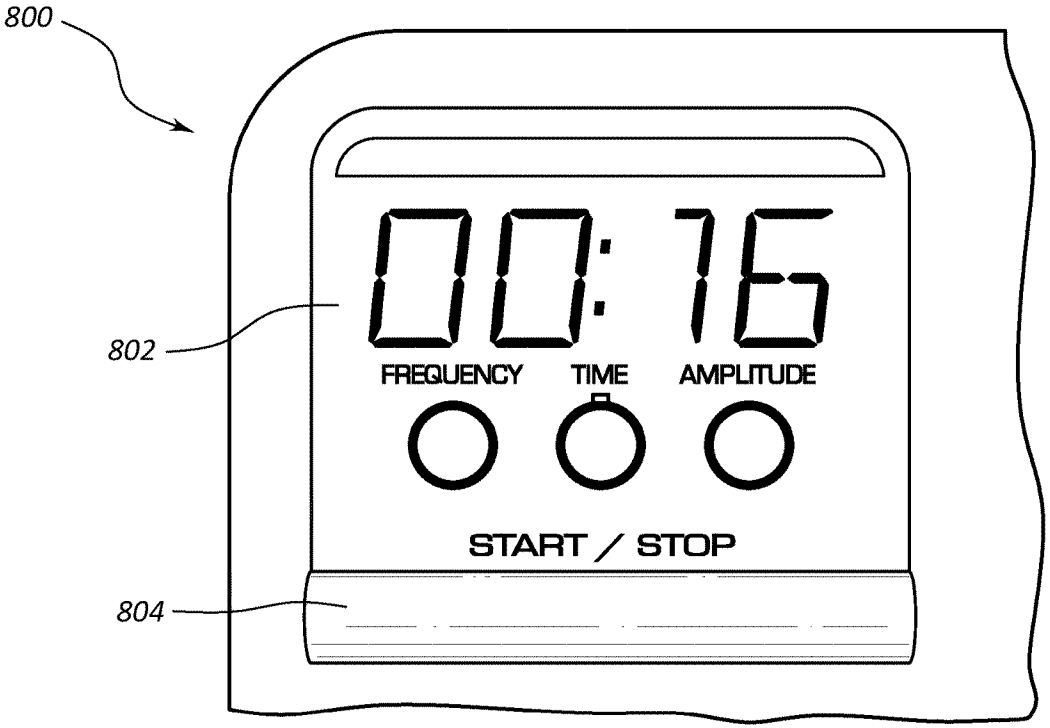
FIG. 8 illustrates a perspective view of an example of a display incorporated into an exercise device in accordance with the present disclosure.

FIG. 8 is a display 800 that is incorporated into the treadmill 800. In some examples, the display 800 is incorporated into the upright structure. In yet other examples, the display 800 is incorporated into the deck, such as into the platform.

The display 800 may include a field 802 that depicts different parameters about the user's workout on the platform. For example, the field may depict a vibration amplitude, a time duration of the workout, or a frequency of the vibration. In some cases, just one of the parameters is depicted at a time. In other examples, at least two of the parameters are depicted in the display simultaneously.

An input mechanism 804 may be proximate the display 800. The input mechanism 804 may be a push button, a touch screen input, a level, a dial, a switch, a microphone, another type of input mechanism, or combinations thereof.

Figure 9:
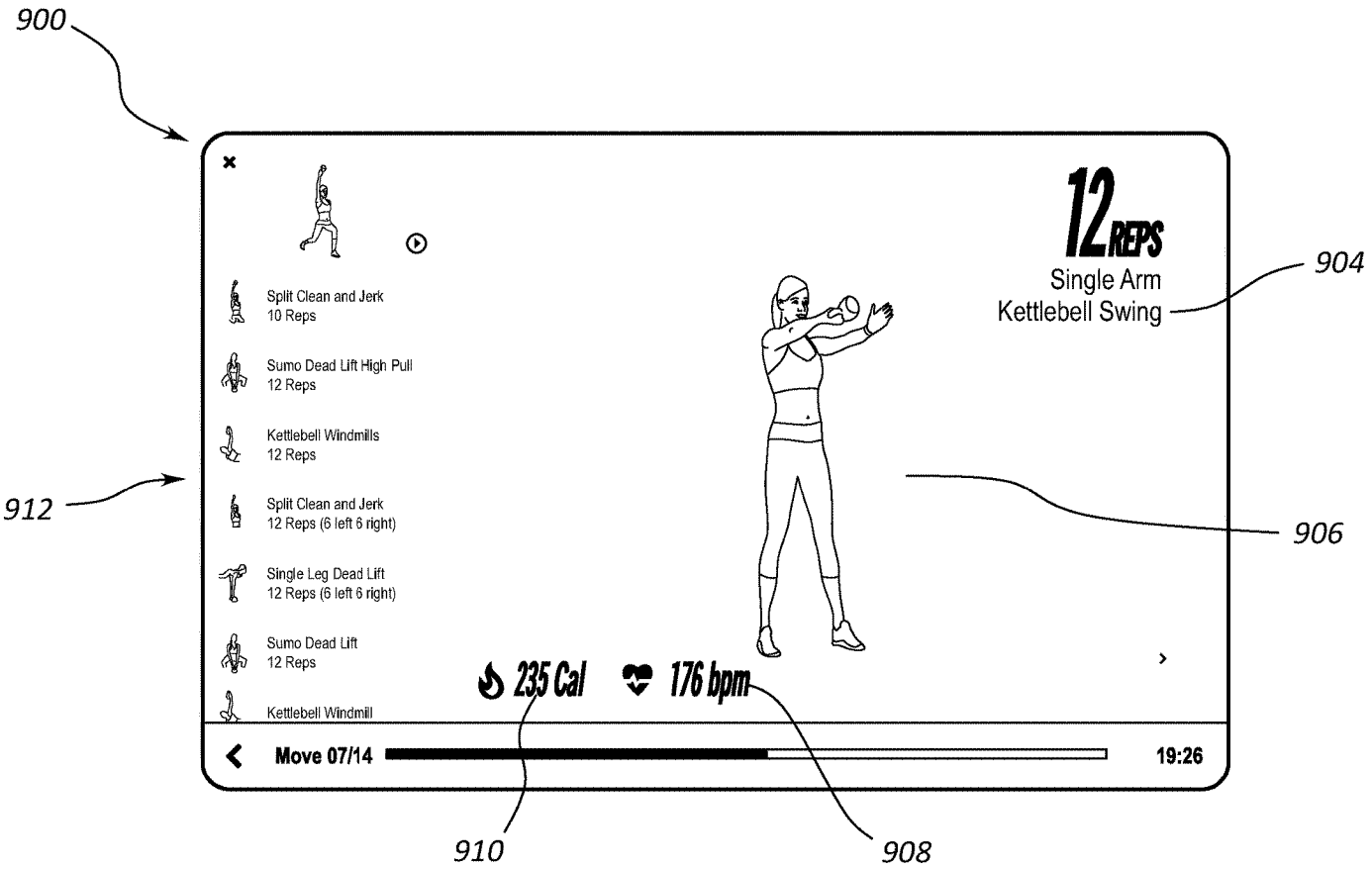
FIG. 9 illustrates a perspective view of an example of a display incorporated into an exercise device in accordance with the present disclosure.

FIG. 9 depicts another example of a display 900 incorporated into the treadmill. In this example, the display 900 is connected to the upright structure that is attached to the deck. In this example, the display 900 includes a repetition count 902, a name 904 of the exercise type, an image 906 of the how the exercise type is performed (e.g. visual instructions on performing the exercise type), a heart rate 908, a calorie count 910, and a routine sequence 912. The routine sequence 912 includes the types of exercises that are coming up next in the exercise routine and the number of repetitions to perform. In some examples, the display may include a video segment and an audio segment that describes how the exercise is to be performed.

Figure 10:
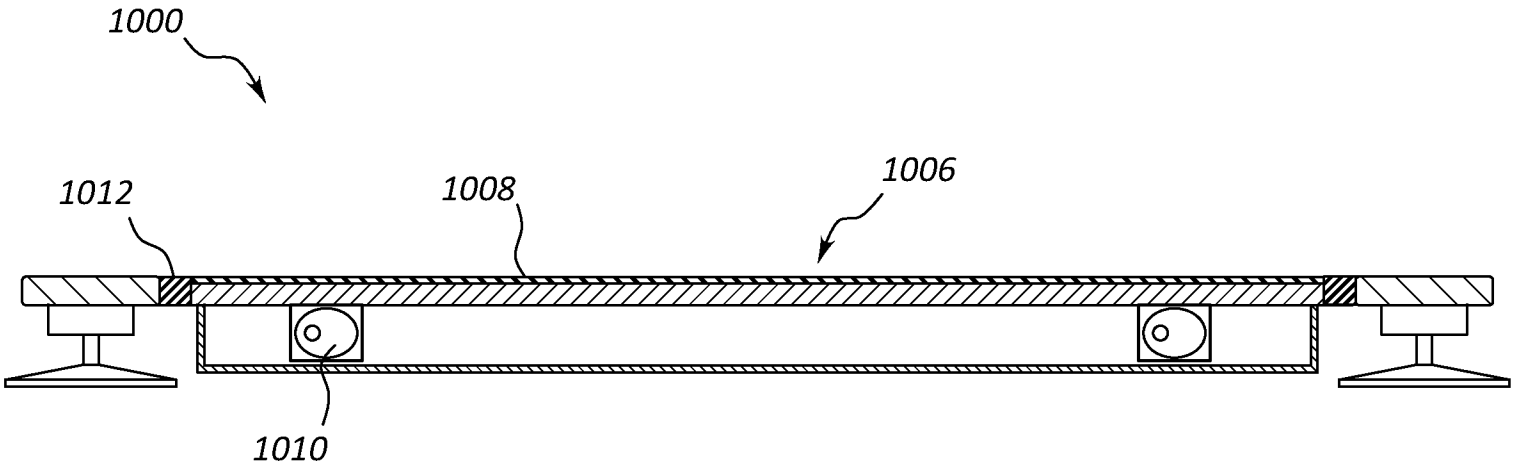
FIG. 10 illustrates a cross sectional view of an example of a platform incorporated into an exercise device in accordance with the present disclosure.

FIG. 10 depicts an example of a treadmill 1000. In this example, the treadmill 1000 includes a platform 1006 adjacent to the tread belt. The platform 1006 includes a top plate 1008 that is connected to a vibration mechanism 1010. The vibration mechanism 1010, when activated, can vibrate the top plate 1008. Additionally, the platform 1006 may include at least one vibration isolator 1012 that at least mitigates the strength of the vibrations as the vibrations pass from the platform to the other portions of the deck, the upright structure, the display, other components of the treadmill, or combinations thereof. In some examples, the vibration isolator 1012 eliminates vibrations from passing from the platform to the other components of the treadmill.

In this example, the vibration mechanism 1010 includes a camming mechanism where a cam 1014 has an eccentric mass. As the eccentric mass rotates about an axle, the rotation generates a vibration in the top plate 1008.

Figure 11:
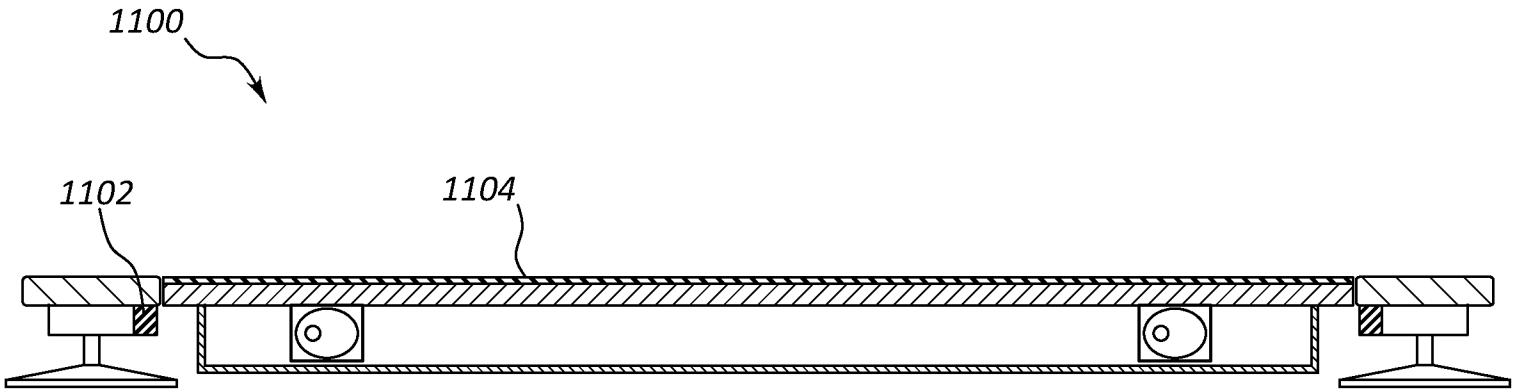
FIG. 11 illustrates a cross sectional view of an example of a platform in accordance with the present disclosure.

FIG. 11 depicts an example of a treadmill 1100. In this example, the vibration isolator 1102 is an active vibration isolator 1102 that detects a vibration and then actively imposes a cancellation wave that cancels the vibrations that could be potentially transmitted to the other portions of the treadmill 1100. In this example, the vibration isolators 1102 on attached to components of the treadmill 1100 that are off of the platform's top plate 1104.

GENERAL DESCRIPTION

In general, the invention disclosed herein may provide a user with a treadmill that has several advantages over conventional treadmills. The treadmill may include a running deck that has first pulley and a second pulley. A tread belt may surround the first and second pulley. A motor can be attached to either the first or the second pulley so that as the motor rotates its shaft, the connected pulley also rotates which drives movement of the tread belt. In those examples where the treadmill includes just a single motor, the movement of the tread belt drives movement of the other pulley that is not connected to the motor. A user may perform aerobic exercises on the tread belt, such as walking, running, cycling, or another type of aerobic exercise.

The treadmill may also include a platform where the user may perform anaerobic exercises. Free weights or other types of weights that can be used to perform the anaerobic exercises may be positioned on the platform or at least proximate the platform so that the weights are conveniently accessible to the user while standing on the platform. In some cases, the platform includes a top plate on which the user can exercise and at least one weight rack that is separate from the top plate.

In some cases, a free weight rack may be incorporated into the treadmill. In this example, the free weight rack may have a first portion incorporated into a first side of the treadmill and a second portion incorporated into a second side of the treadmill. Each of the portions of the free weight rack may position the free weights within a convenient reach of each of the user's hands. Thus, the free weights may be accessible to the user when the user is on the exercise deck.

For purposes of this disclosure, the term "free weight" refers broadly to free weights that are intended to be used to execute lifts associated with strength training. In some cases, the free weights may be intended to be held in a single hand where free weights for a first hand are positioned in the first portion 718 of the free weight rack 716, and free weights intended for the second hand are positioned in the second portion 722 of the free weight rack 716. These free weights may include dumbbells, kettlebells, balls, adjustable dumbbells, weight plates, Bulgarian bags, other types of weighted bags, barbells, curl bars, other types of free weights, or combinations thereof.

In some cases, the user can work out on the portion of the exercise deck that includes the tread belt. In this example, the user may desire to mix up the anaerobic exercise and aerobic exercise portions of his or her workout. During the anaerobic portions of the workout, the tread belt may be stopped while the user performs the free weight exercises. When the anaerobic portion of the workout is completed, the user may resume the operation of the tread belt to perform an aerobic portion of the workout. In other examples, the user may want to use the free weights while the tread belt is in operation. For example, the user may want to carry dumbbells during a run.

In other examples, the treadmill incorporates a separate area on the exercise deck where the user can perform exercises with the free weights. In some cases, this free weight area may be in the front end of the treadmill proximate the treadmill's upright portion. A console supported by the upright portion can provide information about the user's workout such as the time, distance, and speed at which the user executed the aerobic portions and the anaerobic portions of the workout.

In some examples, the platform includes a vibration mechanism, a weight scale, another feature, or combinations thereof. In examples with the vibration mechanism, the vibration mechanism may be used to vibrate a top plate of the platform. The vibrations may provide multiple benefits. One benefit is that the vibrations cause the user to work harder while performing an anaerobic exercise. The vibrations therefore increase the number of calories burned and stimulate additional stabilization muscles during the anaerobic portion of the workout.

In some examples, the vibration mechanism includes a camming mechanism where a cam has an eccentric mass. As the eccentric mass rotates about an axle, the rotation generates a vibration in the top plate. The eccentric mass may include any appropriate type of shape. While these examples have been described with the vibration mechanism including a camming mechanism, any appropriate type of vibration mechanism may be used in accordance with the principles described in the present disclosure.

The vibrations also provide a benefit for determining at least one parameter of the user's workout. For example, a vibration sensor may be used to measure the vibrations of the top plate when the user is on the top plate to determine the user's weight, the amount of weight being used by the user, the type of exercise being performed by the user, a repetition count of the exercise, another type of exercise, or combinations thereof. In some examples, the vibration sensor may include an accelerometer, a multi-axis accelerometer, a distance sensor, an optical sensor, a laser displacement sensor, a velocity sensor, a capacitance sensor, a proximity probe, a magnet, a piezoelectric device, a potentiometric sensor, a strain gauge, a geophone, another type of sensor, or combinations thereof.

In some examples, the vibration sensor may be used to determine a baseline measurement. The baseline measurement may be the vibrations recorded by the sensor when the plate is vibrating, but the user and other objects are not on the top plate of the platform. In other examples, the baseline measurement may be a vibration signature that was recorded on a different treadmill with a platform. The baseline measurement may have a unique baseline signature that can be compared to other vibration signatures. In some examples, the baseline signature has a consistent amplitude and frequency.

The baseline measurement may be compared to vibration measurements taken when the user is performing an anaerobic exercise on the platform. For instance, when the user is standing on the platform while the platform is vibrating, the vibration signature will be different than the baseline signature. The user's weight affects the signature's amplitude. In those situations where the user is not moving while standing on the vibrating top plate, the signature may also have a consistent amplitude and frequency. The comparison of the vibration signature and the baseline signature can identify the amount of weight on the top plate.

In those situations where the user picks up a free weight, the additional weight of the free weight will further affect the vibration signature. Thus, the vibration signature can identify the combined weight of the user and the free weigh. During the anaerobic portion of the workout, the user will pick up and return the free weights. In those moments where the user is not holding a weight, the vibration signature can be compared with the baseline to determine the user's weight. In some examples, the treadmill may provide instructions for the user to stand still on the vibration plate to determine the user's weight before instructing the user to lift weights. In other examples, the treadmill determines the user's weight by determining the amount of weight on the top plate throughout the exercise routine. As a result, the vibration signature includes moments where the user is holding additional weight and moments where the user is not holding additional weight. In some examples, the treadmill identifies those characteristics of the vibration signature that depict a consistent vibration reading that indicates the lowest weight on the treadmill to determine the user's baseline weight. With the baseline weight, the treadmill can determine the amount of weight being held by the user at any given time during the anaerobic workout.

As the user performs anaerobic exercises on the platform, the user's movements may also affect the vibration signature when the vibration mechanism is active. For example, when the user lifts a weight, the acceleration of the weight's movement may momentarily increase the load on the top plate, which can affect the amplitude of the vibration signature at that moment. This change in the vibration signature may be time stamped and classified as a lift. Each event in the vibration signature with these types of characteristics may also be classified as a lift. To determine the repetition count, the treadmill or processor may count these types of events, such as the number of times when the amplitude changes in the vibration signature. In examples where these events are time stamped, the user's lift rate can be determined.

Additionally, certain movements performed on the top plate may create different patterns in the vibration signature. These patterns may be distinct for certain a types of exercises. As a result, the type of exercise being performed by the user may be distinguished from other types of exercises. For example, performing a military press exercise may generate a different vibration pattern than performing a lung exercise, a curl exercise, a jumping exercise, a push-up exercise, leg lift exercise, a sit-up exercise, another type of exercise, or combinations thereof.

In some examples, the type of exercise is determined by factors other than the vibration signature. In some instances, the treadmill may instruct the user to perform a certain type of exercise. In these examples, the treadmill may determine that the type of exercise instructed to be performed is the exercise being performed by the user. In other examples, a camera is in communication with the treadmill where the user is in the camera's field of view. An analysis may be performed on the footage captured by the camera to determine the type of exercise performed by the user. In yet other examples, the top plate may include a load cell, a scale, a level, or another type of sensor that detects the location of a load on the top plate. While the user may perform many types of exercises in a central region of the top plate, other types of exercises, such as push-ups and sit-ups may load the top plate asymmetrically. This asymmetric loading may be used to determine the exercise type.

While the examples above have been described with reference to how anaerobic exercises affect the amplitude of a vibration signature, the performance of anaerobic exercises may affect the vibration signature in other ways. For example, certain movements on the top plate may generate a different vibration frequency than the vibration frequency imposed by the vibration mechanism. This distinct vibration frequency may increase or decrease the vibration frequency imposed by the vibration mechanism. Additionally, these user imposed vibrations may cause vibrations imposed by the vibration mechanism to cancel, diminish, amplify, or change in another detectable way.

Any appropriate number of vibration sensors may be used in accordance with the principles described in the present disclosure. For example, a vibration sensor may be attached to each corner of the top plate. In other examples, a single sensor is attached to a single side of the top plate. In yet another example, a single sensor is attached to a central region of the top plate. In some cases, the sensor is attached to a top surface of the plate, an underside of the plate, proximate the plate, another location, or combinations thereof.

Further, in some cases, no vibration mechanism is used to impose a vibration on the top plate. The user's movements while performing the anaerobic exercise may generate vibrations in the top plate that can determine parameters about the user's workout, such as the amount of weight added, the type of exercise being performed, the repetition count of the exercise, another type of parameter of the exercise, or combinations thereof.

In some examples, a display is connected to the treadmill. In some instances, the display may provide information, including information about instructions to the user on which exercise to perform, how to perform each exercise, the repetition count, other information relating the anaerobic portion of the workout, or combinations thereof.

The treadmill may also be in communication with a remote device over a network, such as the internet. The user may access the records of his or her exercise history, previous workouts, exercise recommendation, personal information, or combinations thereof. The remote device may record the workout information and/or the physiological information associated with the workout. An example of a user program that may be compatible with the principles described herein can be found at www.ifit.com, which is administered through Icon Health and Fitness, Inc. located in Logan, Utah, U.S.A.

In some examples, the top plate is vibrationally isolated from other components of the treadmill. Vibration isolators may be used to cancel, reduce, and/or eliminate vibrations from the top plate to other portions of the treadmill. In those examples where the platform is included in a rear portion of the treadmill, the vibration isolators may cancel, reduce, and/or eliminate vibrations from passing from the platform into the rear portion of the treadmill, which also protects the front portion of the treadmill, including the upright structure, and the display and other electronics attached to the upright structure, from the vibrations. Further, in those examples where the platform is located in a front portion of the treadmill, the vibration isolators may protect the front portion, which protects the rear portion, and protect the upright structure from the platform's vibrations.

A passive vibration isolator may be used to reduce and/or eliminate vibrations from passing to other components of the treadmill. In some examples, the passive vibration isolators may include an elastomeric material that connects the top plate and/or the platform to other components of the treadmill. The elastomeric material may include rubber.

Another type of passive vibration isolator may include pneumatic, air, or hydraulic bladder, canister, or other types of containers. These bladders or canister may include a compressed air and/or liquid. In some cases, the pressure is maintained with a source that continuously feeds the bladder and/canister. In some examples, the passive isolator may include an air spring in the form of a rubber bladder which provides damping.

In other examples, the isolators may include mechanical springs and/or spring-dampers. Pads or sheets of flexible materials such as elastomers, rubber, cork, dense foam, laminate materials, other types of material, or combinations thereof may also be used as vibration isolators. Elastomer pads, dense closed cell foams, laminate materials, molded and bonded rubber, elastomeric isolators and mounts, or combinations thereof may also be used. In some cases, the isolators are made of layers of neoprene and steel with a low horizontal stiffness.

In some cases, the vibration isolators are active isolators that impose a vibration that reduces and/or cancels the vibrations from the vibration mechanism or from the vibrations generated by the user's workout on the top plate. The active vibration isolators may include a spring, a feedback circuit which includes a sensor, a controller, and an actuator. The vibration from the top plate is processed to determine the characteristics of the top plate. The characteristics of the vibration are fed to the actuator to produce another vibration that either reduces and/or cancels the vibrations from the top plate. The sensors may be positioned on a component of the treadmill or the platform that is connected to the top plate. In some examples, the active isolators may impose the canceling vibrations to components connected to the top plate, but not to the actual top plate. Further, in some examples, a combination of passive isolators and active isolators are used. The passive isolators may be used to reduce the vibrations that travel from the top plate to the other treadmill components, and the active isolators may be attached to the treadmill components that are intended to be vibration free.

The vibration isolators may be used to extend the life of the other treadmill components. For example, the vibration isolators may insulate and/or isolate the display, upright structure, pulleys in the deck, the tread belt, processors, memory, electronics, other components, or combinations thereof.

In some cases, the platform may include a weight scale. The weight scale may be large enough to allow the user to stand and/or exercise on the weight scale. One advantage to working out on a platform with a weight scale is that as the user performs certain types of exercises, like thrusting free weights over his head, the load felt by the weight scale changes. Detecting this change can be used to determine when and if the user actually performed the overhead lift. For example, in situations where the dumbbells are thrust over the user's head, the scale may measure an increased amount of weight. The processing resources in communication with the weight scale may associate a time stamp with the measured increase. Thus, the processing resources can determine statistics about the user's workout (e.g. how long the user executed the workout, how long between each repetition, start times, end times, and so forth).

The weight scale can also determine how much weight the user is using during the workout. For example, the weight scale can determine the weight of the user when the user is standing on the scale without holding weights. When the user picks up free weights, the weight scale can subtract the user's body weight from the total weight being measured. The difference between the total weight and the user's body weight can be determined to be the weight amount the user is holding.

Exercising on the scale can provide inputs for determining how many repetitions the user performed. For example, the weight scale may recognize weight fluctuation patterns that are characteristic of the user lifting or lowering free weights.

As these patterns are recognized, the weight scale may cause a repetition counter to increment by one when a lift pattern is recognized.

The weight scale may include any appropriate type of measuring mechanism. In some examples, the weight scale includes a piezoelectric material that changes its electrical properties in response to a mechanical load. In other examples, the weight scale may include a magnetostrictive material that changes its magnetic properties in response the mechanical load. In yet other examples, the weight scale may also include a spring mechanism, a strain gauge, a hydraulic mechanism, a pneumatic mechanism, another type of measuring mechanism, or combinations thereof.

In some cases, the tread belt passes over the region of the treadmill deck that contains the weight scale. In this example, the treadmill can determine when the user is holding weight while standing on the tread belt, like in situations where the user is carrying free weights during a walk or run. In response to determining that the user is carrying free weights during a walk or run, the treadmill can increase the calorie burn count.

In some situations, the treadmill guides the user with a programmed workout. In some cases, the programmed workout alters the tread belt's speed, the incline of the deck, and other factors affecting the aerobic portion of the workout. Additionally, the programmed workout may include anaerobic portions as well. In these instances, the programmed workout may instruct the user to perform certain types of lifts with the free weights. In some cases, the programmed workout may select the amount of weight that the user is to lift. In embodiments where the free weight rack includes an adjustable dumbbell, the treadmill may cause the adjustable dumbbell to select the amount of weight prescribed by the programmed workout. In other instances, the treadmill may allow the user to select the amount of weight to lift even if the programmed workout instructs the user to lift a predetermined amount.

The predetermined weight amount recommended in the programmed workout may be based on information about the user. This information may be derived from history compiled with fitness trackers, previous workouts on the treadmill, age information, height information, body composition information, gender information, other types of personal information, or combinations thereof. In some instances, the treadmill is in communication with a remote computing device that contains a user profile detailing fitness information about the user. The treadmill or a remote computing device may also take into consideration the user's fitness goals when selecting the type of lifts to perform, the amount of weight to perform with the lifts, and the number of repetitions.

The weight scale can be used to determine if the user selected the recommended weight amount. In those situations where the user selected a different weight amount than the recommended amount, the programmed workout can alter an aspect of the workout. For example, if the user selected a weight amount that is heavier than the recommended amount, the programmed workout can reduce the number of repetitions that the user is instructed to lift. Further, the calorie burn count can also be adjustable based on the weight amount that the user actually selects instead of the weight amount instructed by the programmed workout.

The weight scale can also be used to verify that the user performs the number of recommended lifts. In this example, the weight scale can cause a repetition counter to increment by one when the weight scale detects a weight fluctuation pattern characteristic of performing a lift. In some examples, a separate repetition counter is used to determine the number of repetitions performed by the user. For example, an optical camera can be incorporated into the treadmill's upright structure. The optical camera can record and analyze information to determine the number of lifts performed by the user and, in some instances, whether the user performed the type of lift instructed by the programmed workout.

In some cases, the programmed workout's instructions can be presented to the user through a display in the console. The programmed workout can present the number of lifts to perform, the type of lifts to perform, the next type of exercise to perform, and so forth. In some case, the display screen can instruct the user on how to perform the lift. For instance, the programmed workout may instruct the user to perform negatives by lifting up quickly and lowering the weight slowly, or the programmed workout may instruct the user to perform the same type of lift by lifting up and lowering the weight at the same rate. In other examples, a speaker may be used to audibly instruct the user about the programmed workout.

Information relating to both the anaerobic and aerobic portions of the workout can be present to the user. For instance, the repetition count may be presented in the display, the calories burned during the workout may be presented in the display, the user's heart rate or other physiological parameters be presented in the display, and so forth.

In some case, the treadmill is in communication with a remote device, and the information recorded about the workout is sent to the remote device. In one instance, the information is sent to the user's mobile device and the user follows the workout with his or her mobile device.

The instruction system for instructing the user about the workout may include a combination of hardware and programmed instructions for executing the functions of the instruction system. The instruction system may include processing resources that are in communication with memory resources. Processing resources include at least one processor and other resources used to process the programmed instructions. As described herein, the memory resources may represent generally any memory capable of storing data such as programmed instructions or data structures used by the instruction system.

The processing resources may include I/O resources that are capable of being in communication with a remote device that stores user information, workout history, external resources, databases, or combinations thereof. The remote device may be a mobile device, a cloud based device, a computing device, another type of device, or combinations thereof. In some examples, the instruction system communicates with the remote device through a mobile device which relays communications between the instruction system and the remote device. In other examples, the mobile device has access to information about the user. The remote device may collect information about the user throughout the day, such as tracking calories, exercise, activity level, sleep, other types of information, or combination thereof.

The remote device may execute a program that can provide useful information to the instruction system. An example of a program that may be compatible with the principles described herein includes the iFit program which is available through www.ifit.com identified above. An example of a program that may be compatible with the principles described in this disclosure is described in U.S. Pat. No. 7,980,996 issued to Paul Hickman. U.S. Pat. No. 7,980,996 is herein incorporated by reference for all that it discloses. In some examples, user information accessible through the remote device includes the user's age, gender, body composition, height, weight, health conditions, other types of information, or combinations thereof.

The processing resources, memory resources, and remote devices may communicate over any appropriate network and/or protocol through the input/output resources. In some examples, the input/output resources includes a transmitter, a receiver, a transceiver, or another communication device for wired and/or wireless communications. For example, these devices may be capable of communicating using the ZigBee protocol, Z-Wave protocol, BlueTooth protocol, Wi-Fi protocol, Global System for Mobile Communications (GSM) standard, another standard, or combinations thereof. In other examples, the user can directly input some information into the instruction system through a digital input/output mechanism, a mechanical input/output mechanism, another type of mechanism, or combinations thereof.

The memory resources may include a computer readable storage medium that contains computer readable program code to cause tasks to be executed by the processing resources. The computer readable storage medium may be a tangible and/or non-transitory storage medium. The computer readable storage medium may be any appropriate storage medium that is not a transmission storage medium. A non-exhaustive list of computer readable storage medium types includes non-volatile memory, volatile memory, random access memory, write only memory, flash memory, electrically erasable program read only memory, magnetic based memory, other types of memory, or combinations thereof.

The memory resources may include instructions for simulating an aerobic exercise instructor that represent programmed instructions that, when executed, cause the processing resources to control the aerobic portion of the user's workout. The aerobic exercise may include, but is not limited to, walking, running, shuffling, skipping, biking, jumping, or otherwise moving while the tread belt is in operation. The aerobic exercise instructor may control the speed of the tread belt based on the user's heart rate or other physiological readings, the user's goals, programmed workouts, inputs from the user, or combinations thereof.

The memory resources may also include instructions for simulating an anaerobic exercise instructor that represent programmed instructions that, when executed, cause the processing resources to control the anaerobic portions of the user's workout. The anaerobic exercise instructor may instruct the user to perform lifts, perform a number of repetitions, perform a type of lift, perform other aspects of the anaerobic portion of the workout, perform other aspects of the workout, or combinations thereof.

The memory resources may also include a weight selector that represents programmed instructions that, when executed, cause the processing resources to select the amount of weight to lift. In one embodiment, the free weights include an adjustable dumbbell, and a selector is incorporated into the rack. The selector adjusts the dumbbell so that the desired amount of weight is automatically attached to the dumbbell's handle, and the user does not have to make the adjustment manually.

The repetition count instructor represents programmed instructions that, when executed, cause the processing resources to instruct the user to perform a number of lifts. The lift number may be presented to the user through a display, through a speaker, another mechanism, or combinations thereof.

The weight verifier represents programmed instructions that, when executed, cause the processing resources to verify that the user is lifting the weight. In some cases, the weight verifier also verifies that the user is lifting the amount of weight instructed by the instruction system.

The counter verifier represents programmed instructions that, when executed, cause the processing resources to verify that the user is performing the instructed number of lifts. This count verification may be based on images captured with an optical sensor, the fluctuations measured at the weight scale, another type of sensor, or combinations thereof. The count verification may be presented in a console or display integrated into the treadmill, a mobile device in communication with the treadmill, a remote device in communication with the treadmill, or combinations thereof.

The vibration recorder represents programmed instructions that, when executed, cause the processing resources to record vibrations imposed from the top plate. The vibrations may be imposed by the vibration mechanism or by the movements of the user. In some cases, the vibration recorder records the vibrations when no one is on the top plate. This recorded vibration may become a baseline signature to which other vibrations signatures are compared to. The recorder may also record the vibrations of the top plate when a user is standing on the top plate of the platform or otherwise performing exercises on the top plate.

The vibration comparer represents programmed instructions that, when executed, cause the processing resources to compare baseline signature with the vibration signatures taken when the user is on the plate or performing movements on the plate. Based on the characteristics of the vibration signatures the processor may determine the weight of the user, the amount of weight used by the user, the type of exercise performed by the user, the number of repetitions performed by the user, other characteristics about the user's workout, or combinations thereof.

Further, the memory resources may be part of an installation package. In response to installing the installation package, the programmed instructions of the memory resources may be downloaded from the installation package's source, such as a portable medium, a server, a remote network location, another location, or combinations thereof. Portable memory media that are compatible with the principles described herein include DVDs, CDs, flash memory, portable disks, magnetic disks, optical disks, other forms of portable memory, or combinations thereof. In other examples, the program instructions are already installed. Here, the memory resources can include integrated memory such as a hard drive, a solid state hard drive, or the like.

In some examples, the processing resources and the memory resources are located within the treadmill, the adjustable dumbbell, the mobile device, an external device, another type of device, or combinations thereof. The memory resources may be part of any of these device's main memory, caches, registers, non-volatile memory, or elsewhere in their memory hierarchy. Alternatively, the memory resources may be in communication with the processing resources over a network. Further, data structures, such as libraries or databases containing user and/or workout information, may be accessed from a remote location over a network connection while the programmed instructions are located locally.

What is claimed is:

1. A treadmill, comprising:

a deck;

a first pulley disposed in a first portion of the deck;

a second pulley disposed in a second portion of the deck;

a tread belt surrounding the first pulley and the second pulley;

a scale mechanism incorporated into the deck; and a repetition counter incorporated into the treadmill and in data communication with the scale mechanism.

2. The treadmill of claim 1, further including a motor in mechanical communication with at least one of the first pulley and the second pulley; and a cover superjacent the motor, wherein the scale mechanism is incorporated into the cover over the motor.

3. The treadmill of claim 1, wherein the repetition counter comprises a piezoelectric material.

4. The treadmill of claim 3, wherein the piezoelectric material is incorporated into a cover superjacent a motor.

5. The treadmill of claim 1, further comprising a free weight rack connected to the deck.

6. The treadmill of claim 1, further comprising:

a processor and memory; and a display in communication with the processor;

wherein the processor is in communication with the scale mechanism and the repetition counter, and wherein the memory includes programmed instructions that, when executed, cause the processor to display a weight of a user.

7. The treadmill of claim 6, wherein the programmed instructions, when executed, further cause the processor to determine whether the user is holding a free weight.

8. The treadmill of claim 7, wherein determining whether the user is holding the free weight comprises measuring an increase with the scale mechanism.

9. The treadmill of claim 6, wherein the programmed instructions, when executed, further cause the processor to determine whether the user is executing an anaerobic exercise with a free weight.

10. The treadmill of claim 6, wherein the programmed instructions, when executed, further cause the processor to count anaerobic exercise repetitions performed by the user with the repetition counter.

11. The treadmill of claim 6, wherein the programmed instructions, when executed, further cause the display to present a count of the repetition counter.

12. The treadmill of claim 6, wherein the programmed instructions, when executed, further cause the processor to instruct the user to select a weight amount.

13. The treadmill of claim 12, wherein the programmed instructions, when executed, further cause the processor to instruct the user to perform an exercise with the weight amount.

14. The treadmill of claim 12, wherein the programmed instructions, when executed, further cause the processor to instruct the user to perform a pre-determined repetition count with the weight amount.

15. The treadmill of claim 12, wherein the programmed instructions, when executed, further cause the processor to verify that the user selected the weight amount by measuring an increase with the scale mechanism.

16. The treadmill of claim 12, wherein the programmed instructions, when executed, further cause the processor to verify that the user performed pre-determined repetitions with the repetition counter.

17. A treadmill, comprising:

a deck;

a first pulley disposed in a first portion of the deck;

a second pulley disposed in a second portion of the deck;

a tread belt surrounding the first pulley and the second pulley;

a motor in mechanical communication with at least one of the first pulley and the second pulley;

a cover superjacent the motor;

a scale mechanism incorporated into the cover over the motor;

a repetition counter having a piezoelectric material that is incorporated into the cover and in data communication with the scale mechanism; and a free weight rack connected to the deck.

18. The treadmill of claim 17, further including:

a processor and memory; and a display in communication with the processor;

wherein the processor is also in communication with the scale mechanism and the repetition counter, and wherein the memory includes programmed instructions that, when executed, cause the processor to display a weight of a user.

19. The treadmill of claim 18, wherein the programmed instructions, when executed, further cause the processor to:

instruct the user to select a free weight; and verify that the user selected the free weight by measuring an increase with the scale mechanism.

20. A treadmill, comprising:

a deck;

a first pulley disposed in a first portion of the deck;

a second pulley disposed in a second portion of the deck;

a tread belt surrounding the first pulley and the second pulley;

a motor in mechanical communication with at least one of the first pulley and the second pulley;

a cover superjacent the motor;

a scale mechanism incorporated into the cover over the motor;

a repetition counter having a piezoelectric material that is incorporated into the cover;

a free weight rack connected to the deck;

a processor and memory; and a display in communication with the processor;

wherein the processor is in communication with the scale mechanism and the repetition counter, and wherein the memory includes programmed instructions that, when executed, cause the processor to:

instruct a user to select a free weight;

instruct the user to perform an exercise with the free weight;

instruct the user to perform a pre-determined repetition count with the free weight;

verify that user selected the free weight by measuring an increase with the scale mechanism; and verify that user performed pre-determined repetitions with the repetition counter.

* * * * *